US005921687A

United States Patent [19]

Koike et al.

[11] Patent Number: 5,921,687

[45] **Date of Patent: *Jul. 13, 1999**

[54] PRINTING APPARATUS

[75] Inventors: Kiyoshi Koike; Hiroshi Nakao, both of Nagaokakyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/518,879

[22] Filed: Aug. 24, 1995

Related U.S. Application Data

[62] Division of application No. 07/887,137, May 22, 1992, Pat. No. 5,474,394.

[30] Foreign Application Priority Data

| | | | |
|---|---|---|---|
| May 30, 1991 | [JP] | Japan | 3-127219 |
| May 24, 1991 | [JP] | Japan | 3-119787 |
| May 24, 1991 | [JP] | Japan | 3-119788 |
| Jun. 18, 1991 | [JP] | Japan | 3-145155 |
| Sep. 19, 1991 | [JP] | Japan | 3-239059 |
| Oct. 18, 1991 | [JP] | Japan | 3-270675 |
| Oct. 18, 1991 | [JP] | Japan | 3-271055 |
| Oct. 18, 1991 | [JP] | Japan | 3-271076 |
| Nov. 19, 1991 | [JP] | Japan | 3-94750 |
| Apr. 14, 1992 | [JP] | Japan | 4-93975 |

[51] Int. Cl.[6] ..... B41J 2/32

[52] U.S. Cl. ..... 400/120.01; 400/120.16; 400/120.17; 400/208; 400/708; 400/636; 347/141; 347/177; 347/197; 347/198; 347/214; 347/215; 347/220; 347/221; 347/222; 347/223

[58] Field of Search ..... 400/120.01, 120.02, 400/120.16, 120.17, 219, 88, 207, 208, 248, 708, 636, 120.03, 120.04, 231, 225, 223, 234, 614, 624, 625, 703, 605, 621; 347/223, 171, 177, 197, 198, 214, 215, 220, 221, 222; 492/31

[56] References Cited

U.S. PATENT DOCUMENTS

| | | | |
|---|---|---|---|
| 4,404,568 | 9/1983 | Kikuchi et al. | 400/120.16 |
| 4,614,950 | 9/1986 | Ito | 400/703 |
| 4,616,236 | 10/1986 | Watanabe et al. | 400/207 |
| 4,666,320 | 5/1987 | Kobayashi et al. . | |

(List continued on next page.)

FOREIGN PATENT DOCUMENTS

| | | |
|---|---|---|
| 0186207 | 7/1986 | European Pat. Off. . |
| 0218205 | 4/1987 | European Pat. Off. . |
| 0311982 | 4/1989 | European Pat. Off. . |
| 0315482 | 5/1989 | European Pat. Off. . |
| 0341831 | 11/1989 | European Pat. Off. . |

(List continued on next page.)

OTHER PUBLICATIONS

"Lever & Retaining Assembly for Ribbon Cartridges" IBM Technical Disclosure Bulletin, vol. 27 No. 4A pp. 1860–1862, Sep. 1984.

(List continued on next page.)

*Primary Examiner*—Eugene Eickholt

[57] ABSTRACT

A printing apparatus employs a nearly linear conveying path P2 for printing paper P from a position confronting the platen roller 6 and thermal head 7 for composing the printing unit 3 to the paper discharge unit 2. The capstan roller 4, pinch roller 5, and discharge rollers 10, 10 are disposed opposedly to the conveying path P2, and at an intermediate position of the conveying path P2 intersects the conveying path P1 from the paper supply unit 1 to the printing unit 3. A paper supply port is disposed at the bottom of the paper cassette forming the paper supply unit 1, so that the conveying path P1 from the paper supply port to the printing unit 3 is shortened, and accordingly the paper conveying path is shortened. The printer construction simplified and downsized, while the precision of positioning of the printing paper and positioning of the printing head is enhanced, so that the printing quality may be improved.

49 Claims, 93 Drawing Sheets

U.S. PATENT DOCUMENTS

| | | | |
|---|---|---|---|
| 4,673,304 | 6/1987 | Liu et al. . | |
| 4,687,358 | 8/1987 | Saitou | 400/208 |
| 4,738,555 | 4/1988 | Nagashima . | |
| 4,768,039 | 8/1988 | Akutagawa et al. | 400/208 |
| 4,822,189 | 4/1989 | Dubring et al. | 400/208 |
| 4,944,619 | 7/1990 | Suzuki | 400/208 |
| 4,973,983 | 11/1990 | Yamamoto et al. | 400/208 |
| 4,983,854 | 1/1991 | Mizunu et al. . | |
| 5,001,498 | 3/1991 | Shimizu et al. | 400/636 |
| 5,005,998 | 4/1991 | Takanashi et al. | 400/208 |
| 5,021,804 | 6/1991 | Nozawa et al. | 400/636 |
| 5,036,338 | 7/1991 | Imai | 400/120.16 |
| 5,041,845 | 8/1991 | Ohkudo et al. | 400/621 |
| 5,051,009 | 9/1991 | Sugiura et al. | 400/120.16 |
| 5,069,562 | 12/1991 | Matsuda . | |
| 5,073,053 | 12/1991 | Kashiwagi . | |
| 5,087,925 | 2/1992 | No et al. | 400/708 |
| 5,087,926 | 2/1992 | Wakui | 400/120.16 |
| 5,110,228 | 5/1992 | Yokomizo et al. | 400/208 |
| 5,138,335 | 8/1992 | Sugimoto et al. | 400/219 |
| 5,141,344 | 8/1992 | Murakami et al. | 400/625 |
| 5,148,187 | 9/1992 | Ono et al. | 400/624 |
| 5,149,218 | 9/1992 | Iwatani et al. | 400/625 |
| 5,157,415 | 10/1992 | Seyasu | 400/120.17 |
| 5,168,287 | 12/1992 | Okunomiya et al. | 400/120.16 |
| 5,193,919 | 3/1993 | Godo et al. | 400/120.16 |
| 5,266,972 | 11/1993 | Gotho et al. | 400/248 |
| 5,351,071 | 9/1994 | Matsuda et al. | 400/614 |
| 5,352,048 | 10/1994 | Mizoguchi et al. | 400/208 |
| 5,624,196 | 4/1997 | Jackson et al. | 400/625 |

FOREIGN PATENT DOCUMENTS

| | | | |
|---|---|---|---|
| 0348175 | 12/1989 | European Pat. Off. . | |
| 0388683 | 3/1990 | European Pat. Off. . | |
| 0361826 | 4/1990 | European Pat. Off. . | |
| 0361915 | 4/1990 | European Pat. Off. . | |
| 0392425 | 10/1990 | European Pat. Off. . | |
| 0411462 | 2/1991 | European Pat. Off. . | |
| 4023784 | 2/1989 | Germany . | |
| 3802735 | 8/1989 | Germany . | |
| 0154193 | 12/1980 | Japan . | |
| 6023090 | 7/1983 | Japan . | |
| 58-148779 | 9/1983 | Japan . | |
| 59-76351 | 5/1984 | Japan . | |
| 0167283 | 9/1984 | Japan | 400/605 |
| 0171680 | 9/1984 | Japan . | |
| 59-230782 | 12/1984 | Japan . | |
| 60-89376 | 5/1985 | Japan . | |
| 0139474 | 7/1985 | Japan | 400/625 |
| 0176786 | 9/1985 | Japan | 400/624 |
| 192679 | 10/1985 | Japan . | |
| 242090 | 12/1985 | Japan . | |
| 361150958 | 7/1986 | Japan | 492/31 |
| 0205168 | 9/1986 | Japan | 400/625 |
| 0241178 | 10/1986 | Japan | 400/225 |
| 62-180839 | 8/1987 | Japan . | |
| 62-201281 | 9/1987 | Japan . | |
| 62-172047 | 10/1987 | Japan . | |
| 62-240232 | 10/1987 | Japan . | |
| 0282958 | 12/1987 | Japan | 400/208 |
| 0003978 | 1/1988 | Japan | 400/605 |
| 63-47179 | 2/1988 | Japan . | |
| 63-37243 | 3/1988 | Japan . | |
| 0084960 | 4/1988 | Japan . | |
| 63-62442 | 4/1988 | Japan . | |
| 104862 | 5/1988 | Japan . | |
| 63-102957 | 5/1988 | Japan . | |
| 63-122572 | 5/1988 | Japan . | |
| 63-132065 | 6/1988 | Japan . | |
| 176168 | 7/1988 | Japan . | |
| 63-249674 | 10/1988 | Japan . | |
| 63-286361 | 11/1988 | Japan . | |
| 63-194729 | 12/1988 | Japan . | |
| 64-1962 | 1/1989 | Japan . | |
| 1101180 | 4/1989 | Japan . | |
| 1290465 | 11/1989 | Japan . | |
| H1-275079 | 11/1989 | Japan . | |
| 401301352 | 12/1989 | Japan | 400/208 |
| 000358520 | 3/1990 | Japan | 400/208 |
| 295875 | 4/1990 | Japan . | |
| 402095874 | 4/1990 | Japan | 400/223 |
| 402113974 | 4/1990 | Japan | 400/223 |
| H2115355 | 9/1990 | Japan . | |
| 371270 | 11/1991 | Japan . | |
| 2212111 | 7/1989 | United Kingdom . | |
| 2219281 | 12/1989 | United Kingdom . | |
| 8806100 | 8/1988 | WIPO . | |

OTHER PUBLICATIONS

"Cartridge Latching" IBM Technical Disclosure Bulletin, vol. 21 No. 8, Jan. 1979.

Patent Abstracts of Japan, vol. 14, No. 10, (M–917) (3953) Jan. 10, 1990, JP–A–12 57 074 Oct. 13, 1989.

Patent Abstracts of Japan, vol. 14, No. 003 (M–915) Jan. 8, 1990, JP–A–12 53 472 Oct. 9, 1989.

Patent Abstracts of Japan, vol. 015, No. 194 (M–1114) May 20, 1991, JP–A–30 51 158 Mar. 5, 1991.

PRINTING APPARATUS

This application is a division of U.S. Ser. No. 07/887,137 filed May 22, 1992 and now U.S. Pat. No. 5,474,394.

BACKGROUND OF THE INVENTION

1. Field of the Invention

The present invention relates mainly to a printing apparatus composed as a thermal transfer type using a thermal head.

2. Description of the Related Art

Recently is a mounting demand for an apparatus for reproducing the displays of CRTS and other display screens in color hard copies. As it is easily maintainable, an apparatus for thermal transfer on paper using a color ink sheet having yellow, magenta and cyan colors has been particularly in demand.

For this type of printing apparatus, various structures have been hitherto proposed, and in a general structure, each printing paper separated from the paper supply unit is conveyed along the conveying path into the printing unit where the platen roller and thermal head are opposite to each other, and the printing paper positioned, that is a predetermined leader portion of the printing paper is detected and aligned and the printing processing is executed with respect to the printing paper while being conveyed, and is discharged to the paper discharge unit.

In the case of color printing, the printing paper is moved reciprocally plural times between the platen roller and thermal head by changing the color of ink sheet every time.

This type of printing apparatus is conventionally known in the structures as shown in FIG. 1 to FIG. 4.

FIG. 1 is, for example, a sectional view of a conventional printing apparatus disclosed in the Japanese Patent Application Laid-Open No. 63-249674 (1988). In the drawing, numeral 1 denotes a paper supply unit, 5 is a pinch roller and 10 is a discharge roller. The printing paper P supplied from the paper supply unit 1 is wound around the platen roller 6 by about a half circumference pinch rollers 5, 5 and platen roller 6, and laid over the ink sheet S stored in an ink sheet cassette 8, and while moving the printing paper P and ink sheet S, thermal transfer is effected by the thermal head 7, and the paper is discharged through the discharge roller 10.

In color printing, on one same printing paper P, portions of ink sheet S of plural colors are laid down sequentially to reproduce a color copy. In this case, after printing of one color, the platen roller 6 rotates in the reverse direction of printing operation to return the printing paper P to the print start position, and a different color from the first is printed on the same position of the printing paper P. This operation is repeated as many time as necessary, and when printing is over, the printing paper P is discharged out of the apparatus from the discharge roller 10 through the platen roller 6.

In the conventional printing apparatus shown in FIG. 1, meanwhile, the platen roller 6 has a large diameter, and the paper supply unit 1 and paper discharge unit 2 are located at both sides of the platen roller 6, and separately in the upper and lower directions from the platen roller 6, and therefore the size of the printing apparatus is large, and since the printing paper P is wound around the platen roller 6 and becomes curly, which gives rise to troubles in conveyance. Color deviation is also likely to occur in color printing with such a system.

To solve the problem of the large size of the above described printing apparatus, other printing apparatus were proposed, for example, as shown in FIG. 2 and FIG. 3.

FIG. 2 is, for example, a schematic side view of a conventional printing apparatus disclosed in the Japanese Patent Application Laid-Open No. 180839 (1987). In this printing apparatus, at one side of the platen roller 6 constructing the printing unit 3, a paper supply unit 1 and a paper discharge unit 2 are disposed, and the platen roller 6 is provided with a clamper 6*a*. In the conveying path from the paper supply unit 1 to the platen roller 6, conveying rollers 9, 9 and stationary paper guides Ga, Ga are disposed, while in the conveying path from the platen roller 6 to the discharge roller 10, there are movable paper guide Gg and stationary paper guide Gb.

As shown in FIG. 2(*a*), the printing paper P is individually supplied by the paper supply roller 1*a* from the paper supply unit 1 and is provided to the conveying roller 9. The paper is then conveyed to the opposing position of the thermal head 7 and platen roller 6 while being regulated by the stationary paper guide Ga, and with the front end portion thereof being clamped by the clamper 6*a* of the platen roller 6, it is taken up on the platen roller 6 along with the rotation of the platen roller 6. The thermal head 7 is lowered onto the platen roller 6 together with the ink sheet S, and is pressed against the surface of the printing paper P, so that thermal transfer is effected by the thermal head 7.

When printing is over, the platen roller 6 stops, and the thermal head 7 retracts. The movable paper guide Gg descends to abut against the circumference of the platen roller 6, thereby changing the conveying path to the discharge roller 10 side.

Finally, as shown in FIG. 2(*b*), the platen roller 6 rotates in the reverse direction to that of the printing operation, and the printing paper P is sent out to the discharge roller 10 side along the movable paper guide Gg and stationary paper guide Gb, and is discharged out of the apparatus by the discharge roller 10.

On the other hand, FIG. 3 is, for example, a side view disclosed in the Japanese Patent Application Laid-Open No. 63-286761 (1988). In this printing apparatus, similarly, the paper supply unit 1 and paper discharge unit 2 are disposed in the upper and lower positions at one side of the printing unit 3, and the printing paper P is supplied individually from the paper supply unit 1 through the paper supply belt 1*b* is wound up on the circumference of the pinch roller 5 from the lower side of the platen roller 6, and is laid over on the ink sheet S on the platen roller 6, to perform thermal transfer by the thermal head 7. When printing is over, the movable paper guide Gg slides on the circumference of the platen roller 6, so as to discharge the printing paper P into the paper discharge unit 2 through the paper supply belt 1*b*.

During color printing in such a device, the printing paper P is rotated as many times as necessary along the circumference of the platen roller 6 so as to contact with ink sheets S of different colors to print these different colors. Symbol F denotes a cooling fan of the thermal head 7.

In the conventional printing apparatus shown in FIG. 2 and FIG. 3, since the paper supply unit 1 and paper discharge unit 2 are disposed in upper and lower positions at one side of the printing unit 3, the size can be notably reduced. However, since the diameter of the platen roller 6 is large, and downsizing is limited, and since in the structure of printing by winding the printing paper P on the platen roller 6, being same as in the printing apparatus shown in FIG. 1, the printing paper P is likely to be curly, and the number of parts increases because the conveying path for suppling the printing paper P and the conveying path for discharging are changed by operation of the movable paper guide Gg, and since the movable paper guide Gg is located near the platen roller 6, it is difficult to remove the paper in the event of paper jamming.

As the means for solving the problems in the conventional printing apparatus shown in FIG. 2 and FIG. 3, the printing apparatus as in FIG. 4 is known.

In FIG. 4, the paper supply unit and paper discharge unit (neither shown) are disposed at one side (the left side in FIG. 4) of the printing unit 3, and the platen roller 6 is made small in diameter, and capstan roller 4 and pinch roller 5 are disposed opposedly across the conveying path immediately before the platen roller 6, that is, at the side of paper supply unit 1 and paper discharge unit 2, and the conveying path connecting the capstan roller 4 and platen roller 6 are formed nearly in a linear form.

In such a conventional printing apparatus, although the size is further reduced by reducing the diameter of the platen roller 6, it is necessary to determine the entire layout about the conveying path of the printing paper P, including the relation with the paper supply unit 1, paper discharge unit 2, and printing unit 3, but this point has not been considered sufficiently.

Incidentally, the paper supply unit 1, paper discharge unit 2 and printing unit 3 which is composed of the thermal head 7 and ink sheet cassette 8 and others in the conventional printing apparatus are structured as described below.

FIG. 5 is a schematic side view showing a practical construction of the paper supply unit 1 in the conventional apparatus, and FIG. 6 is a perspective view of essential parts seen from the bottom side of the same, in which numeral 11 denotes a paper cassette for composing the paper supply unit 1. The paper cassette 11 comprises a casing 12 and a core member 13, and the casing 12 is open at the front side and in the front side bottom in the paper supply direction of the printing paper P, and a top plate 12*a* is disposed in the upper portion, and the core member 13 is provided inside. Below the paper cassette 11, a paper supply roller 14 and a push-up member 15 are disposed, and a stationary paper guide 16 is installed further ahead.

The core member 13 has separation pawls 13*b*, 13*b* for supporting the lower portion of the right and left corners at the front end side of the supplying direction of the printing paper P stored in the casing 12, and the right and left side walls of the rear end portion are pivoted on the side wall of the casing 12 by using a shaft 13*c*. The push-up member 15 and arm 14*a* of the paper feed roller 14 are coaxially pivoted by using a shaft 15*a*, and they are rotated in the direction of arrow around the shaft 15*a* by a drive unit not shown, while the paper supply roller 14 is rotated, and the push-up member 15 contacts with or departs from the contact piece 13*d* of the core member 13, and the paper supply roller 14, with or from the bottom of the printing paper P exposed in the lower side of the casing 12. As a result, the paper feed roller 14 is rotated about the shaft 15*a*, and contacts with the lower side of the printing paper P with a predetermined pressure, and by the frictional force acting between them, the printing paper P at the lowest position is separated from the others, and is fed forward.

The operation of such paper supply unit 1 is explained below by reference to the explanatory view of FIG. 7.

FIG. 7 shows the paper supply state, in which the push-up member 15 is rotated about the shaft 15*a* and abuts against the contact piece 13*d*, and pushes and rotates the core member 13 until the upper surface of the printing paper P abuts against the top plate 12*a* about the shaft 13*c*, with the both sides of the front portion of the printing paper P held in the separation pawl 13*b*, and stops in the state being thrust upward.

The arm 14*a* is also rotated in the same direction, and presses the paper supply roller 14, which is rotated and driven, to contact with the lower side of the printing paper P with a predetermined pressure. By the frictional force acting between the paper supply roller 14 and printing paper P, the printing paper P at the lowest position is separated from the other printing papers, and the front end portion slips out of the separation pawl 13*b*, and is guided by the stationary paper guide 16 to be fed into the printing unit 3.

The paper supplying position of the printing paper P is moved from position D to position E as the number of sheets decreases.

In such a conventional paper supply unit 1, meanwhile, since the paper supplying position moves from D to E depending on the number of sheets of the printing paper P, when the storage capacity of the printing paper P is increased, the interval of the stationary paper guides 16 is also increased accordingly, and the stationary paper guides 16 come to occupy a wide space.

FIG. 8 is, for example, a schematic plan view showing the positioning means of printing paper P for the printing unit 3 in the conventional printing apparatus disclosed in the Japanese Patent Application Laid-Open No. 1-290465 (1989), and FIG. 9 is its schematic side view. At one side of the opposing positions of platen roller 6 and thermal head 7, that is, at the opposite side of the layout position of the capstan roller 4 and pinch roller 5, stationary paper guides 17*a*, 17*b* are disposed opposedly above and beneath, and a conveying path for switchback is formed. The front end of the upper stationary paper guide 17*a* serves also as the guide of the ink sheet cassette 8, and a hole Gc is provided in the center of the rear end portion, and a front end sensor SE is disposed here, and a reflector 18 is disposed in the opposing lower stationary paper guide 17*b*. When the printing paper P is detected by the front end sensor SE, the rotation of the capstan roller 4 is stopped, and the printing paper P is positioned, that is, predetermined leader portion is detected and aligned.

The operation of such positioning means is described below by reference to the explanatory view shown in FIG. 10. When supplying paper, as shown in FIG. 9, the thermal head 7 is waiting aside above the platen roller 6, and the printing paper P is conveyed in the arrow direction by the pinch roller 5 and capstan roller 4, and is led in between the stationary paper guides 17*a*, 17*b*. When the front end of the printing paper P comes to the sensing point of the front end sensor SE, driving of the capstan roller 4 stops, thereby finishing the detection and alignment of the printing paper P.

As shown in FIG. 10, the thermal head 7 descends until the ink sheet S contacts tightly with the printing paper P, and the platen roller 6 and capstan roller 4 are rotated and driven reversely, and the printing paper P is switched back in the arrow direction, and the thermal head 7 is heated to make printing.

In color printing, after printing one color in the step shown in FIG. 10, the printing paper P is switched back and returned to the position shown in FIG. 9, and the ink sheet S of the next color is detected, and thereafter the operation shown in FIG. 9 and FIG. 10 is repeated as many times as required.

In such conventional positioning means, in the case where the beginning of the printing paper P is detected, since the distance between the front end sensor SE of the printing paper P and the heat generation unit 7*a* of the thermal head 7 is long, the printing paper P sags on the way, and slipping occurs between the printing paper P and capstan roller 4, pinch roller 5, and the printing paper P may run obliquely, and the positioning precision is poor, the print start position is likely to be dislocated, and color deviation occurs in color printing.

FIG. 11 is, for example, a schematic plan view showing a thermal head and its positioning means in a conventional printing apparatus disclosed in the Japanese Patent Application Laid-Open No. 63-132065 (1988), and FIG. 12 is its schematic side view. The thermal head 7 is shaped like a rod, comprising a linear heating portion 7*a* in the middle of the lower side opposite to the platen roller 6, and radiation fin 7*b* in the upper side, and the middle portion of the holding members 21, 21 disposed at both ends in the longitudinal direction is pivoted in the middle of the support arms 22*a*, 22*a* of the pressing member 22 through the shafts 21*a*, 21*a*.

The pressing member 22 has a pressing plate 22*b* opposing to the thermal head 7 in a straddling manner over the upper sides of the front end portions of support arms 22*a*, 22*a* in an L-shape in side view, and plural contact springs 23 are disposed between the pressing plate 22*b* and the upper surface of the thermal head 7, accumulating a dilating force, and each base end portion is pivoted on the shaft 22*c*, and drooping pieces 22*d* disposed at both ends of the front end portion of the support arms 22*a*, 22*a* are provided with notches 22*a* to be engaged with the shaft 6*b* of the platen roller 6, while stopper pieces 22*f*, 22*f* are projected at the positions confronting the rear end portions 21*c* of the support members 21, 21.

The operation of such thermal head 7 is explained referring to the explanatory view of FIG. 13.

FIG. 13(*a*) shows a state of the thermal head 7 in the waiting position, and in this state, by the dilating force of the contact spring 23, the holding member 21 and support arm 22*a* of pressing member 22 are thrust in the mutually departing directions, and the rear end portion 21*c* of the holding member 21 is abutting against the stopper piece 22*f*.

When pressing the thermal head 7 to the platen roller 6, by the drive unit not shown, the pressing member 22 is rotated in the arrow direction shown in FIG. 13(*b*) about the shaft 22*c* together with the holding member 21, and the thermal head 7 abuts against the circumference of the platen roller 6, and the notches 22*g* formed in the support arm 22*a* of the pressing member 22 are engaged with the shaft 6*b* of the platen roller 6, thereby relatively positioning the thermal head 7 and platen roller 6.

From the state in FIG. 13(*b*), when the pressing member 22 is further rotated, since the thermal head 7 is contacting with the platen roller 6, the contact spring 23 is compressed, and the thermal head 7 is pressed by the platen roller 6 to be in the state shown in FIG. 12, thereby pressing the thermal head 7 to the platen roller 6 and positioning the heating portion 7*a* of the thermal head, and in this state the heating unit 7*a* is heated to make printing.

In such conventional thermal head 7 and its holding member 21, looseness is likely to occur between the notch 22*g* and shaft 6*b* for relatively positioning the thermal head 7 and platen roller 6, and color deviation occurs, but, to <the contrary, when the fitting of the notch 22*g* and shaft 6*b* is too tightly, the contact pressure of the heating portion 7*a* in the thermal head 7 changes, and uneven density occurs, and the load of the platen roller 6 on the shaft 6*b* increases to cause driving loss, and the rotating speed of the platen roller 6 varies, and color deviation occurs similarly.

FIG. 14 is, for example, a schematic plan view showing driving unit and cooling means of a thermal head 7 in a conventional printing apparatus disclosed in the Japanese Utility Model Application Laid-Open No. 63-37243 (1988), and FIG. 15 is its schematic side view, in which another shaft 24 is disposed parallel to a shaft 22*h* for pivoting the base end portion of a support arm 22*a* at the pressing member 22, the shaft 24 being provided with cam 24*a* and gear 24*b* to slide and contact with the shaft 22*h* and this gear 24*b* is coupled with a motor M1 through reduction gear 24*c* and worm gear 24*d*.

As the cooling means of the thermal head 7, a radiation fin 7*b* is disposed on the upper surface of the thermal head 7, and a cooling fan 25 is installed above the thermal head 7. The radiation fin 7*b* is dense in the interval thereof in the middle of the longitudinal direction corresponding to the distribution of the accumulated heat temperature of the thermal head 7 shown in FIG. 16, and loose in the interval thereof gradually as going toward the both ends therefrom, so as to cool corresponding to the accumulated heat distribution of the thermal head 7.

The cooling fan 25 is installed so as to blow air always down toward the thermal head 7 side as indicated by arrow shown in FIG. 15. Numeral 26 is a stopper, disposed at the upper side of the both end portions of the thermal head 7, and is linked to the support arm 22*a* of the pressing member 22, thereby regulating the mutual maximum spacing distance.

The other parts are identified with the same reference numbers as the corresponding parts in the conventional apparatus shown in FIG. 11 and FIG. 12.

The operation of the thermal head 7 is explained below by reference to the explanatory view shown in FIG. 17. FIG. 17(*a*) shows the waiting state, in which air is blown to the thermal head 7 by the cooling fan 25.

When pressing the thermal head 7 to the platen roller 6, first the motor M1 shown in FIG. 15 is rotated to turn the shaft 24 and drive the cam 24*a*, and the pressing member 22 and the thermal head 7 are rotated together in the direction of the arrow in broken line as shown in FIG. 17(*a*), then the thermal head 7 is fitted to the circumference of the platen roller 6 as shown in FIG. 15.

From the state shown in FIG. 15, the cam 24*a* is further rotated, and the contact spring 23 is compressed by the pressing member 22, and the thermal head 7 is pressed against the platen roller 6 as shown in FIG. 17(*b*) to make printing. At this time, the heat from the thermal head 7 is released through the radiation fin 7*b*, while air is brown in from the cooling fan 25 to cool.

The cooling means, incidentally, may comprises a cooling fan F as shown in FIG. 3.

In such conventional cooling means, the surface area of the radiation fin 7*b* is small, and a sufficient cooling effect is not obtained for the amount of heat generated by the thermal head 7, and since the cooling fan 25 or F is installed above the thermal head 7, even while the thermal head 7 is at waiting position, the position of installation of the cooling fan 25 or F is high in order to avoid mutual interference, and to the contrary, the distance from the thermal head 7 is long while printing, resulting in the cooling effect being smaller, and moreover the overall height of the printing apparatus becoming high, and when the heat is accumulated more in the thermal head 7, the ink of the ink sheet S sublimes in excess, and is transferred on the printing paper P, and hence the printing density varies with the passing of the time.

FIG. 18 is, for example, a perspective view of an ink sheet cassette 8 in a conventional printing apparatus disclosed in the Japanese Patent Application Laid-Open No. 63-47179 (1988). The ink sheet cassette 8 comprises a cylindrical feed side bobbin 31 winding an unused ink sheet S, and a cylindrical takeup side bobbin 32 for taking up the used ink sheet S, which are incorporated inside thereof in parallel to each other with each one end exposed outside.

Such ink sheet cassette 8 is stored in a storage magazine 33, and is inserted into or removed from the printing apparatus in a state of coupling the bobbins 31, 32 with a reel device 34. The reel device 34 is designed to take up the ink sheet S by rotating the bobbin 32 about its axial center line by means of a drive unit not shown.

In such conventional ink sheet cassette 8, when detaching or attaching it, the storage magazine 33 must be drawn out to the front panel of the printing apparatus by sliding in the arrow direction, and the ink sheet cassette 8 is taken out by putting a hand into the storage magazine 33, and the ink sheet cassette 8 must be put in, and it takes time to detach and attach the ink sheet cassette 8, and the slide mechanism is needed for inserting the storage magazine 33 into the printing apparatus or removing it therefrom, and the number of parts of the printing apparatus increases on the whole.

FIG. 19 is, for example, a perspective view of a drive system corresponding to the reel device 34 (see FIG. 18) and discharge roller 10 (see FIG. 1 and FIG. 2) in a conventional printing apparatus disclosed in the Japanese Patent Application No. 63-122572 (1988). In the drawing, numeral 41 is a gear linking with a reel device 34, and 42 is a gear linking with a discharge roller 10 of printing paper P. The both gears 41, 42 are disposed by keeping their axial center lines parallel and deviating by a predetermined interval in the axial center line direction, and in the middle of the both gears 41, 42 is disposed a shaft 44 of a square section formed integrally with the shaft of a worm wheel 43, and a relay gear 45 is put on the shaft 44 so as to slide thereon through a compression spring 44*a*.

On the side of the relay gear 45, that is, on the opposite side of the contact side of the compression spring 44*a*, one fork-shaped end of a changeover lever 46 having the middle portion pivoted by a shaft 46*a* is located opposedly across the shaft 44. At the other end of this changeover lever 46, an engaging groove 46*b* is provided, and this engaging groove 46*b* is engaged with a pin 47*a* projecting a little close to the peripheral side of the worm wheel 47. The worm wheels 43, 47 are linked with respective motors M2, M3 through worm gears 48, 49.

Such drive system is explained below by reference to the explanatory views of operation shown in FIG. 20 and FIG. 21. FIG. 20 shows the engaged state of the relay gear 45 and gear 41 linked with the reel device 34 of the ink sheet cassette 8, while the relay gear 45 and the gear 42 linked with the discharge roller 10 are not engaged.

The driving force of the motor M2 is transmitted only to the gear 41 through worm gear 48, worm wheel 43, shaft 44 and relay gear 45, and the reel device 34 is driven. Next, when the motor M3 rotates in a predetermined direction, the worm gear 49 and worm wheel 47 rotate, and the changeover lever 46 rotates about the shaft 46*a* through a pin 47*a*, and the relay gear 45 oscillates in the arrow direction against the dilating force of the compression spring 44*a*, so that the relay gear 45 is released from the gear 41 and is engaged with the gear 42 as shown in FIG. 21.

In this state, the driving force of the-motor M2 is transmitted only to the gear 42, and the discharge roller 10 is driven, and the reel device 34 stops. When the motor M3 rotates in the reverse direction, the relay gear 45 is released from the gear 42, and is engaged with the gear 41 to return to the state shown in FIG. 20.

Thus, in the conventional drive system as abovementioned, the motor M3 is necessary separately for changing over the transmission of driving force, and the number of motors increases, resulting in the mechanism being complicated, the reliability being lowered, and the entire apparatus becoming larger in size.

SUMMARY OF THE INVENTION

It is hence a primary object of the invention, devised in the light of the background stated above, to present a printing apparatus which is reduced in the overall size of apparatus, shorter and linear in the conveying path of the. printing paper so as to prevent conveying troubles of the printing paper, and heightened in the positioning precision of the printing paper and thermal head to the platen roller so as to prevent color deviation and thereby obtain printing of high quality.

A printing apparatus is composed in a constitution in which the conveying path of printing paper being from the confronting position of the platen roller and thermal head for composing the printing unit to the paper discharge unit is nearly linear, the capstan roller, pinch roller, and discharge rollers are disposed opposedly to the conveying path, and an intermediate position of the conveying path is joined with the conveying path being from the paper supply unit to the printing unit, and a paper supply port is disposed at the bottom of the paper cassette for composing the paper supply unit, so that the conveying path being from the paper feed port to the printing unit is shortened, and accordingly the paper conveying path is shortened, the constitution is simplified and downsized, while the precision of positioning of the printing paper and positioning of the printing head is enhanced, so that the printing quality may be improved.

The above and further objects and features of the invention will more fully be apparent from the following detailed description with accompanying drawings.

DESCRIPTION OF THE PREFERRED EMBODIMENTS

Figure 1:
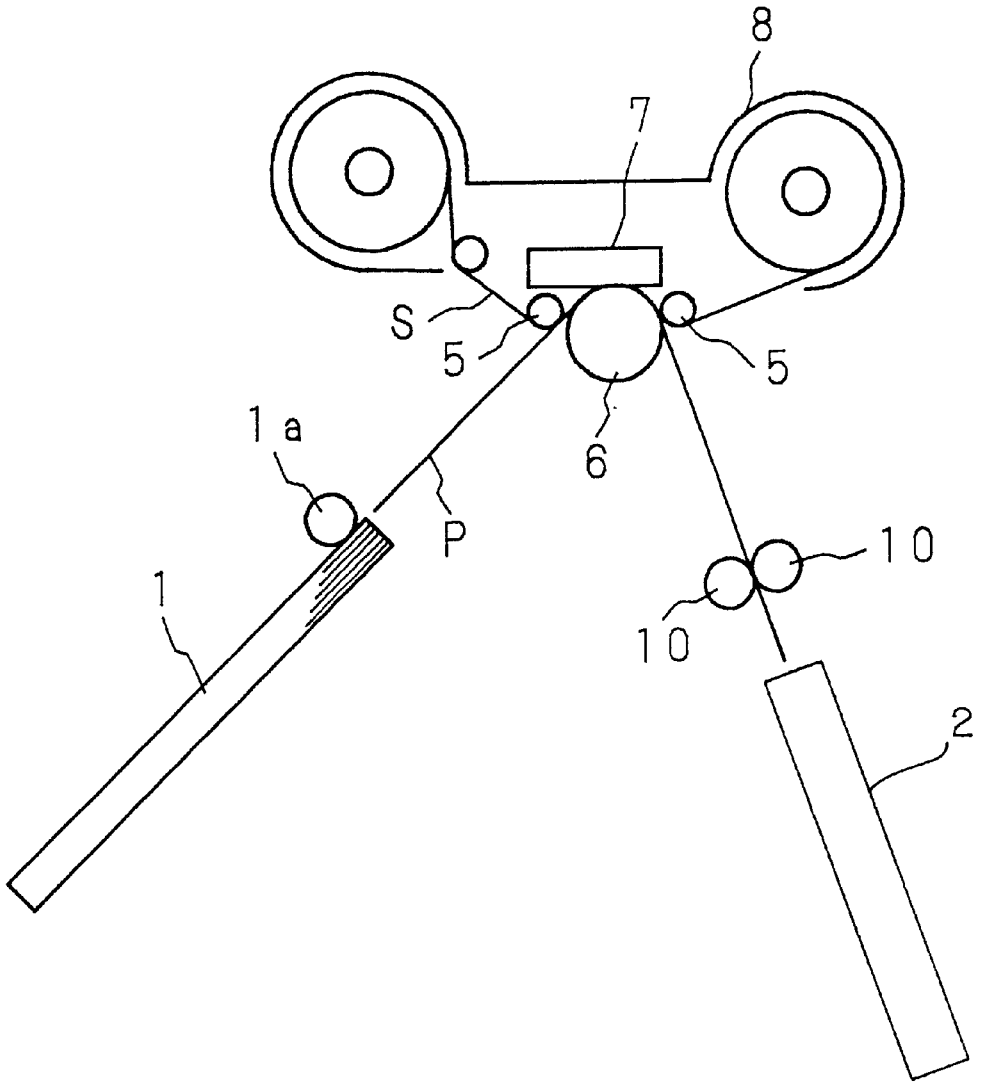
Fig. 1 Prior Art
FIG. 1 is a schematic side view showing a conventional printing apparatus.

Referring now to the drawings, some of the preferred embodiments of the invention are described in detail below.

Figure 22:
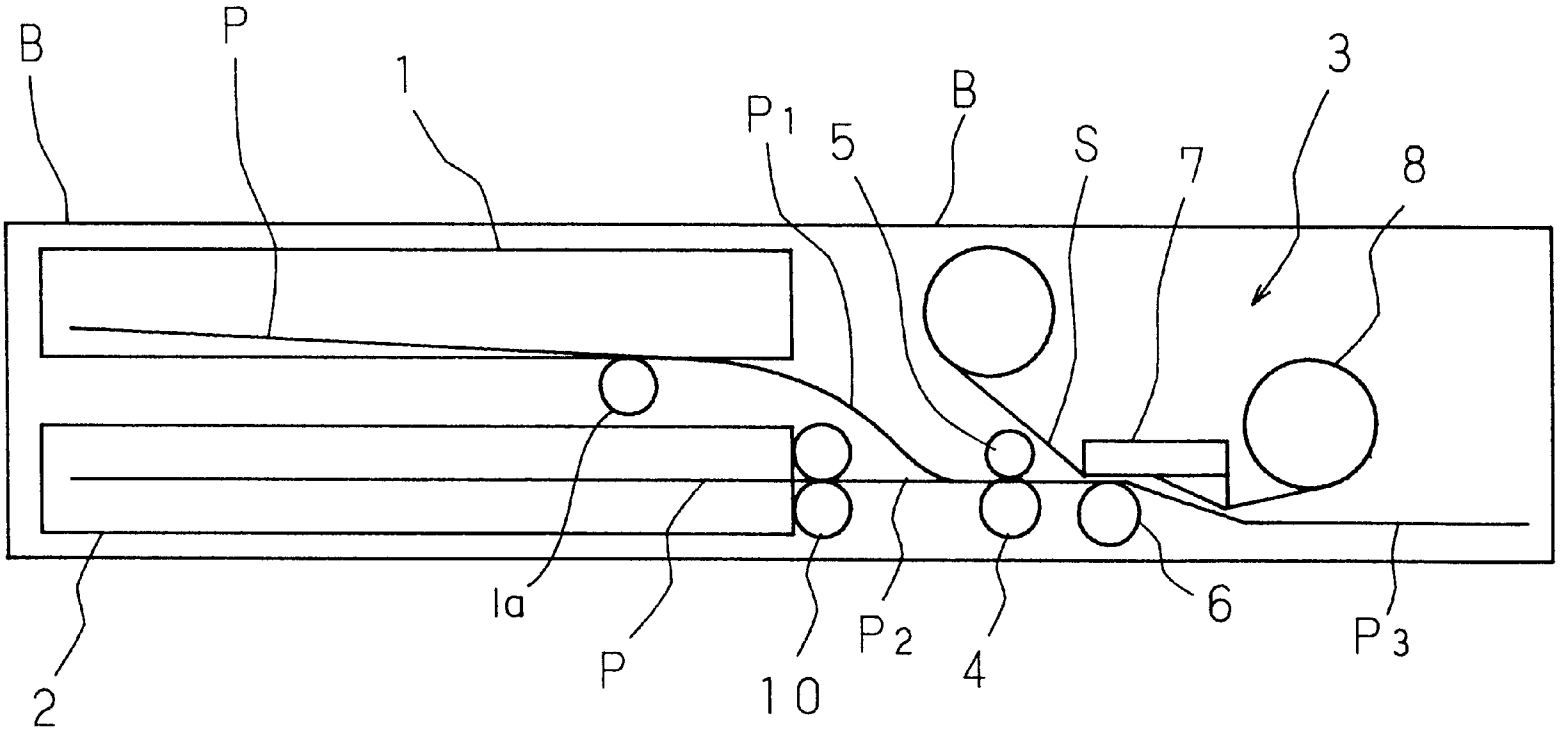
FIG. 22 is a schematic side view of a printing apparatus of the invention.
Figure 23:
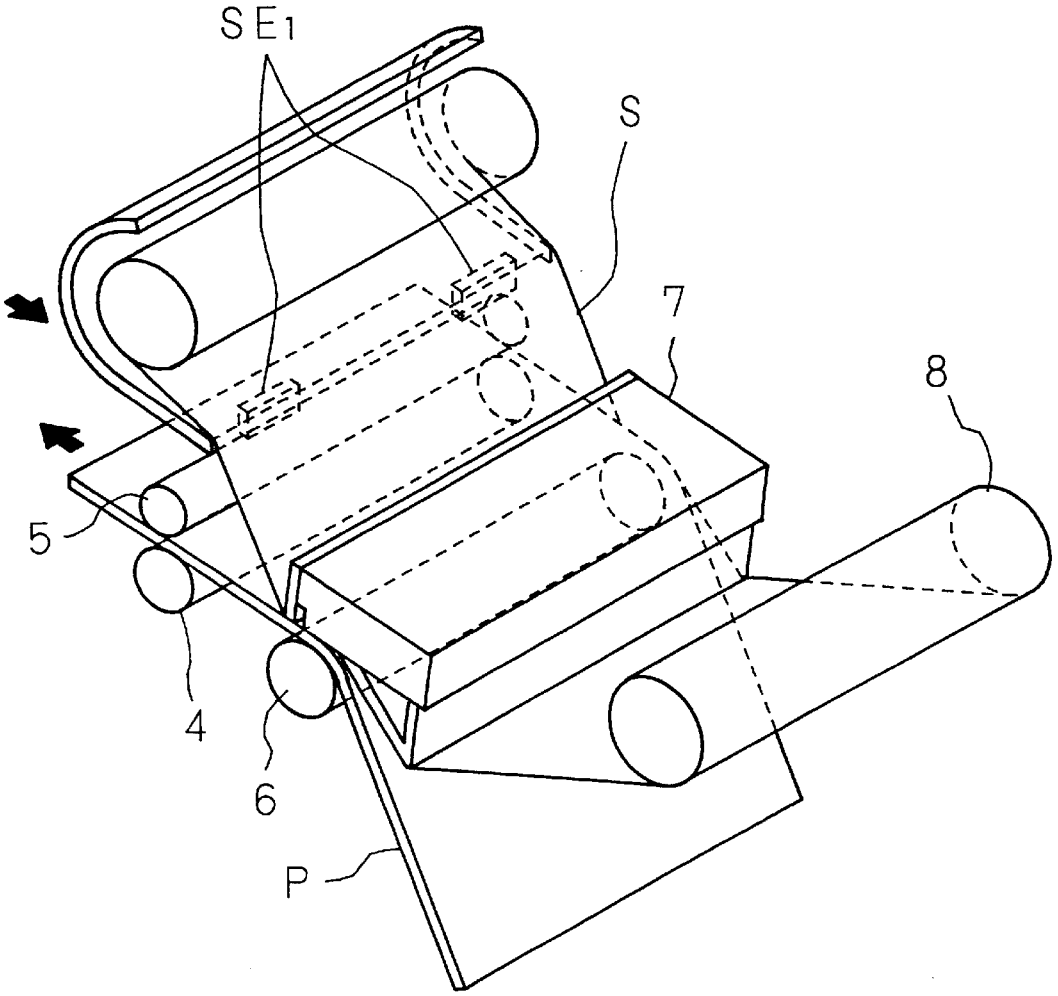
FIG. 23 is a perspective view of its essential parts.

FIG. 22 is a schematic side view of a printing apparatus of the invention, and FIG. 23 is a perspective view of its essential parts. In the drawing, numeral 1 denotes a paper supply unit for feeding printing paper P sheet by sheet, 2 is a discharge unit for collecting the printing paper P after printing, and 3 is a printing unit. The paper supply unit 1 and discharge unit 2 are stacked up vertically and disposed at one side in a box B , and the printing unit 3, comprising platen roller 6, thermal head 7, ink sheet cassette 8 and others, is disposed at the other side in the box B across a predetermined interval from the paper supply unit 1 and discharge unit 2.

Conveying paths P1, P2 of printing paper P are arranged between the printing unit 3 and paper supply unit 1, and discharge unit 2, and a conveying path P3 for switching back the printing paper P is formed behind the printing unit 3. The conveying path P2 linking the printing unit 3 and discharge unit 2 is formed in a nearly horizontal linear profile, and on the way it is joined with the conveying path P1 going from the paper supply unit 1 to the printing unit 3 at a predetermined angle. At the printing unit 3 side position from this junction point of the conveying paths P1, P2, a capstan roller 4 is disposed beneath, and a pinch roller 5 is located above, and a discharge roller 10 is installed just before the discharge unit 2. Besides, SE1 is a sensor for detecting and aligning out the beginning portion of ink sheet S.

Figure 24:
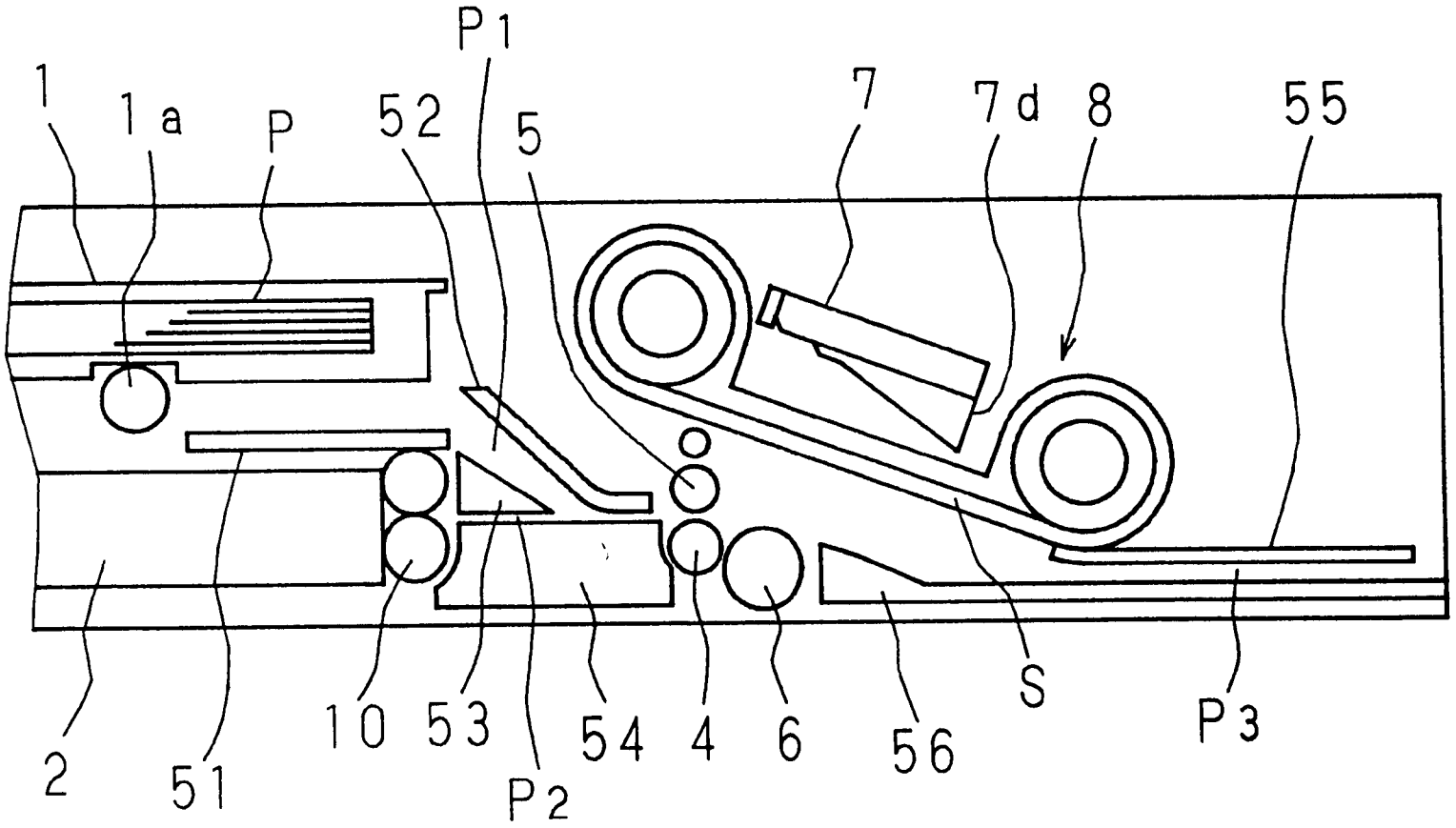
FIG. 24 is a schematic side view showing a practical structure of a conveying path of printing paper in a printing apparatus of the invention, FIGS. 25(*a*)–(*c*) are explanatory drawings showing the conveying passage of the printing paper conveyed in the conveying path shown in FIG. 24.

FIG. 24 is a schematic side. view showing practically the constitution of essential parts shown in FIG. 22. In order to compose the conveying path P1, a stationary paper guide 51 is disposed beneath the paper supply unit 1, and other stationary paper supply guides 52, 53 are provided from the front end of the stationary paper guide 51 to the junction point of the conveying paths P1, P2. On the other hand, to compose the conveying path P2, a stationary paper guide 54 is disposed between the capstan roller 4 and discharge roller 10, and behind the platen roller 6, moreover, stationary paper guides 55, 56 are disposed above and below to compose the conveying path P3.

The conveying path of the printing paper P is described below by reference to the operation drawing shown in FIG. 25. The printing paper P sent out from the paper supply unit 1 by the paper supply roller 1*a* is conveyed between the stationary paper guides 51, 52, 53 as shown in FIG. 25(*a*), and gets into the conveying path P2 from the conveying path P1, and is pinched between the capstan roller 4 and pinch roller 5 and conveyed, running through the platen roller 6 and thermal head 7, and is led behind into the conveying path P3 between the stationary paper guides 55, 56, and when the rear end portion of the printing paper P reaches a specified position between the platen roller 6 and thermal head 7, as shown in FIG. 25(*b*), the printing paper P is stopped, and the leader portion of the printing paper P is detected and aligned.

Figure 25A:
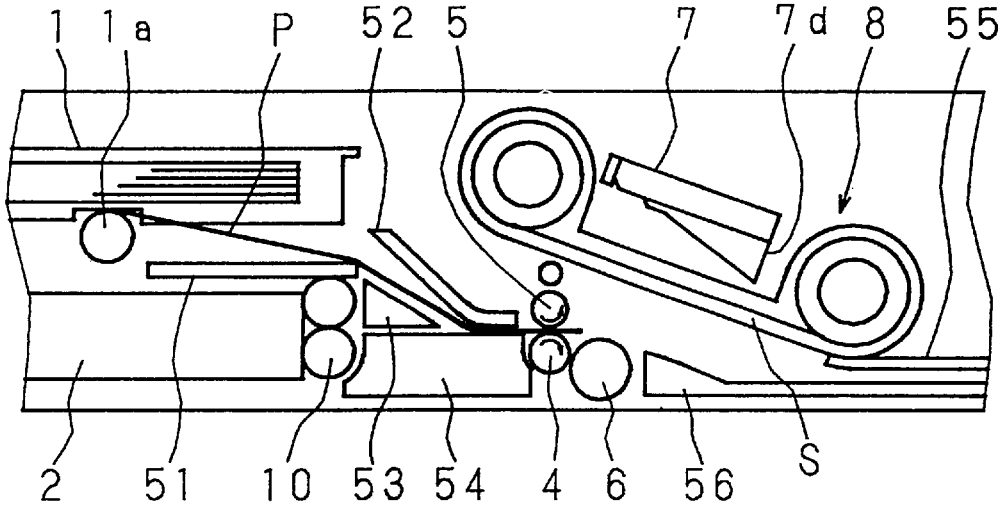
Figure 25B:
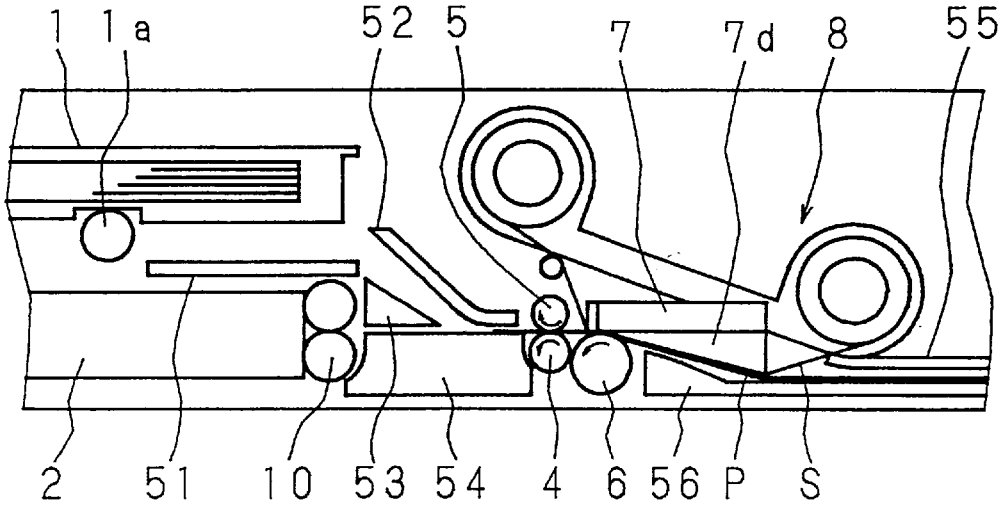
Figure 25C:
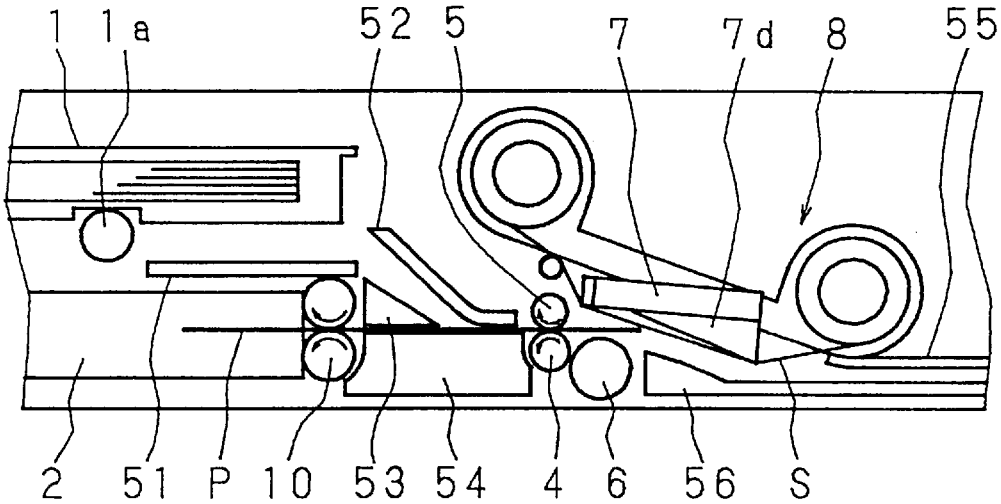

The thermal head 7 descends together with the ink sheet S in the ink sheet cassette 8, and is pressed onto the printing paper P on the platen roller 6, and the platen roller 6 and capstan roller 4 are rotated reversely, and while the printing paper P is conveyed in the conveying path P2 to the discharge unit 2 side as shown in FIG. 25(*c*), the thermal head 7 is energized, and printing is made through the heat generation unit 7*a*, and when printing is over, it is discharged intact into the discharge unit 2. In this process, in order to protect the integrated circuit disposed beneath the thermal head 7, a part of the head cover 7*d* functions as the guide for the printing paper P.

In the case of color printing, meanwhile, the printing paper P is moved reciprocally between the platen roller 6 and thermal head 7 in the conveying path P2, through ink sheets S of different colors every time, to make printing plural times, and is discharged into the discharge unit 2.

Constitution of Conveying Path of Printing Paper

Figure 26:
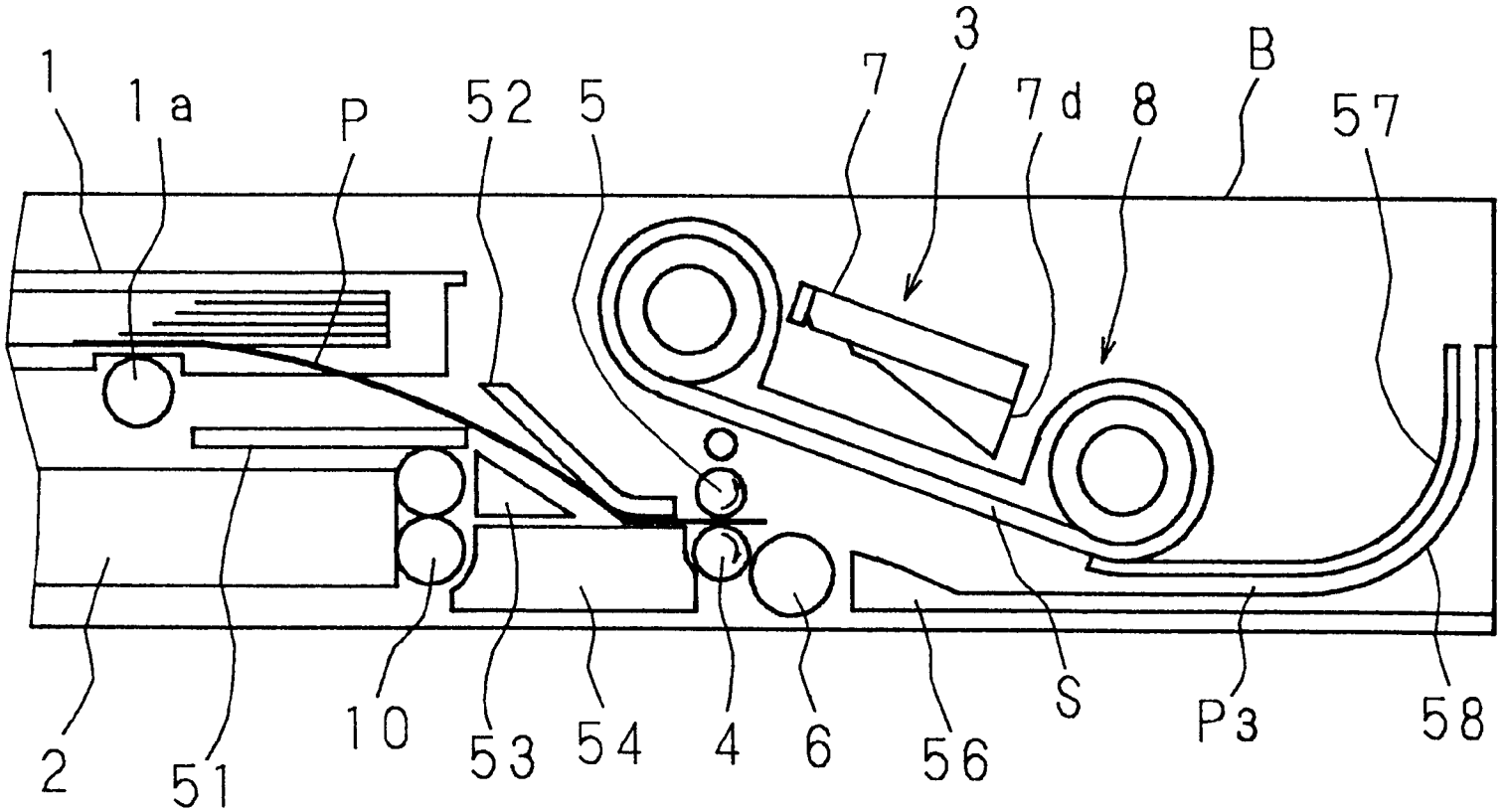
FIG. 26 is a schematic side view showing other example of conveying path.

FIG. 26 is a schematic side view showing the case of composing a long conveying path P3 corresponding to a long printing paper P, in which stationary paper guides 57, 58 for composing the conveying path P3 behind the printing unit 3 are disposed after being curved upward along the side wall of the box B.

The other constitution and operation are substantially same as in the constitution of the printing apparatus shown in FIG. 25, and corresponding parts are identified with same reference numbers.

In such constitution, the free space in the box B may be effectively utilized, and the box B is prevented from becoming larger in size.

Figure 27:
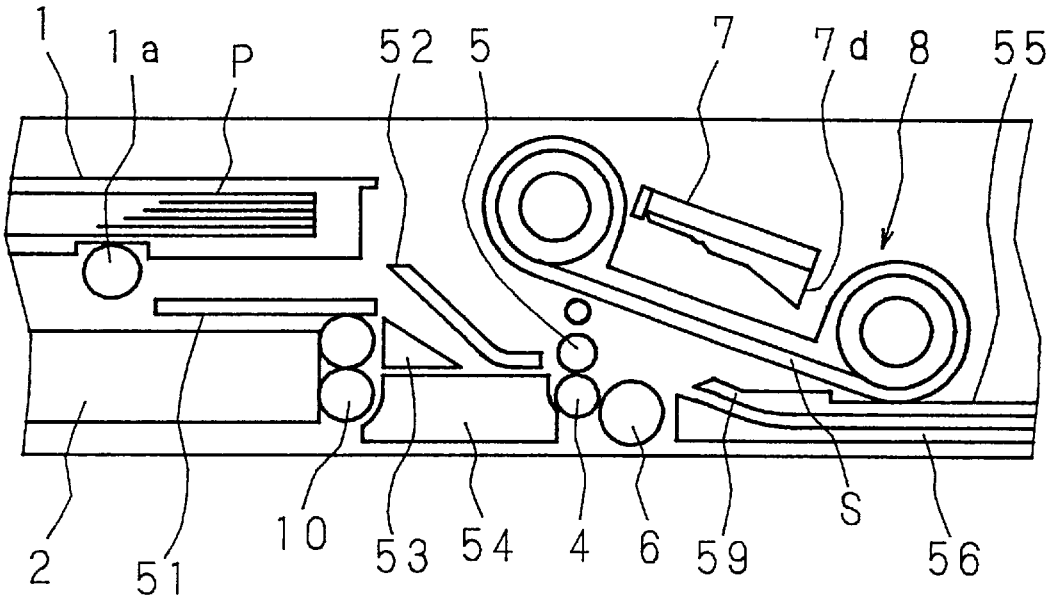
FIG. 27 is a schematic side view showing a different example of conveying path of printing paper.
Figure 28:
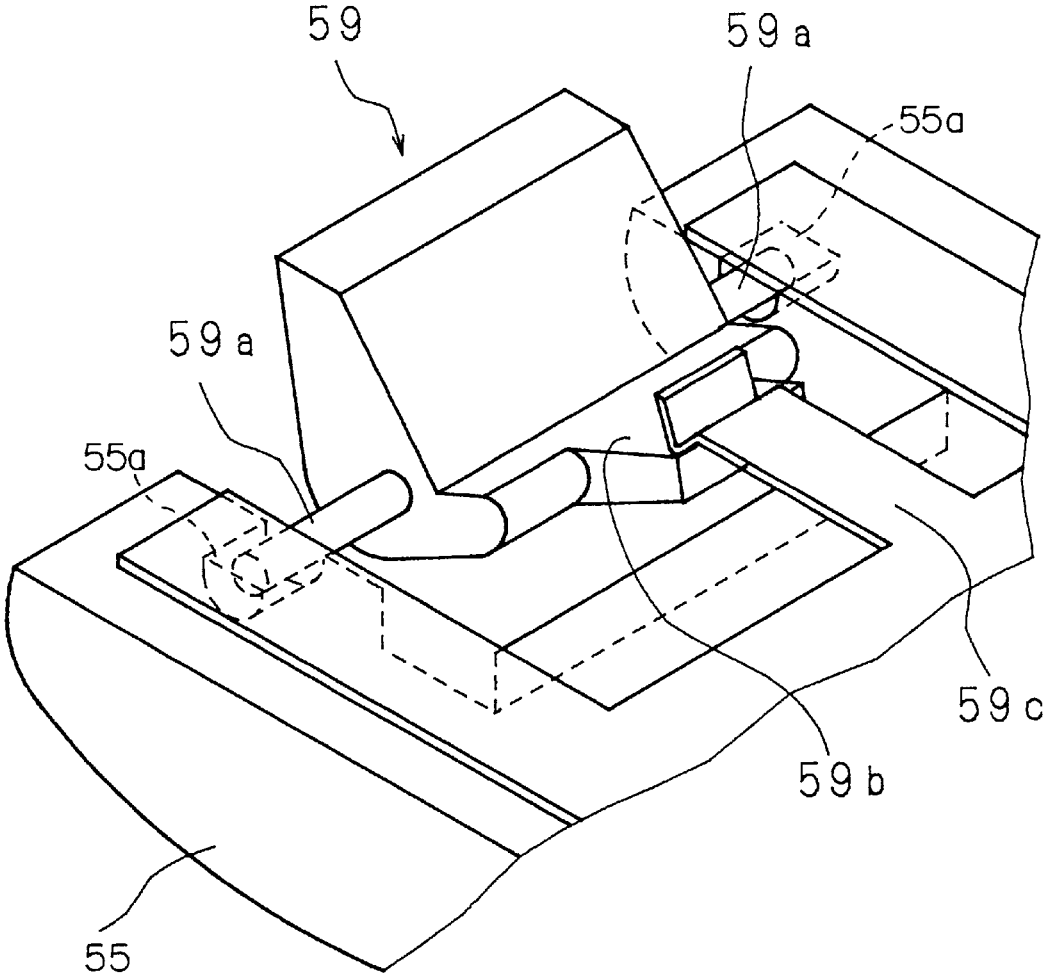
FIG. 28 is an enlarged perspective view of essential parts of the conveying path shown in FIG. 27.

FIG. 27 is a schematic side view showing a further different example of the conveying path of the printing paper P, and FIG. 28 is an enlarged perspective view of its essential parts. In this embodiment, of the upper and lower stationary paper guides 55, 56 formed behind the platen roller 6, the front end portion of the stationary paper guide 55 is extended to the platen roller 6 side, and at the extended front end, a movable paper guide 59 is disposed.

The movable paper guide 59 is curved in a V-form as obvious from the side view in FIG. 28, and the curved portion is pivoted by the shaft 59*a*, in the hole 55*a* opened in the stationary paper guide 55, while a leaf spring 59*c* is abutting against the base end portion 59*b*, and the front end portion is always thrust and held in the direction of departing from the stationary paper guide 56 side by the leaf spring 59*c*.

Figure 30:
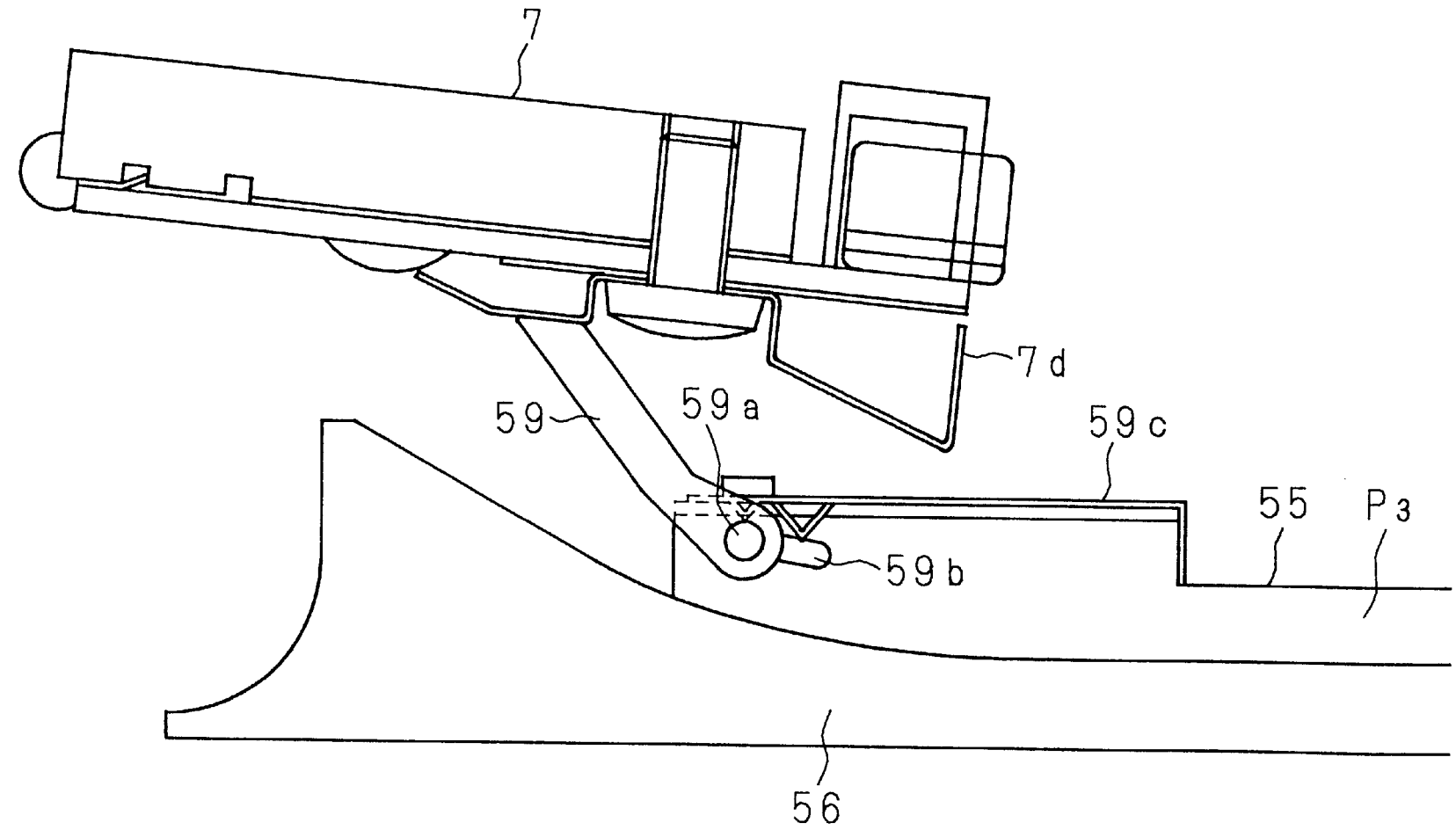
FIG. 30 is an explanatory view of an operation of a movable paper guide shown in FIG. 27.
Figure 31:
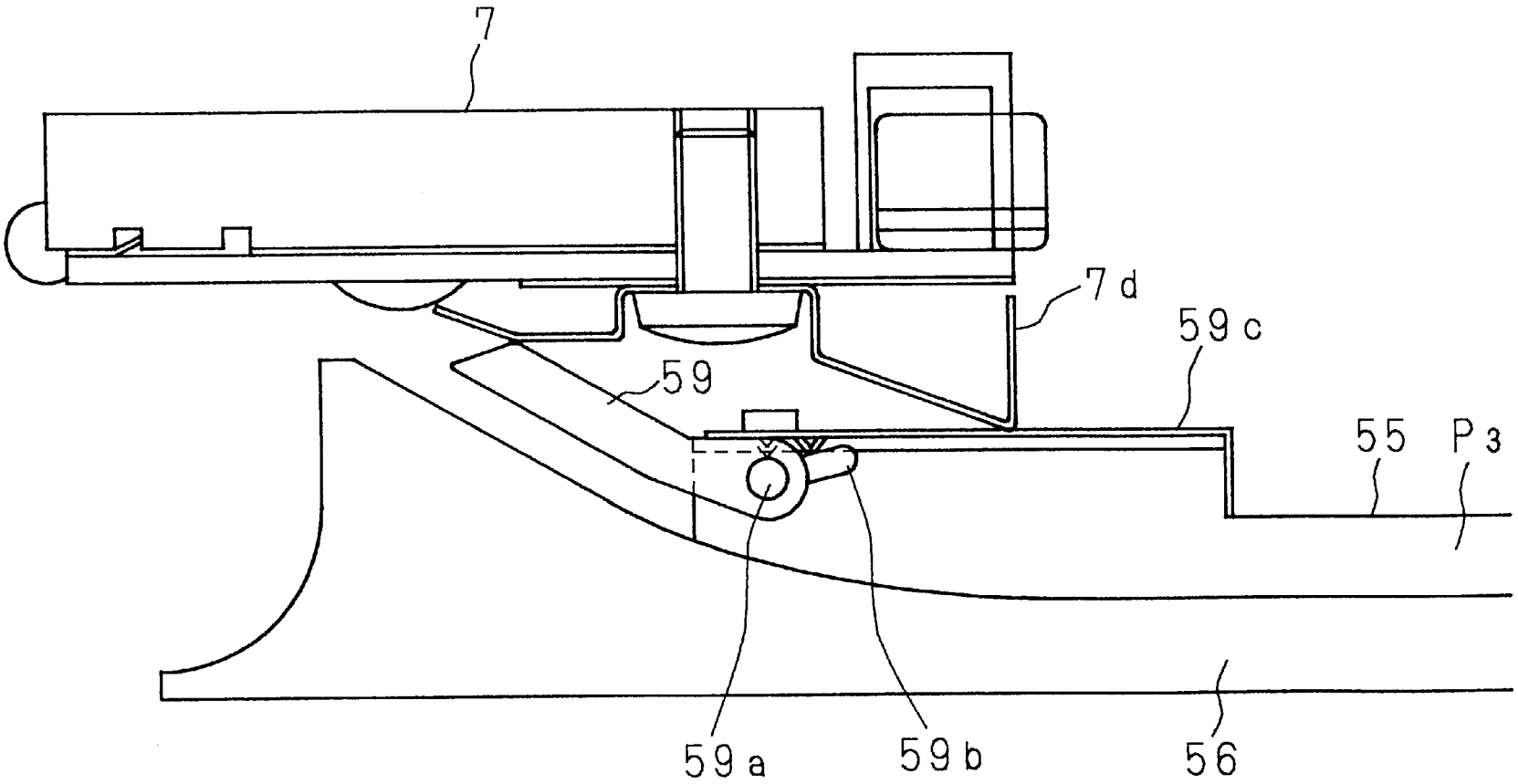
FIG. 31 is an explanatory view of an operation of a movable paper guide shown in FIG. 27.

The operation of this movable paper guide 59 is explained below together with enlarged explanatory views of operation in FIG. 29 to FIG. 31.

Figure 29:
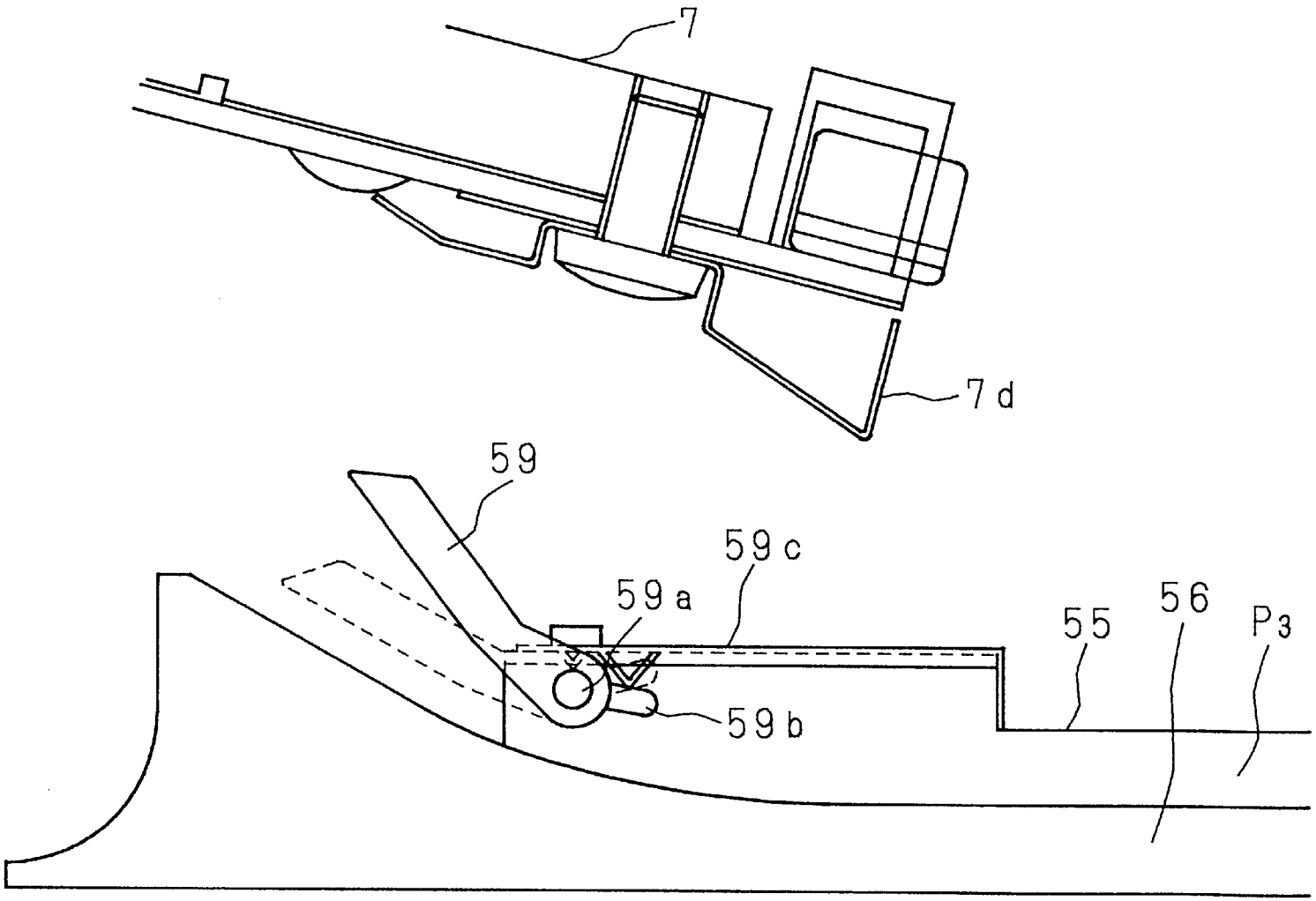
FIG. 29 is an explanatory view of an operation of a movable paper guide shown in FIG. 27.

As shown in FIG. 29, while the thermal head 7 is at the waiting position, since the movable paper guide is pressed in its base end portion 59*b* by the leaf spring 59*c*, the front end portion side is positioned in the state being away from the stationary paper guide 56. When the thermal head 7 descends, first, as shown in FIG. 30, a part of the head cover 7*d* of the thermal head 7 abuts against the movable paper guide 59, and pushes it down and turns it about the shaft 59*a* by resisting the leaf spring 59*c*, and is positioned parallel to the front end portion of the stationary paper guide 56 as shown in FIG. 31. When the thermal head 7 goes up, it returns to the position shown in FIG. 29 through the same process as above. As a result, the allowance for the printing paper P to be curved in the conveying path P3 is eliminated, and the positioning precision of the printing paper is heightened, and conveying troubles of the printing paper P can be prevented.

Figure 32:
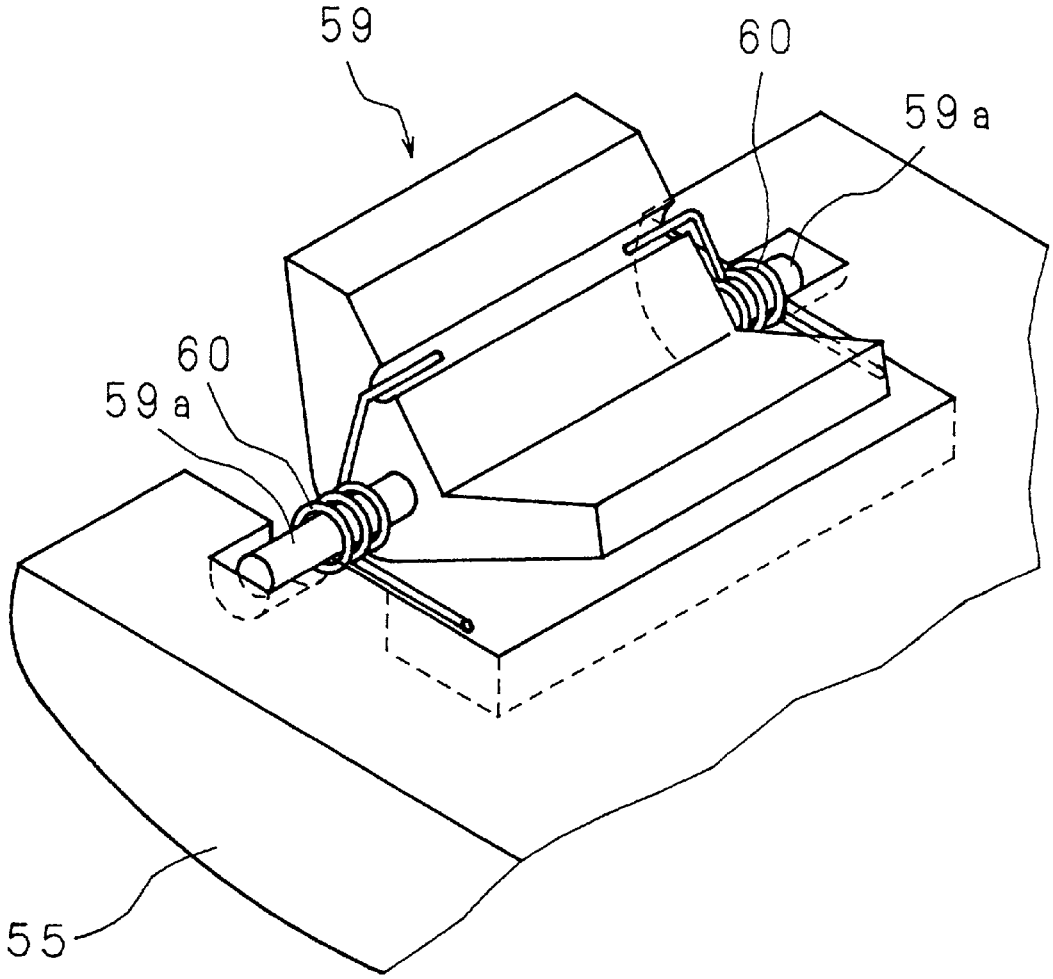
FIG. 32 is a perspective view showing other example of movable paper guide.

FIG. 32 is a perspective view showing other example of the movable paper guide 59, and in this embodiment, meanwhile, coil springs 60, 60 are externally fitted on the shaft 59*a* for pivoting the movable paper guide 59, and one end of the coil spring 60 is stopped on the movable paper guide 59, and the other end on the stationary paper guide 55 respectively.

In such an embodiment, the constitution may be simplified more than that in which the leaf spring 59*c* is used.

The other constitution and operation are substantially same as the movable paper guide 59 shown in FIG. 28, and corresponding parts are identified with same reference numbers, and explanations thereof are omitted.

Constitution of Paper Supply Unit

Figure 33:
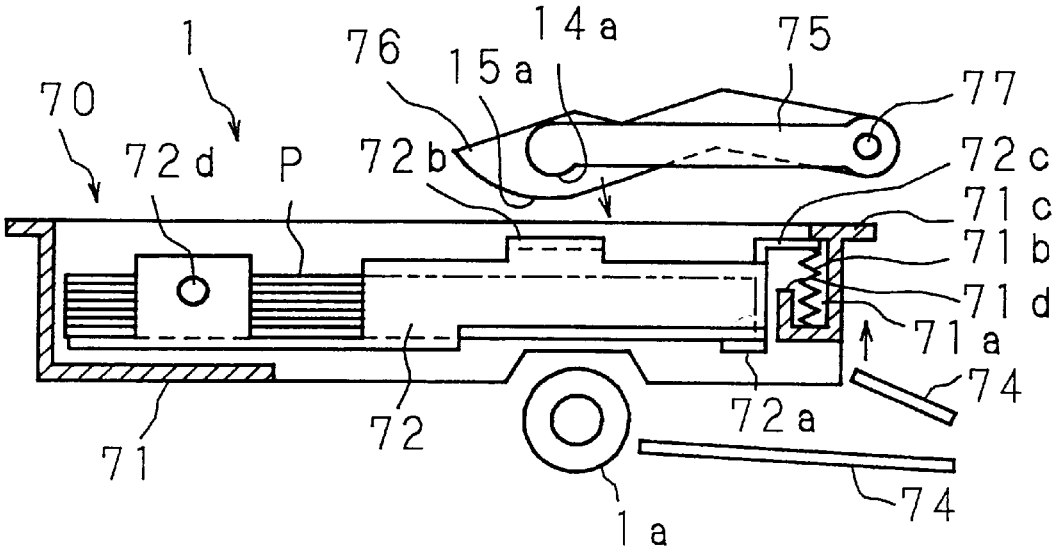
FIG. 33 is a schematic side view showing a practical structure of a paper supply unit in a printing apparatus of the invention, FIGS. 34(*a*), (*b*) are explanatory views of an operation of the paper feed unit of FIG. 33.

FIG. 33 is a schematic side view showing a practical constitution of the paper supply unit 1, in which numeral 70 denotes a paper cassette for composing the paper supply unit 1. The paper cassette 70 is composed by disposing a middle casing 72 inside a rectangular outer casing 71 having the upper portion opened, and paper supply roller 1*a* and stationary paper guide 74 are disposed in the lower portion, and push-down lever 75 and pressing lever 76 are disposed further in the upper portion.

The middle casing 72 comprises separation pawls 72*a* at both sides of the front bottom portion in the paper supplying direction of the printing paper P, an abutting piece 72*b* to contact with the front end of the push-down lever 75 above the middle portion, and a stopping piece 72*c* extending forward at the front end portion, and the both side walls of the rear end portion are pivoted on the side wall of the outer casing 71 by means of shaft 72*d*.

The stopping piece 72*c* extending to the front end side of the middle casing 72 is disposed on the spring retainer 71*a* in the state of being mounted on the dilating spring 71*b* stored in the spring retainer 71*a* disposed inside of the front end portion of the outer casing 71, and then is located between the upper and lower stoppers 71*c*, 71*d*, and is always in the state of abutting against the upper stopper 71*c*.

The paper fed roller 1*a* is disposed against the middle of the lower portion of the outer casing 71, and it is designed to contact with the lower side of the printing paper P located at the lowest position of the stock of the printing papers P stored in the middle casing 72 when the middle casing 72 is pushed and turned downward. The push-down lever 75 and pressing lever 76 are pivoted coaxially on the shaft 77, and when they are rotated about the shaft 77 in the direction of arrow, the front end of the pressing lever 76 abuts against the contact piece 72*b* of the middle casing 72, thereby pushing down and turning the middle casing 72 about the shaft 72*d*. The stationary paper guide 74 is opposite to the front portion and front lower portion of the outer casing 71.

Figure 34A:
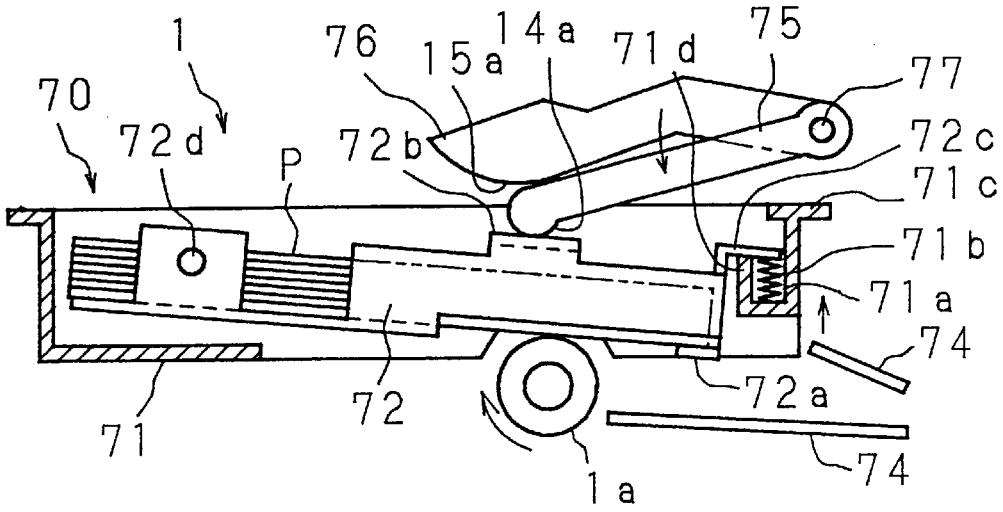
Figure 34B:
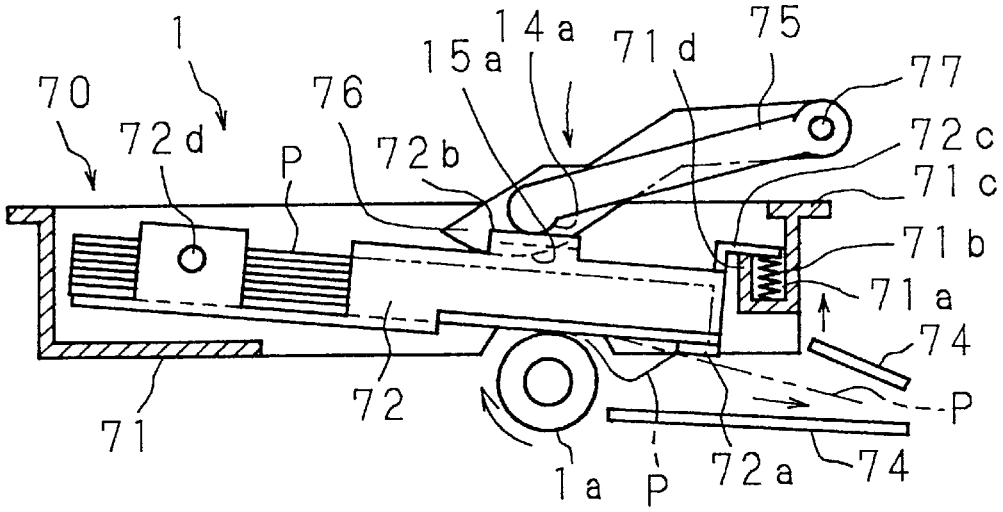

The operation of such paper supply unit 1 is explained below by reference to the explanatory view of operation shown in FIG. 34. FIG. 34(*a*) shows the standby state of paper supplying and FIG. 34(*b*) shows the paper supplying state. In the standby state, the push-down lever 75 is rotated about the shaft 77 in the direction of arrow by a drive unit not shown, and its front end abuts against the contact piece 72*b*, and accordingly the lower side of the printing paper P stored in the middle casing 72 is pushed and turned to the position contacting with the paper supply roller 1*a*.

Next, as shown in FIG. 34(*b*), the pressing lever 76 rotates in the arrow direction to abut on the upper surface of the printing paper P to further press the middle casing 72, and the lower surface of the printing paper P is pressed with a specified pressure against the paper supply roller 1*a* which is rotated and driven. By the frictional force acting between the paper supply roller 1*a* and printing paper P, the conveying force for the printing paper P is generated, and the printing paper P at the lowest position in the middle casing 72 is separated from other papers, and is sent out in the arrow direction, and is fed to the printing unit 3 side between the paper guides 74.

When supplying of the printing paper P is over, the push-down lever 75 and pressing lever 76 return to the former position shown in FIG. 33, thereby finishing one cycle of paper supplying operation. The printing paper P supplied from such paper supplying unit 1 is transferred to the conveying path P2 through the conveying path P1 as clear from FIG. 22, and is pinched between the capstan roller 4 and pinch roller 5, and is conveyed to the printing unit 3 side.

Practical Constitution of Capstan Roller

Figure 35:
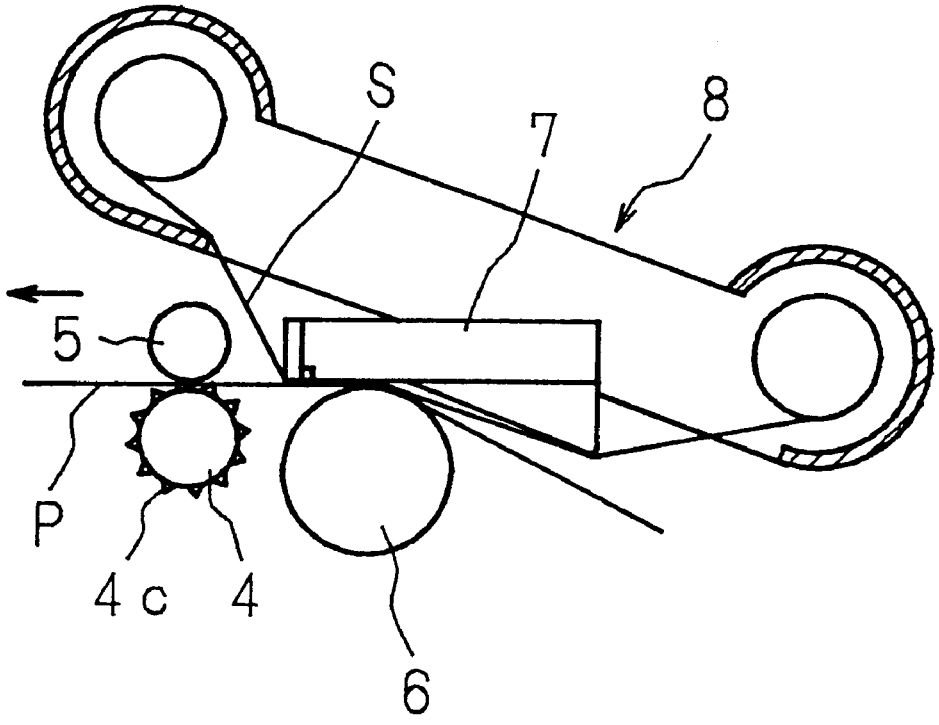
FIG. 35 is a schematic side view showing a capstan roller which is a conveying roller disposed in the conveying path.
Figure 36:
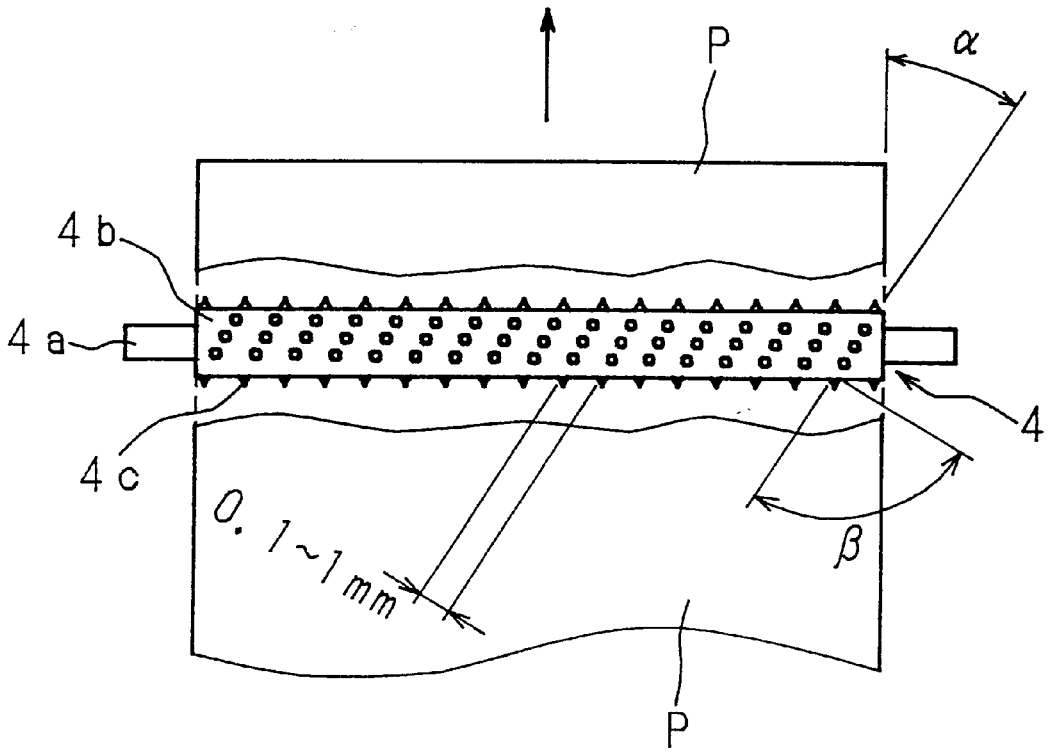
FIG. 36 is a schematic plan view of the same capstan roller.

FIG. 35 is a schematic side view showing the printing unit 3 and the conveying path P2 in its vicinity, and FIG. 36 is a schematic plan view of the capstan roller 4 shown in FIG. 35. In the vicinity where the platen roller 6 and thermal head 7 are opposing to each other, the capstan roller 4, which is a drive roller, is installed at the lower side across the conveying path P2 of the printing paper P, while the pinch roller 5, which is a driven roller, is disposed at the upper side, opposedly in upper and lower positions. The capstan roller 4 is composed by externally fixing the roller main body 4*b* made of metal or the like on the outer circumference of the shaft 4*a*.

On the surface of the outer circumference of the roller main body 4*b*, as shown in FIG. 36, projections 4*c* are regularly formed in a spiral form nearly at predetermined intervals at an angle α within 20° to 40° to the conveying direction of the printing paper P and at spiral pitch of 0.1 to 1 mm, and the crossing angle β of the lines linking projections positioned at the shortest distance of the projection row adjacent in the axial length direction is set to be 90°.

Consequently, the row of the projections 4*c* is positioned in a state slightly deviated in the peripheral direction of the capstan roller 4, and the projection 4*c* abuts against the printing paper P passing between the capstan roller 4 and pinch roller 5 at any position in the axial length direction, and by conveying the printing paper P with the projection biting in, slipping of the printing paper P and capstan roller 4 is prevented, and a strong conveying force capable of preventing disturbance of conveyance by external effect may be obtained.

When the projection 4c bites into the printing paper P, the surface of the printing paper P may be possibly damaged, but the capstan roller 4 having the projections 4*c* on the surface is located on the opposite side of the printing surface of the printing paper P and the pinch roller 5 is located at the printing surface side, so that the printing surface of the printing paper P may be protected, so that the printing quality will not be damaged.

If, incidentally, the arraying angle α of the projections 4*c* is 45° or more, and the crossing angle β is 90° or more, the present portion and absent portion of the projections are alternately formed in the peripheral direction of the capstan roller 4, and in certain regions the projections 4*c* do not contact with the printing paper P, and slipping may occur.

Figure 37:
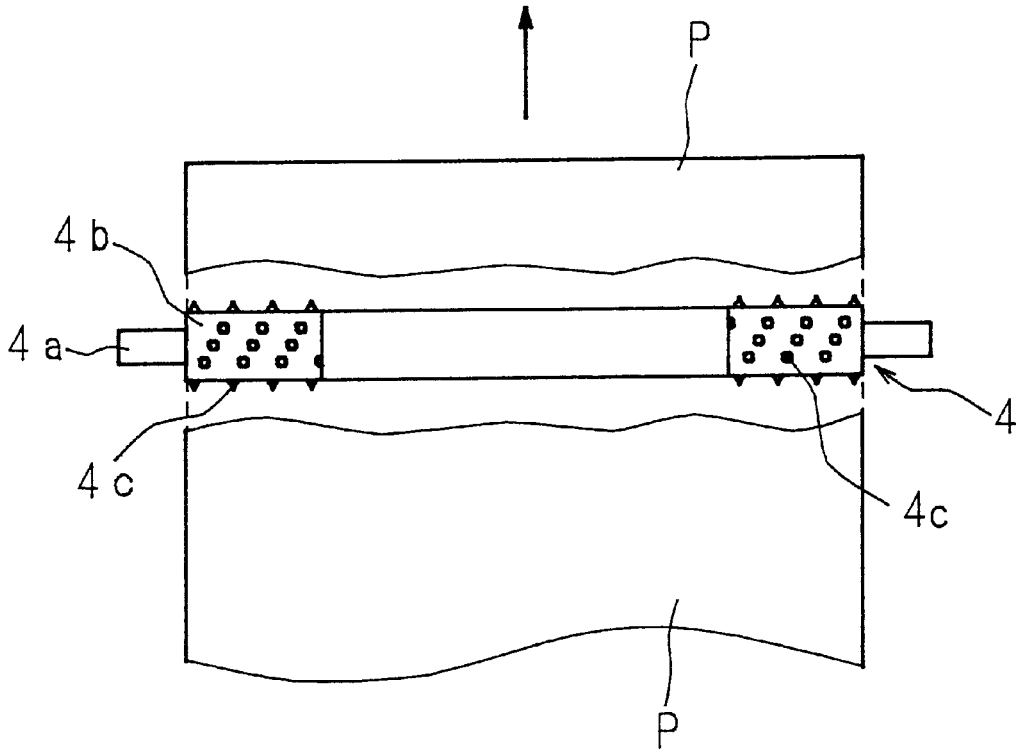
FIG. 37 is a schematic plan view showing other example of capstan roller.

FIG. 37 is a schematic plan view showing other example of the capstan roller, and in this embodiment, projections 4*c* are formed at both ends in the axial length direction for a predetermined length in the axial length direction, respectively, and the middle portion in the axial length direction is free of projections 4*c*. In this way, by dividing the projection forming region on the surface of the capstan roller 4 into two positions in the axial length direction so that the projections may be present only in both end portions in the widthwise direction of the printing paper P, the composition of the capstan roller 4 may be simplified, and it is possible to manufacture easily and at low cost, so that the cost may be saved.

The other constitution and action are substantially same as in the embodiment shown in FIG. 36, and corresponding parts are identified with same reference numbers and explanations are omitted.

Figure 38:
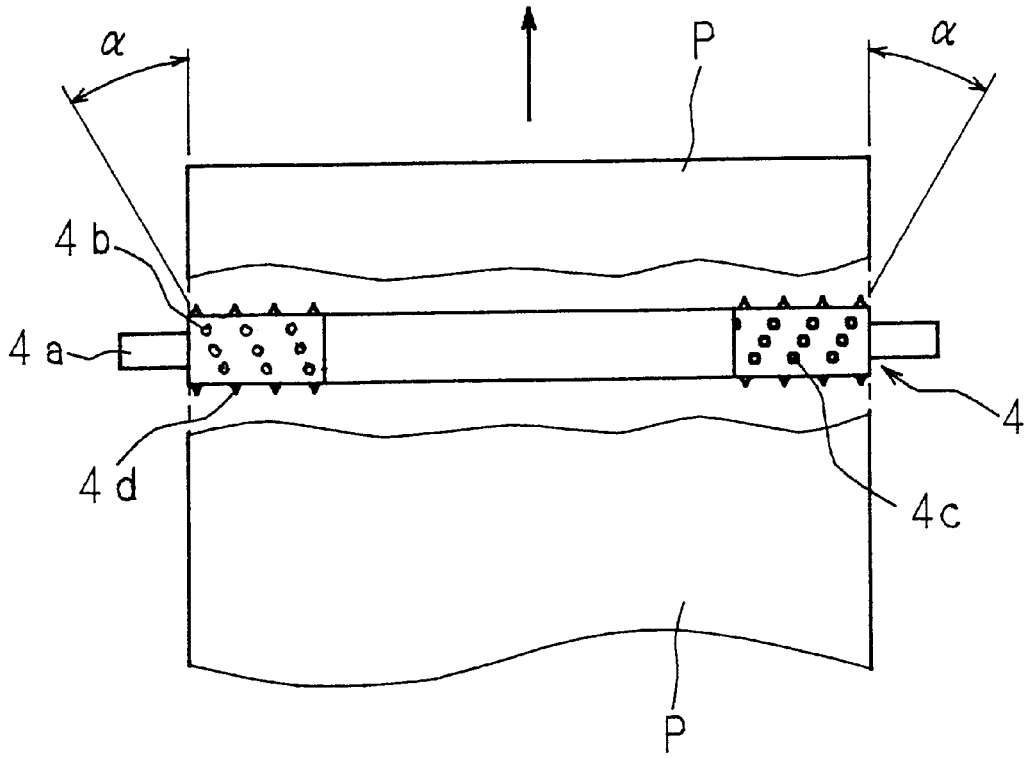
FIG. 38 is a schematic side view showing a further different example of capstan roller.

FIG. 38 is a schematic plan view showing a further different example of the capstan roller, in which projections 4*c*, 4*d* are formed at both ends in the axial length direction for a predetermined length respectively, and the arraying directions of the projections 4*c*, 4*d* at both ends are mutually opposite, and the angle α to the conveying direction of the printing paper P is set at 30°.

Figure 39:
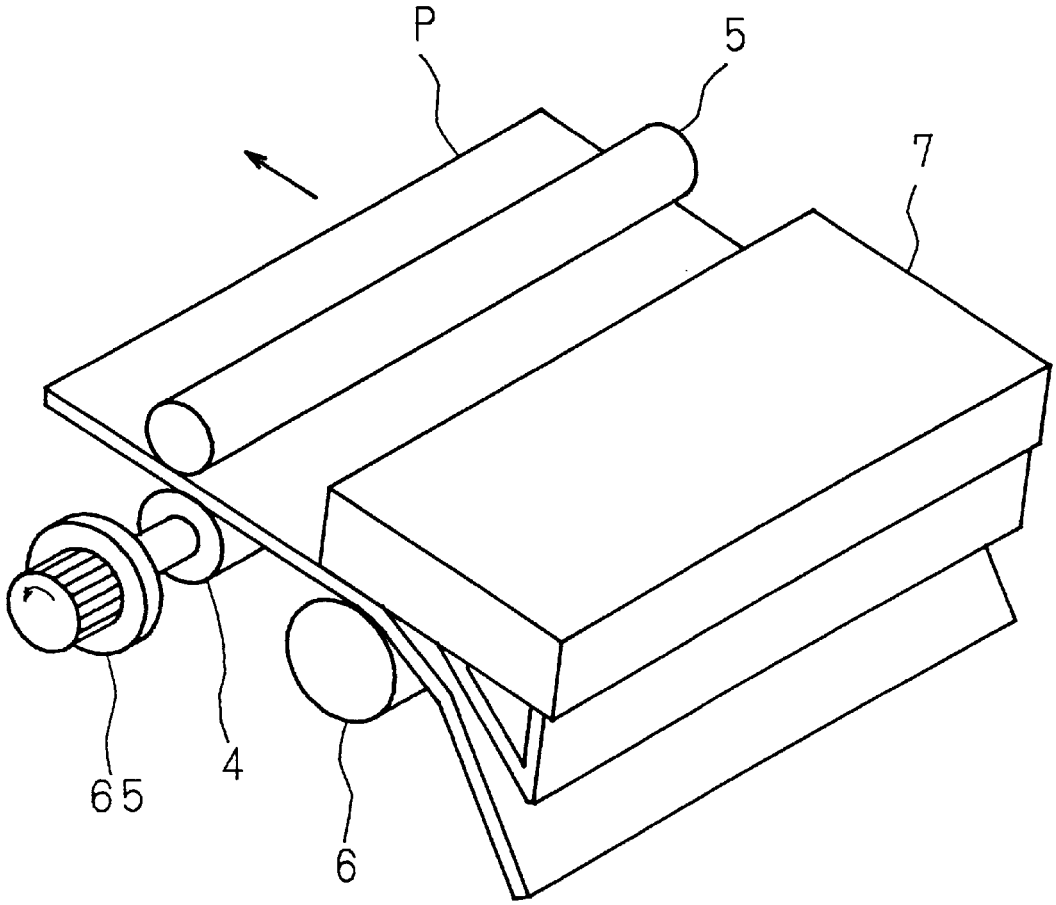
FIG. 39 is a schematic side view showing a further different example of capstan roller.

FIG. 39 is .a perspective view showing another different example of the capstan roller 4, in which a handle 65 is fixed or externally adhered to one shaft end of the capstan roller 4, preferably at one end of the maintenance door side.

The structure of the capstan roller is not particularly defined, but as shown in FIG. 36 to FIG. 38, for example, a row of projections 4*c*, 4*d* may be formed, or may not be formed as in the prior art.

The other constitution is substantially same as the constitution shown in FIG. 35, and the corresponding parts are identified with the same reference numbers.

In such an embodiment, by using the handle 65 for manually rotating the capstan roller 4, jamming of printing paper P near the platen roller 6 and capstan roller 4 may be easily cleared, and the reliability may be enhanced.

Figure 40:
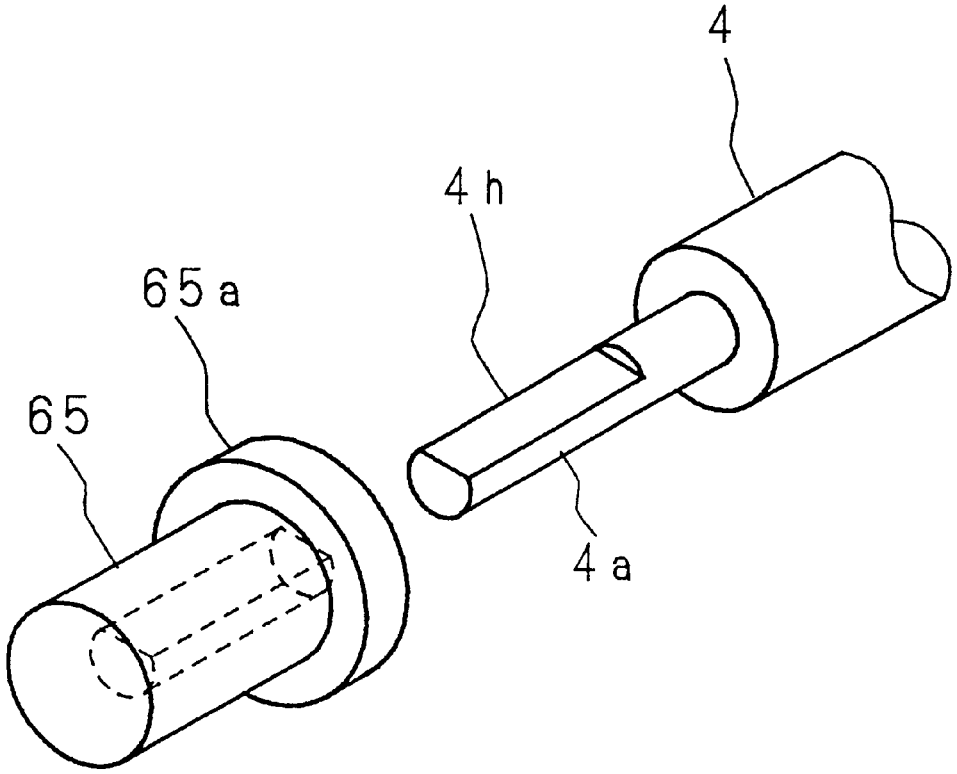
FIG. 40 is a schematic side view showing a further different example of capstan roller.
Figure 41:
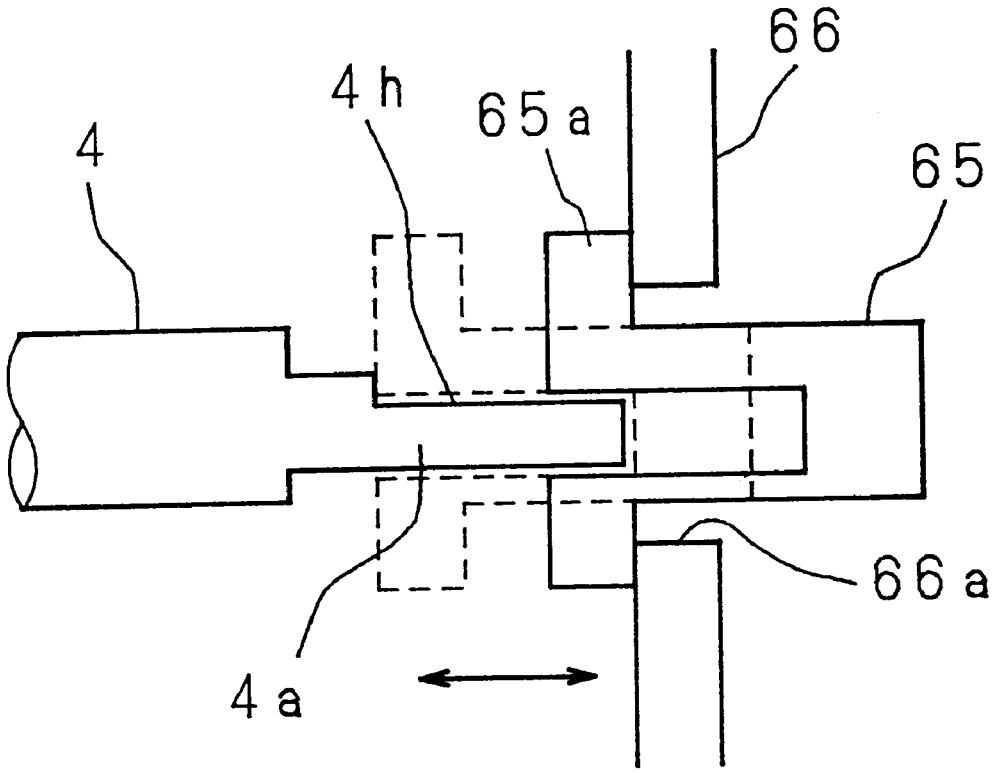
FIG. 41 is a schematic side view showing a further different example of capstan roller.

FIG. 40 is a perspective view showing a further different example of the capstan roller 4, and FIG. 41 is a partial sectional view showing the relation between the capstan roller 4 and outer plate 66, in which D-cut portion 4*h* is formed at one shaft end of the capstan roller 4, and the handle 65 has also a D-cut portion corresponding to this D-cut portion 4*h* so as to be inserted in or removed from the shaft 4*h* in its axial length direction.

The handle 65 has a flange portion 65*a* larger in outside diameter than its handle portion, and only the handle portion is exposed outside from a hole 66*a* smaller in diameter than the flange portion 65*a* pierced in the outer plate 66, and by inserting it or removing it (about 10 mm) into the position indicated by broken line or the position indicated by solid line shown in FIG. 41 as required, so that the handle 65 may be rotated easily. When the handle 65 is drawn out to the maximum extent, the flange portion 65*a* abuts against the back of the outer plate 66 to prevent it from slipping out of the shaft 4*a*.

In such an embodiment, when the handle 65 for manually rotating the capstan roller 4 is not necessary, it is positioned inside the hole 66*a*, and when necessary, it can be drawn out from the hole 66*a*, and the handle 65 does not interfere the ease of manipulation.

Figure 42:
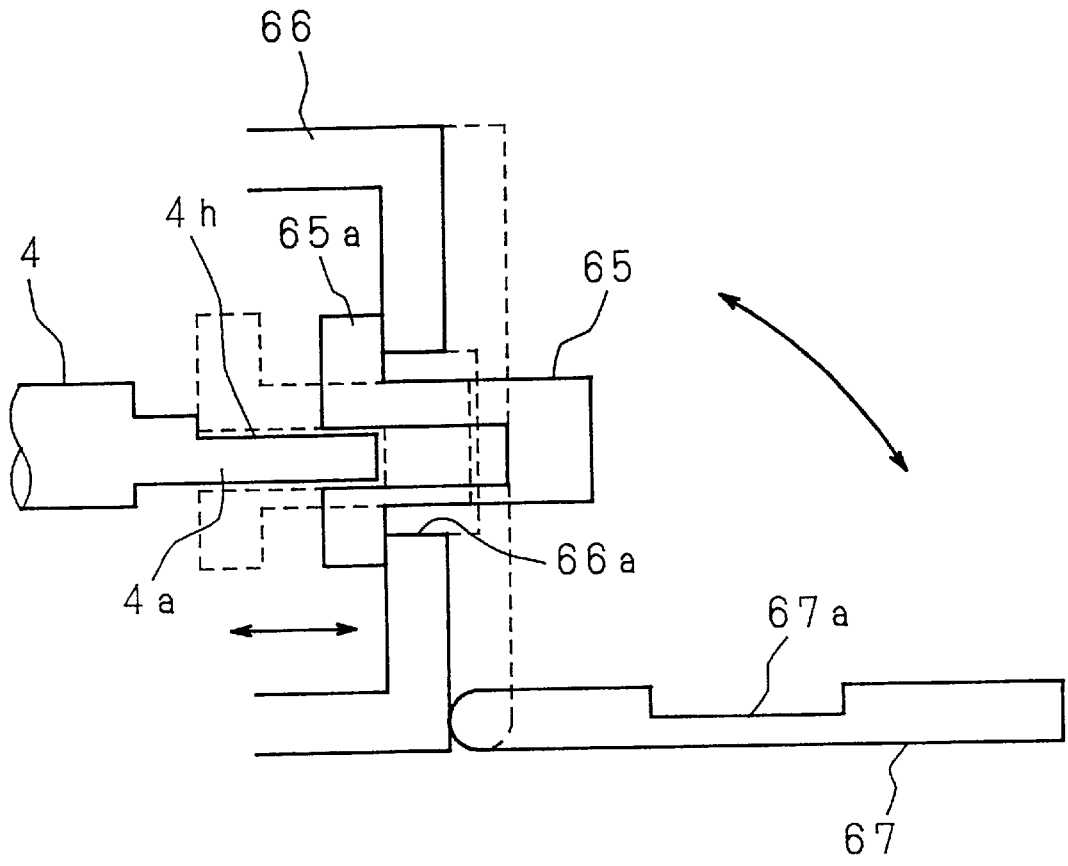
FIG. 42 is a schematic side view showing a further different example of capstan roller.

FIG. 42 is a partial sectional view showing a constitution in which a door 67 is disposed in the part corresponding to the hole 66*a* of the outer plate 66, in which an outer door 67 for opening and closing the hole 66*a* is pivoted outside of the outer plate 66 in a state being thrust toward the closing side, so as to be rotated between the closing position and the opening position rotating 90° to the front side. Inside the door 67, there is a hole 67*a* nearly equal to the diameter of the hole 66*a*, and when the door 67 is rotated to the closing position, the hole 67*a* is opposite to the hole 66*a*, and the handle 65 is held at its front end in the state of projecting outward of the outer plate 66 by the length corresponding to the depth of the hole 67*a* as shown by broken line, so that the handle 65 may be drawn out easily.

After clearing paper jamming, by closing the door 67, the handle 65 is pushed inside of the 66*a* to return to the former position.

Figure 43:
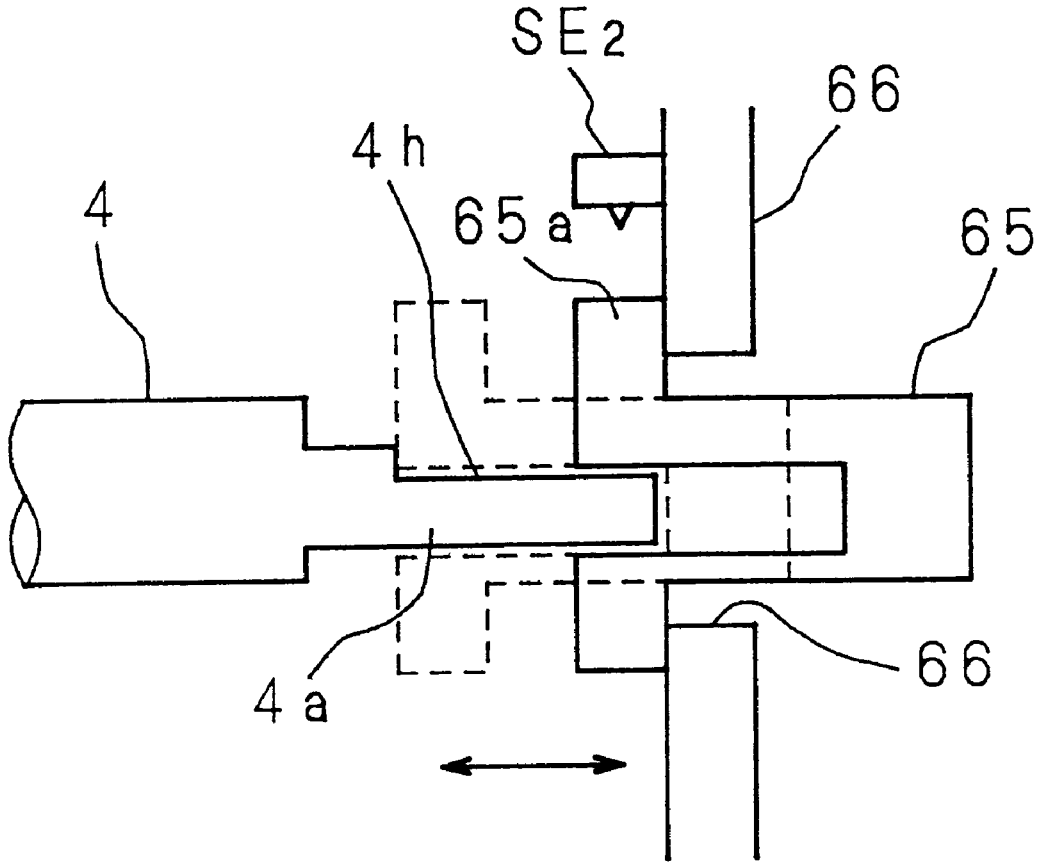
FIG. 43 is a schematic side view showing a further different example of capstan roller.

FIG. 43 is a schematic sectional view showing a different embodiment of the invention. Usually, when a motor of the type which generates a holding torque so that spontaneous rotation may not occur due to disturbance while not driving is used as the driving motor for the capstan roller 4, the motor holding torque becomes a large load, and manual rotation of the handle 65 is difficult.

In this embodiment, accordingly, when the handle 65 is drawn out to the manual operation position, the sensor SE2 detects it, and the current flowing into the motor which is the driving source is cut off, and the holding torque of the motor is cut off, and the load of the drive system is alleviated, and manual rotation is made easy to enhance the controllability.

The position detection sensor SE2 is composed of electric, magnetic or optical sensor, and when detecting the flange portion 65*a* of the handle 65, the current is cut off for the driving motor of the capstan roller 4, for example, the stepping motor.

The printing paper P caught between the capstan roller 4 and the pinch roller 5 is led into the conveying path P3 through the printing unit 3, and the rear end portion of the printing paper P is detected and aligned at the predetermined position.

Figure 44:
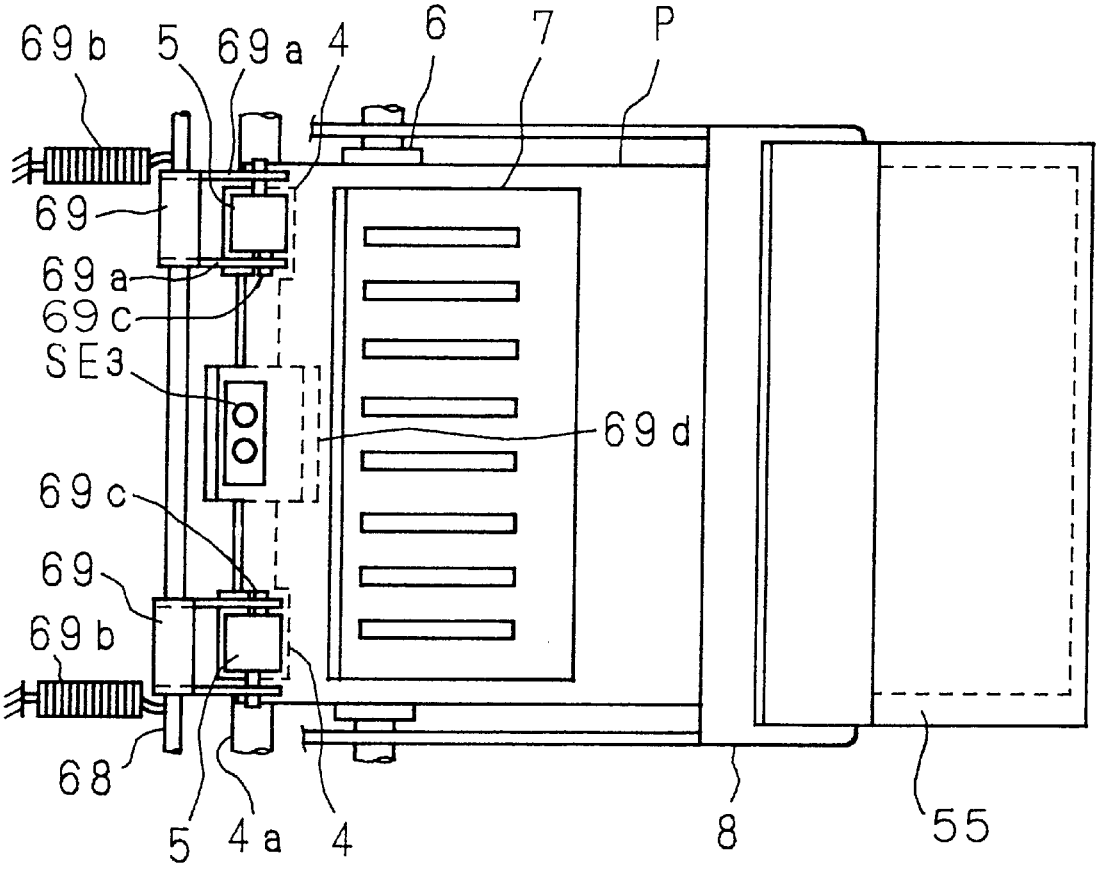
FIG. 44 is a schematic plan view showing a head detecting sensor of printing paper in a printing apparatus of the invention.
Figure 45:
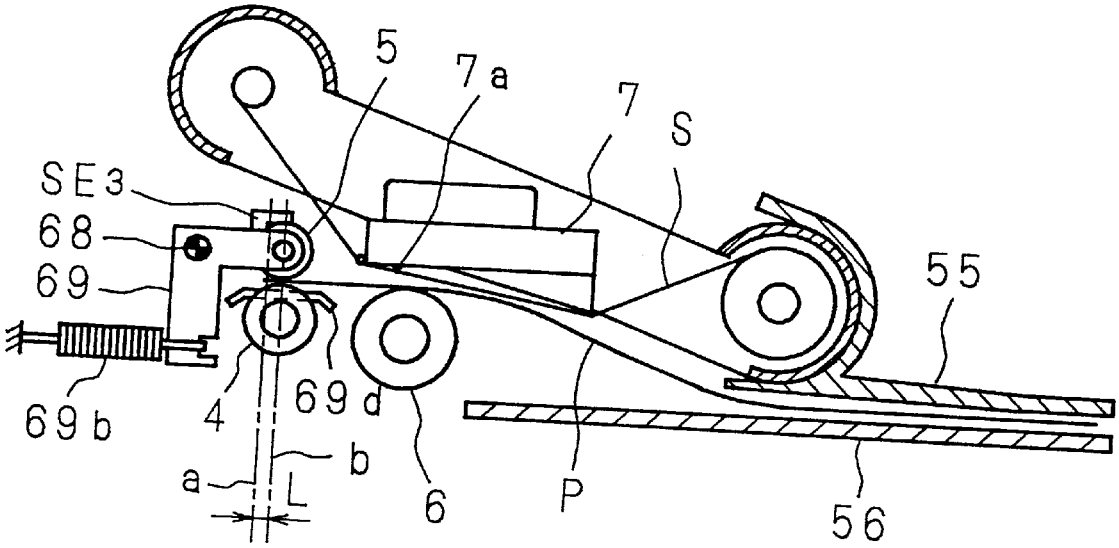
FIG. 45 is its schematic side view, FIGS. 46(*a*), (*b*) are explanatory views of an operation of the sensor of FIG. 44.

FIG. 44 is a schematic plan view showing the configuration of the head detecting sensor of printing paper P in a printing apparatus of the invention, and FIG. 45 is its schematic side view. In the drawing, numeral 68 is a shaft disposed parallel to the shaft 4*a* of the capstan roller 4, and on this shaft 68 is supported a suspension frame 69 positioned at each end of the moving range of the printing paper P. Each suspension frame 69 is formed in an L-shape in side view as shown in FIG. 45, and each pinch roller 5 is supported rotatably around the mounting shaft 39*c* between a pair of support pieces 69*a*, 69*a* projecting toward the direction of the platen roller 6, parallel to the capstan roller 4.

The other end of the suspension frame 69 is linked to a tension spring 69*b*, and each pinch roller 5 is contacting with it at the side of the capstan roller 4. In the middle of two pinch rollers 5,5, the sensor SE3 for detecting the front end of the printing paper P is installed downward, with its detection point determined at position a shown in FIG. 45. Opposite to this detection sensor SE3, a reflector 69*d* is disposed below the moving range of the printing paper P. The position a which is the detection point of the sensor SE3 is set as being shifted to the opposite side of the platen roller 6 by the portion of L from the line b linking the axial center lines of the pinch roller 5 and capstan roller 4, and the position a is the beginning position of the printing paper P.

Figure 46A:
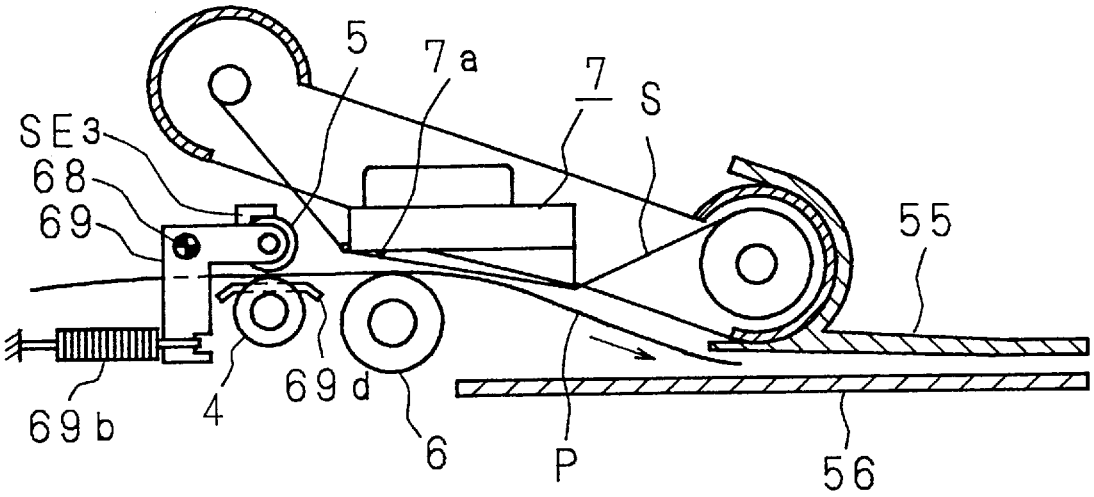
Figure 46B:
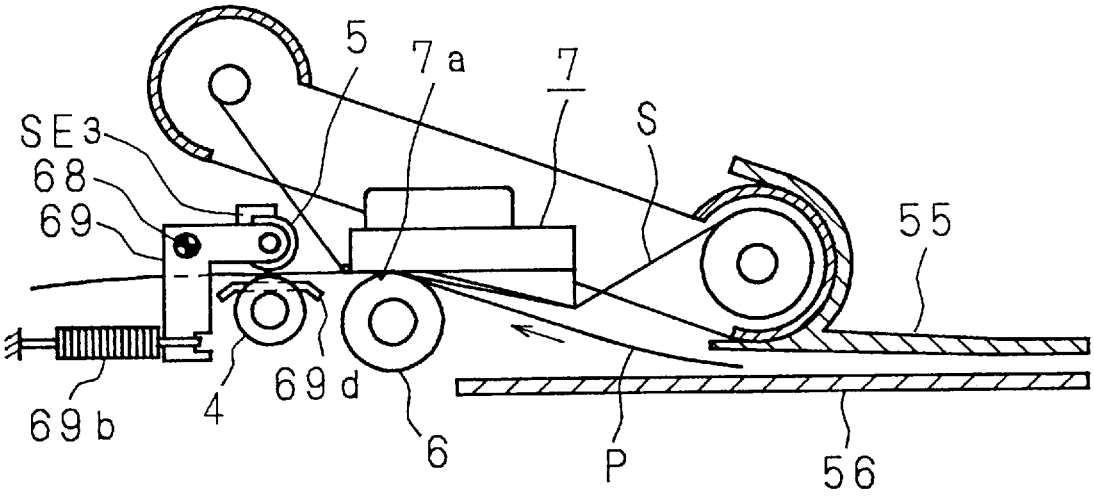

Positioning of the printing paper P is explained together with the explanatory view of operation shown in FIG. 46. FIG. 46(*a*) shows the state of paper supplying and the thermal head 7 is waiting away above the platen roller 6. When the printing paper P is conveyed in the direction of the arrow by means of the pinch roller 5 and capstan roller 4, and led in between the stationary paper guides 55, 56, and the rear end of the printing paper P passes through the position a shown in FIG. 45, the fact above is simultaneously detected by the sensor SE3, and driving of the capstan roller 4 is stopped, thereby detecting the head as shown in FIG. 45.

FIG. 46(*b*) shows the printing state, in which the thermal head 7 is lowered to contact the ink sheet S with the surface of the printing paper P, and the printing paper P is conveyed in the direction of arrow by the pinch roller 5 and capstan roller 4, and the heat generation unit 7*a* of the thermal head 7 is heated to make printing.

Figure 9:
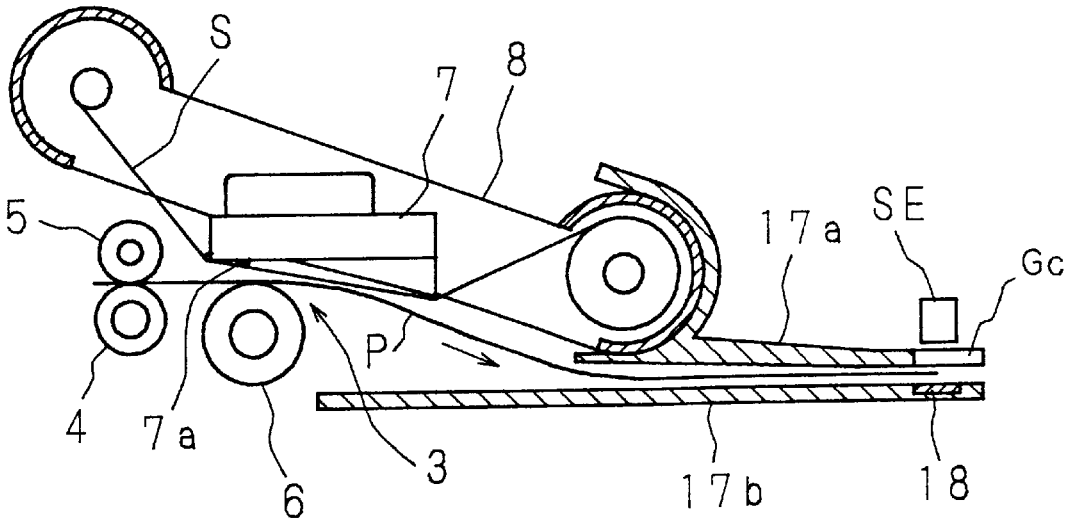
Fig. 9 Prior Art
FIG. 9 is its schematic side view.
Figure 10:
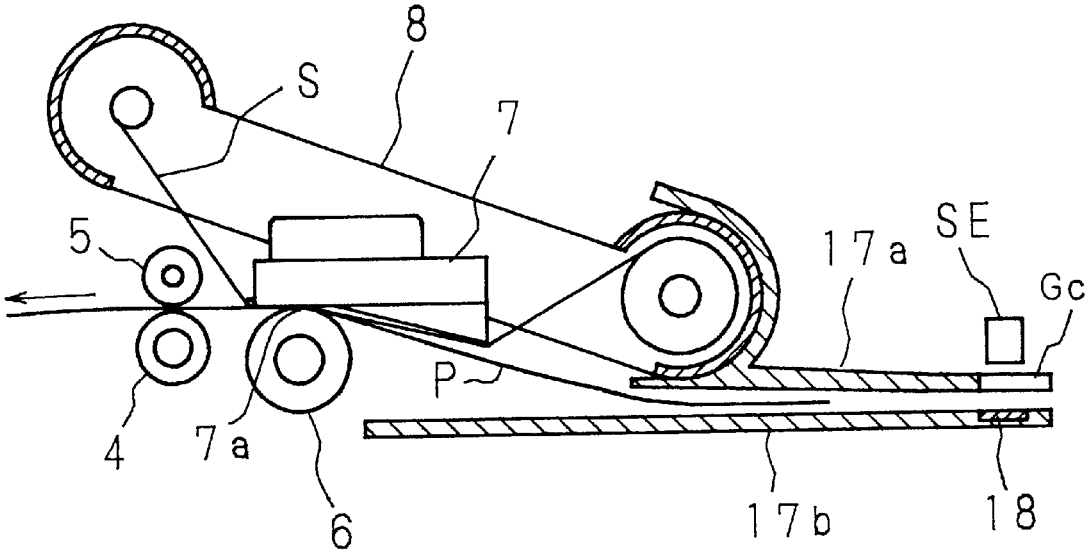
Fig. 10 Prior Art
FIG. 10 is an explanatory view of an operation showing the positioning operation of the printing paper.
Figure 11:
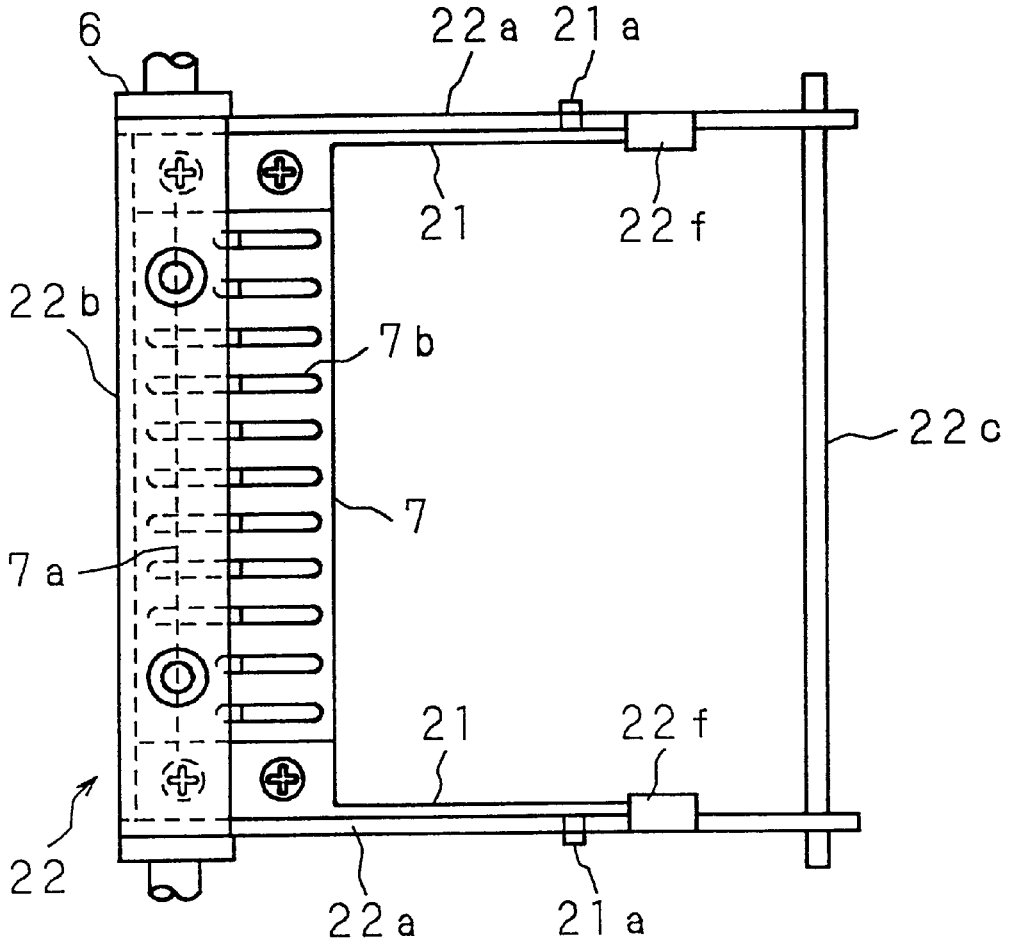
Fig. 11 Prior Art
FIG. 11 is a schematic plan view showing a thermal head and its holding structure in a conventional printing apparatus.
Figure 12:
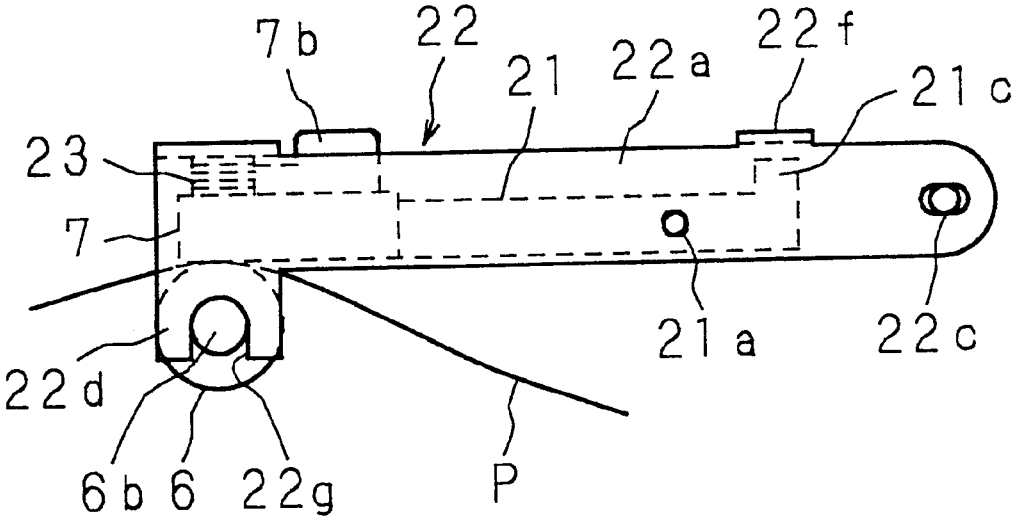
Fig. 12 Prior Art
FIG. 12 is its side view, FIGS. 13(*a*) and 13(*b*) are explanatory views of an operation of the thermal head shown in FIG. 11 and FIG. 12.
Figure 13A:
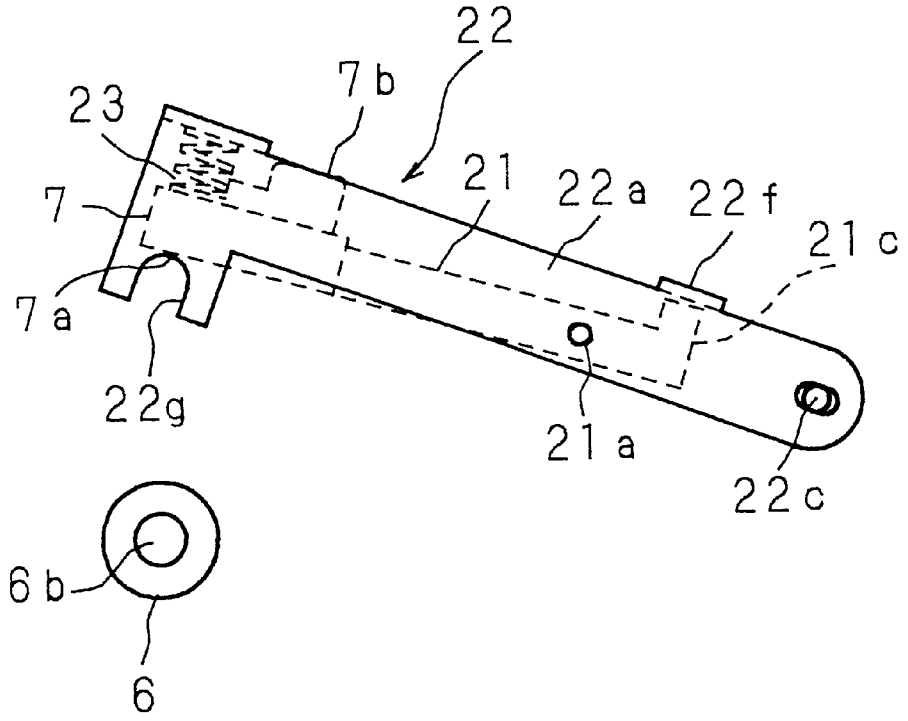
Fig. 13(a) Prior Art
Figure 13B:
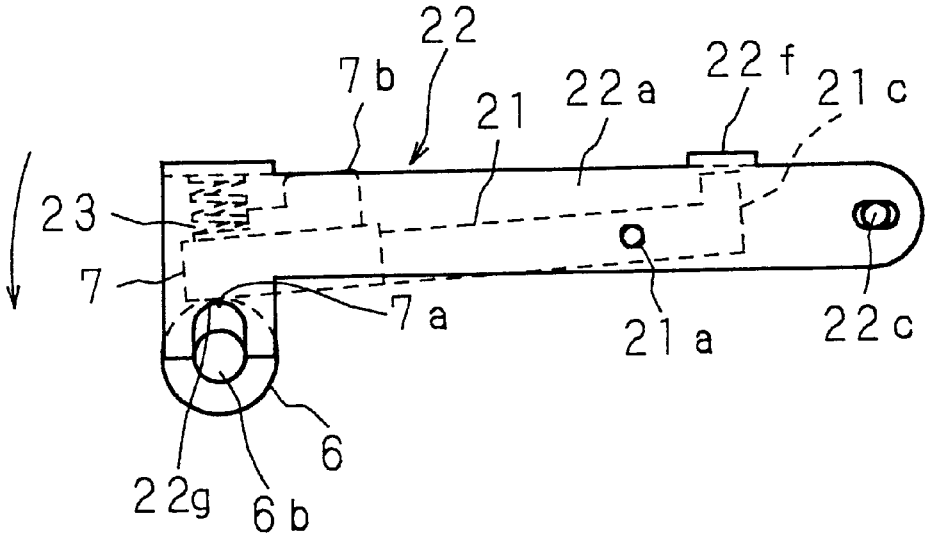
Fig. 13(b) Prior Art
Figure 14:
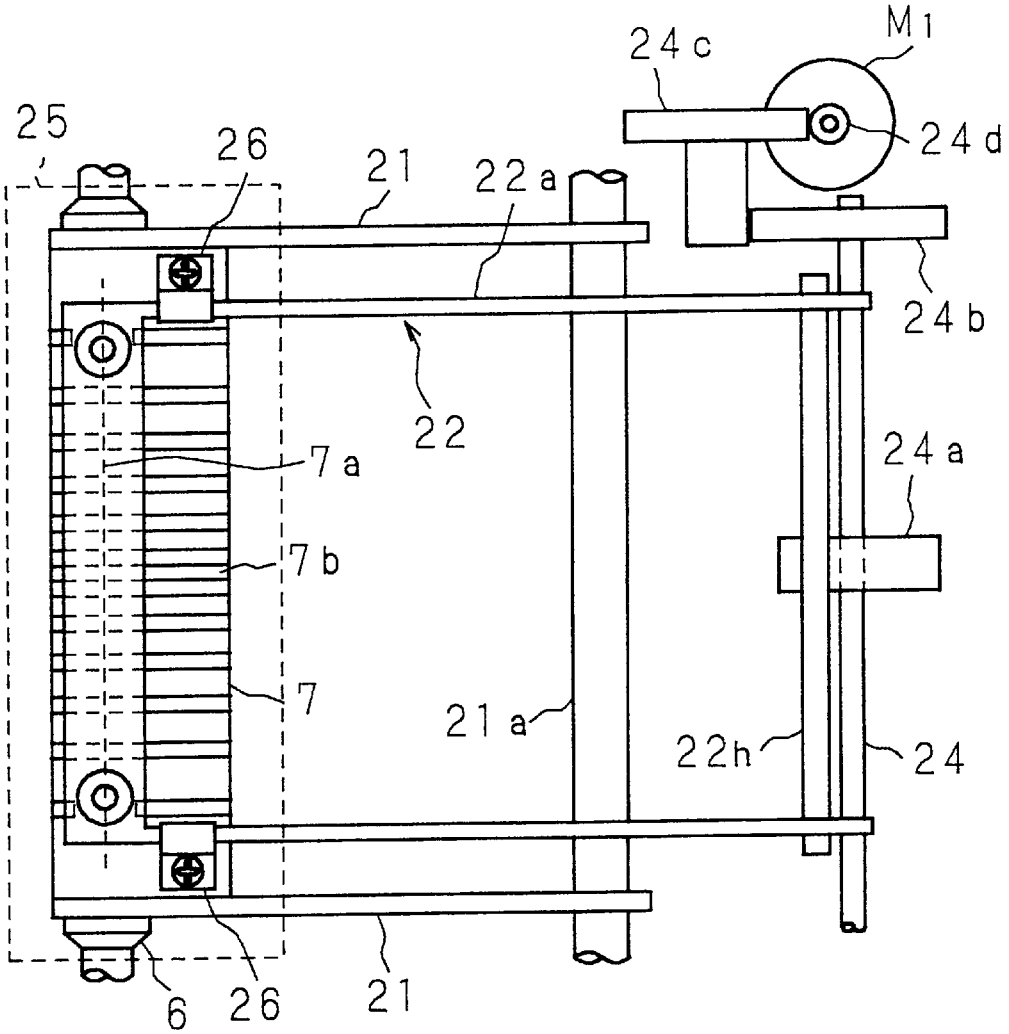
Fig. 14 Prior Art
FIG. 14 is a schematic plan view showing a drive unit of thermal head and its cooling means in a conventional printing apparatus.

The detection sensor SE3 installed between the independent pinch rollers 5, 5 detects the front end of the printing paper P near the printing unit 3, by contrast to the beginning sensor SE of the printing paper P in the prior art as shown in FIG. 9, and therefore the head detecting precision of the printing paper P is enhanced. Besides, the pinch roller 5 is independently suspended, and if the mutual diameters of the pinch rollers 5 are slightly different, an equal supplying speed is applied to the right and left sides of the printing paper P, so that the printing paper P may not run obliquely.

Practical Structure of Thermal Head

Figure 47:
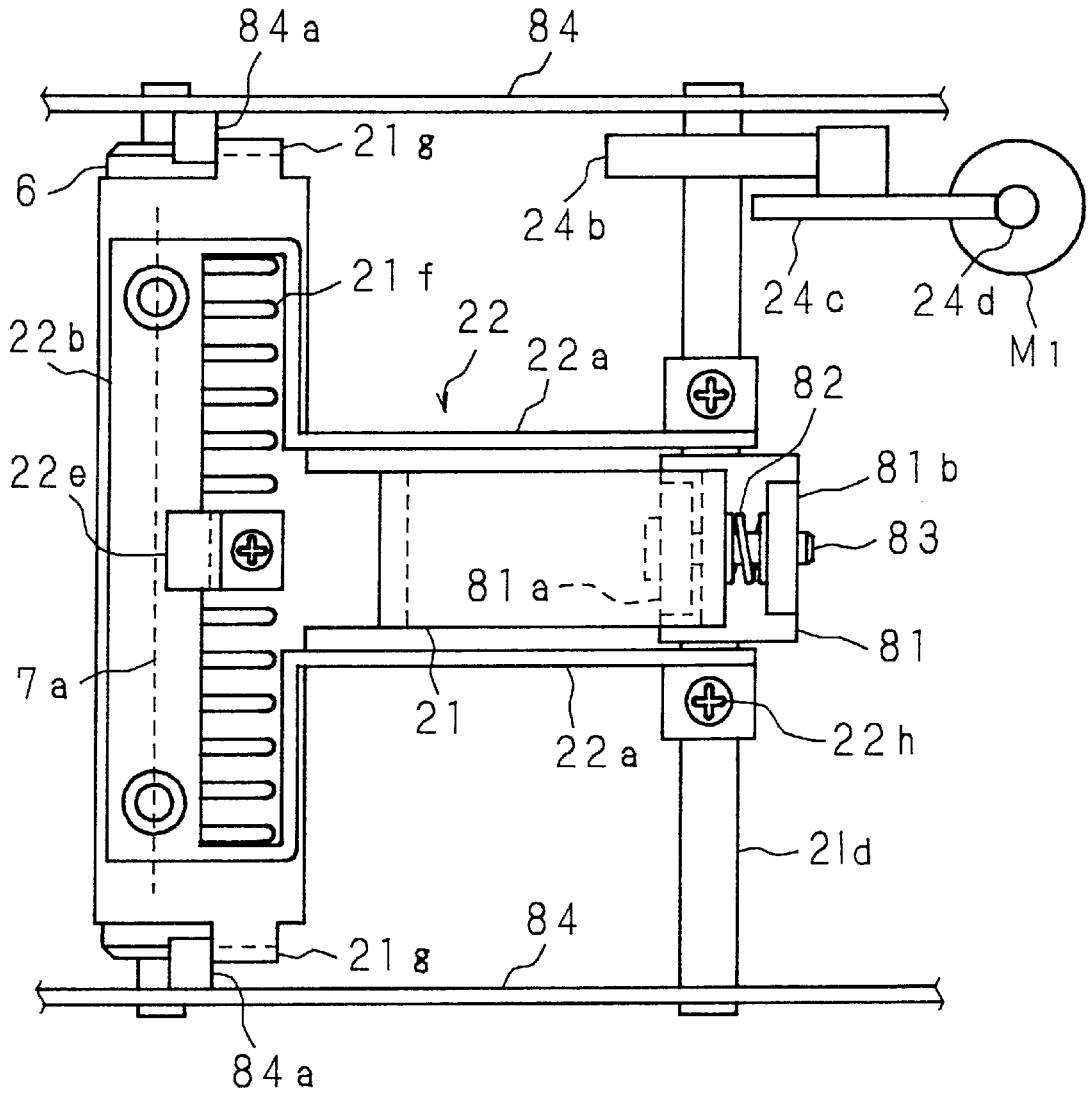
FIG. 47 is a schematic plan view showing a thermal head and its positioning means in a printing apparatus of the invention.
Figure 48:
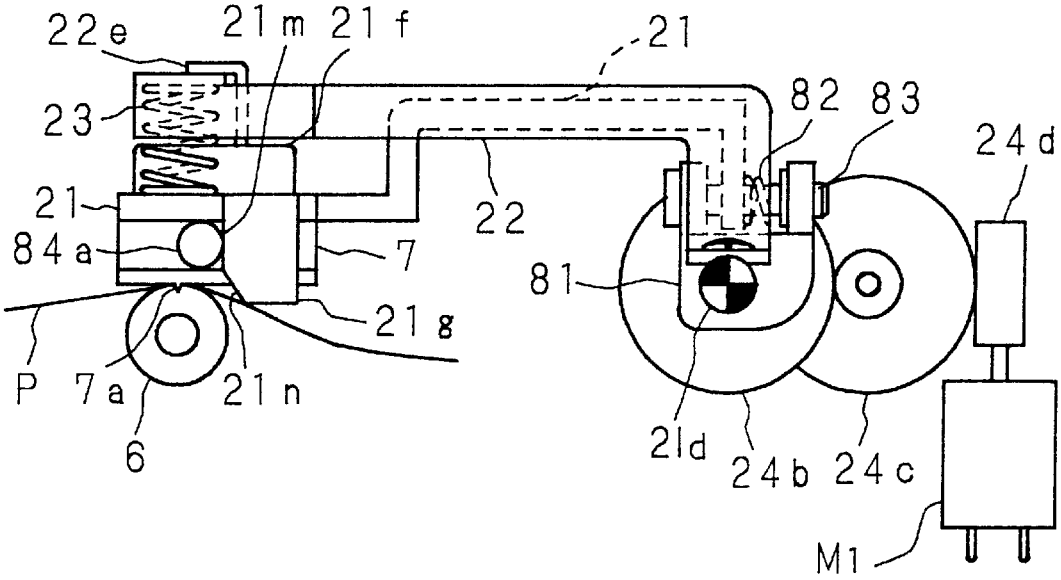
FIG. 48 is its schematic side view.
Figure 49:
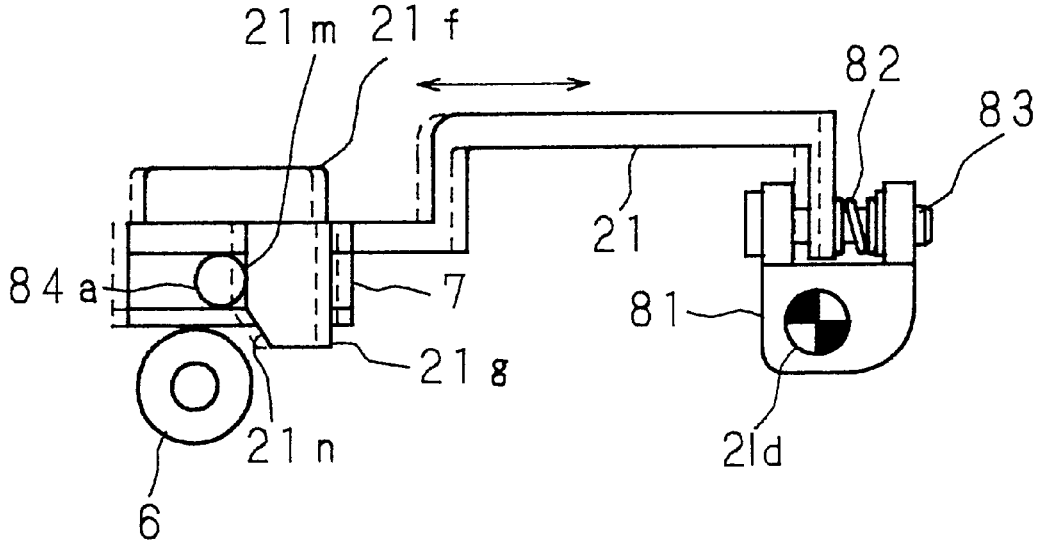
FIG. 49 is an explanatory view showing the operation of positioning of the thermal head, FIGS. 50(*a*)–(*c*) are explanatory views of the operation of the thermal head and its positioning means.

FIG. 47 is a schematic plan view showing the thermal head 7 composing the printing unit 3 in a printing apparatus of the invention, and its support mechanism, and FIG. 48 is a schematic side view, and FIG. 49 is an explanatory view if operation for positioning the thermal head.

The thermal head 7 is installed at the lower side of the front end portion of a holding member 21 in a T-form in plan view, and its rear end portion is pivoted between the brackets 81*a*, 81*a* erected on the bush 81 externally mounted on the shaft 21*d* by means of a coupling shaft 83 in the state of being thrust to the platen roller 6 side through an intervening coil spring 82.

On the other hand, a pressing member 22 is similarly shaped in a T-form in plan view, and a pressing plate 22*b* is set between the front ends of the support arms 22*a*, and its rear end portion is integrally fixed to the shaft 24 with a set screw 22*h*. The pressing plate 22*b* is opposing upward to the front end portion of the holding member 21, and a contact spring 23 is intervening between it and the front end of the holding member 21.

Incidentally, numeral 22*e* is a stopper disposed on the upper surface of the front end portion of the holding member 21, and it is facing upward to the front end portion of the pressing member 22, and the relative position of the holding member 21 and pressing member 22 is regulated in the state of giving a proper dilating force to the contact spring 23.Numeral Numeral 21*f* denotes radiation fins disposed on the holding member 21. At one end of the shaft 21*d* a gear 24*b* is provided, and through a reduction gear 24*c* which is engaged with this gear 24*b*, it is engaged with a worm gear 24*d* disposed on the output shaft of the motor M1 and the shaft 21*d* is rotated according to normal and reverse driving of the motor m1 and the holding member 21 and pressing member 22 are rotated about the shaft 21*d* and the thermal head 7 is pressed on the platen roller 6, or is departed therefrom.

On both sides of the front end portion of the holding member 21 for mounting the thermal head 7, as shown in FIG. 48, guide plates 21*g* are suspended, and guide pins 84*a*, 84*a* are projecting from the side frames 84, 84 above the both end portions of the platen roller 6 to above the platen roller 6, respectively. Each guide plate 21*g* is provided with a vertical portion 21*m* as shown in FIG. 48, and a slant portion 21*n* inclining at a predetermined angle to it, and when the thermal head 7 descends to the platen roller 6 side, the slant portion 21*n* of the guide plate 21*g* slides on the guide pin 84*a*, and when the thermal head 7 further goes down, the vertical portion 21*m* slides on the guide pin 84*a*, thereby positioning, as shown in FIG. 49, in the longitudinal direction of the thermal head 7 with respect to the platen roller 6, that is, in the conveying direction of the printing paper P.

Figure 50A:
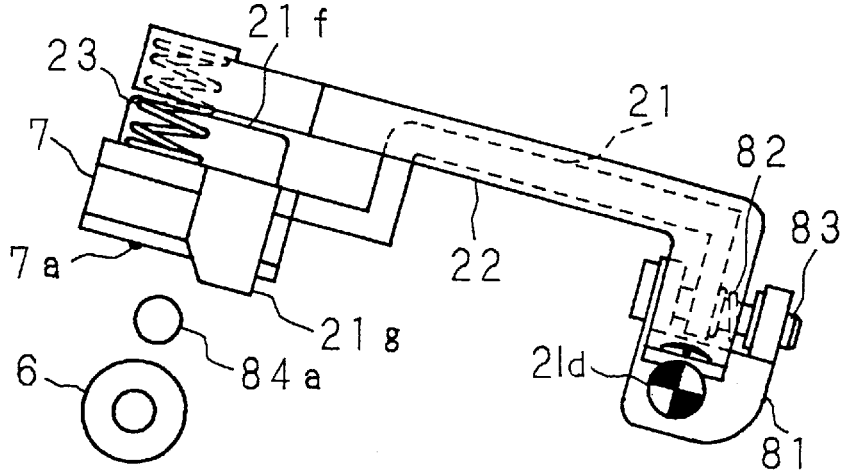
Figure 50B:
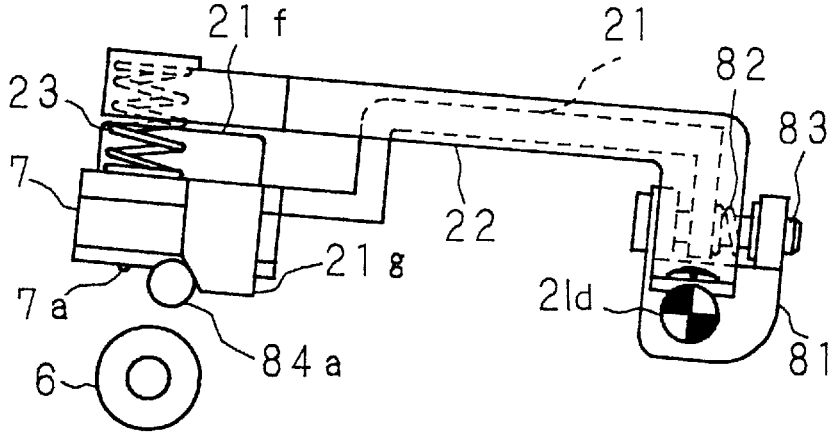
Figure 50C:
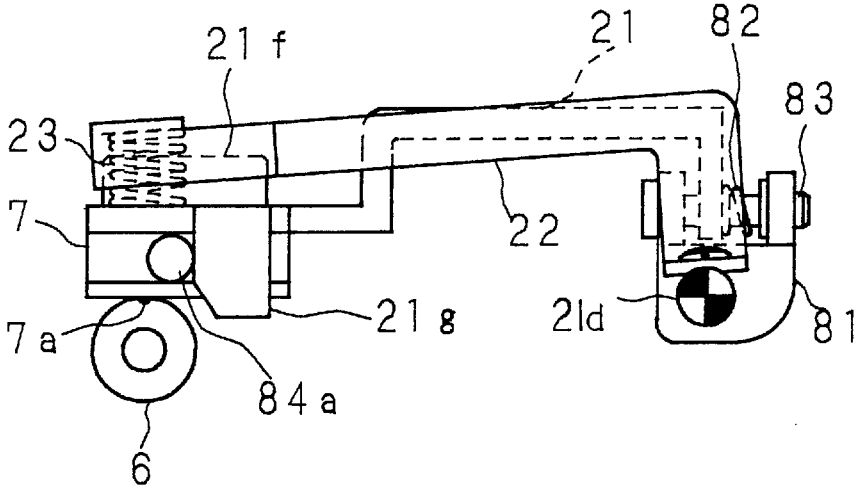

The positioning operation of such thermal head is described below by reference to the explanatory view of operation shown in FIG. 50. FIG. 50(*a*) shows the state of the thermal head 7 waiting upward, in which the holding member 21 and the pressing member 22 are thrust by the coil spring 82 and pushed out to the platen roller 6 side.

In consequence, when the shaft 21*d* is rotated by the motor M1 shown in FIG. 47, the pressing member 22 fixed therein is put in rotation, and the slant portion 21*n* of the lower end of the guide plate 21*g* abuts against the guide pin 84*a*, as shown in FIG. 50(*b*). When the pressing member 22 is further rotated, the holding member 21 is rotated to the platen roller 6 side by the contact spring 23, and the guide pin 84*a* slides along the slant portion 21*n* of the guide plate 21*g*, and is pushed back to the bush 81 side.

When the pressing member 21 is further rotated, as shown in FIG. 50(*c*), the thermal head 7 stops in the state of abutting against the platen roller 6, and the contact spring 23 is compressed, and the pressing force on the platen roller 6 is maintained. In this state, the thermal head 7 is energized to make printing.

Figure 51:
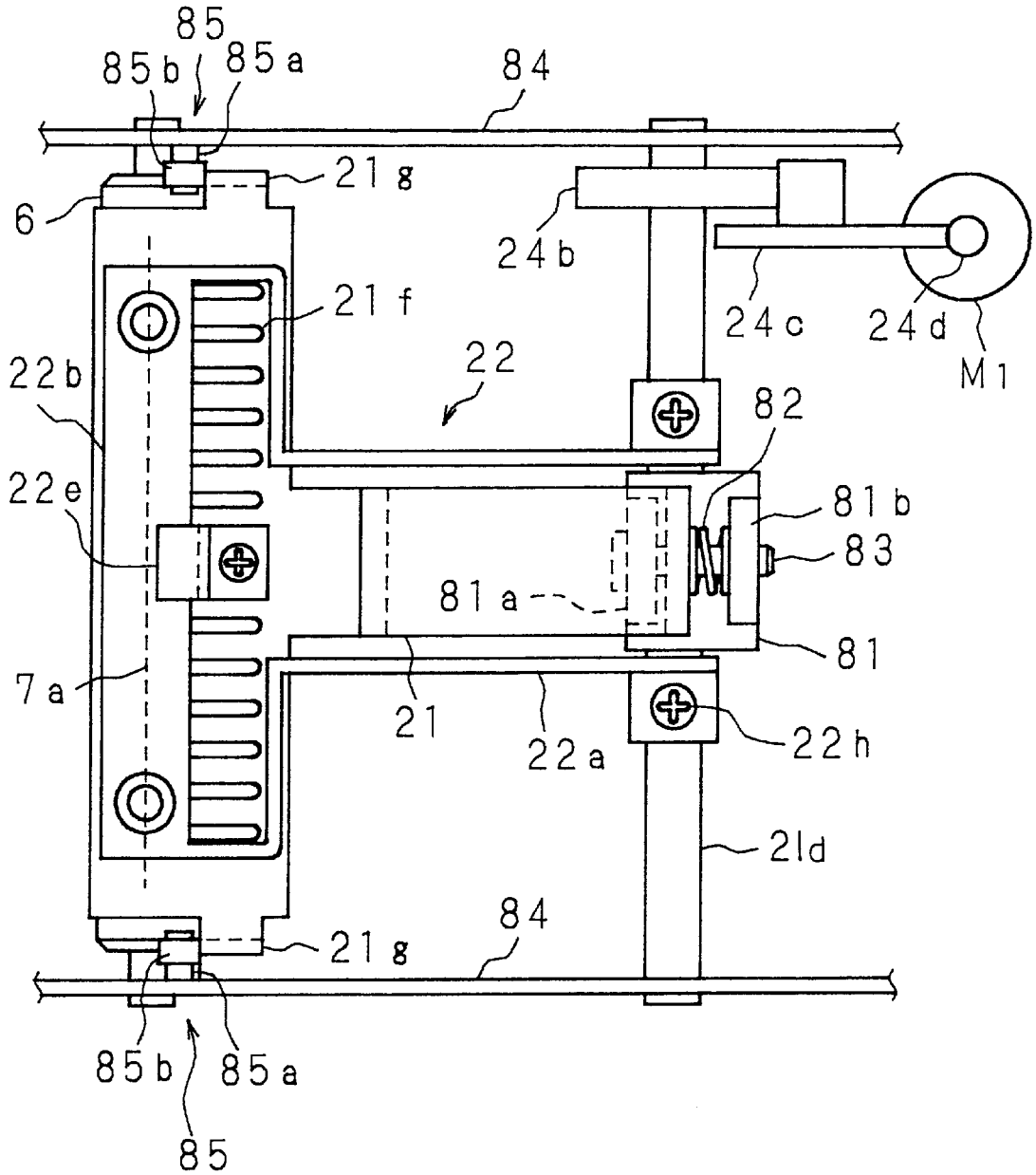
FIG. 51 is an explanatory view of an operation showing other example of thermal head and its positioning means.
Figure 52:
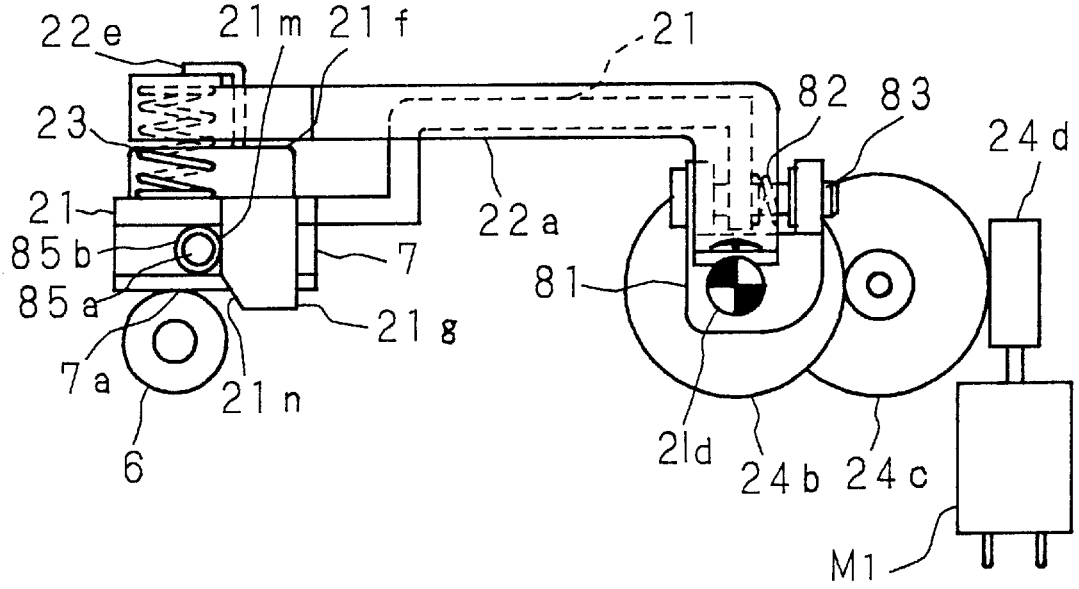
FIG. 52 is its schematic side view.

FIG. 51 is a schematic plan view showing other example of thermal head 7 in a printing apparatus of the invention and its support structure, and FIG. 52 is its schematic side view.

In this embodiment, instead of the guide pin 84*a* as shown in FIG. 47 a detachable collar 85*b* is fitted to the pin 85*a*. By replacing such a guide pin 85 with a collar 85*b* having a different outside diameter, the position to be positioned of the platen roller 6 with respect to the thermal head 7 may be freely adjusted.

The other constitution and operation are substantially same as that of embodiment shown in FIG. 47 and FIG. 48, and the corresponding parts are identified with same reference numbers and explanations are omitted.

Figure 53:
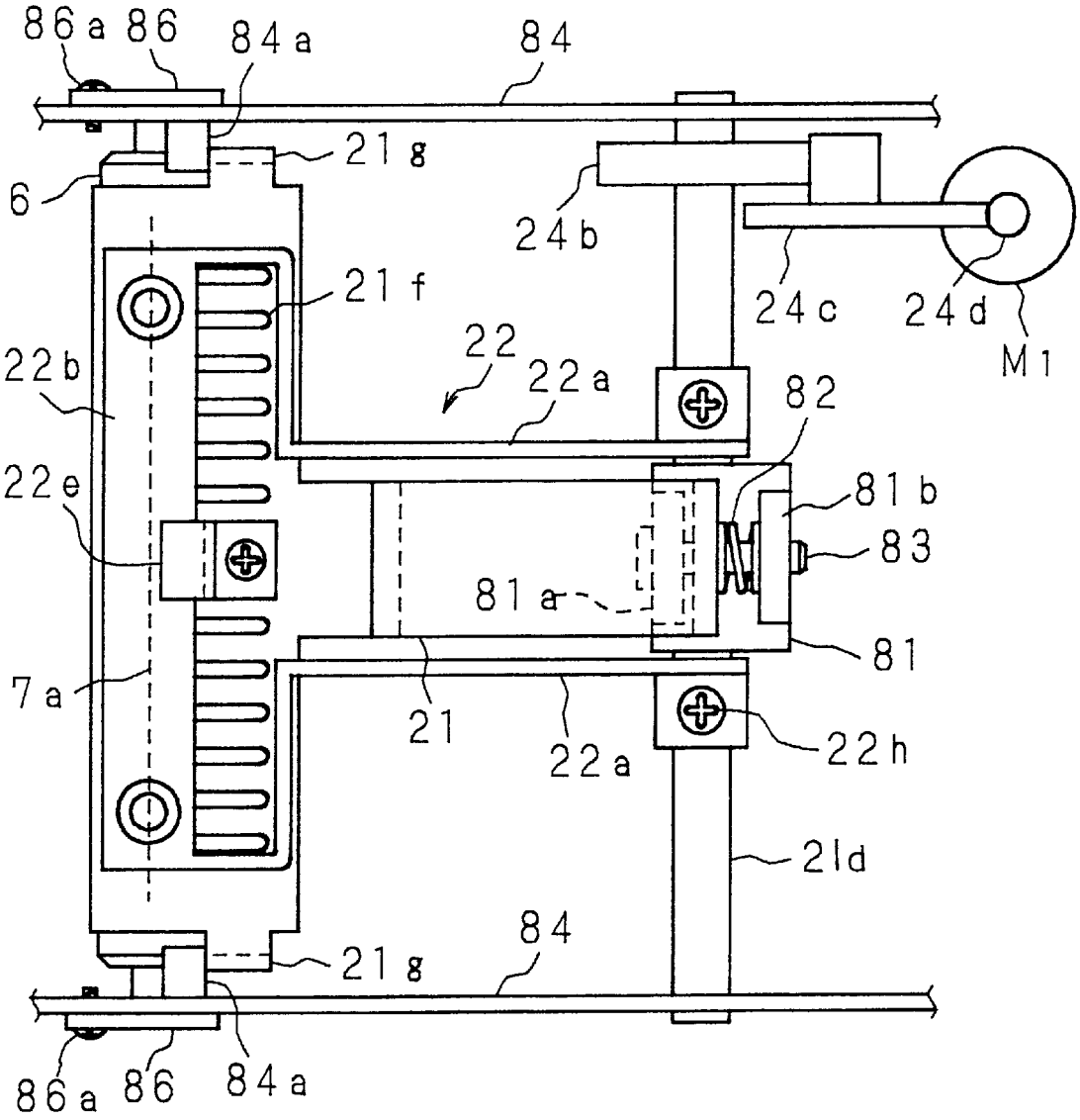
FIG. 53 is a schematic plan view showing a different example of thermal head and its positioning means.
Figure 54:
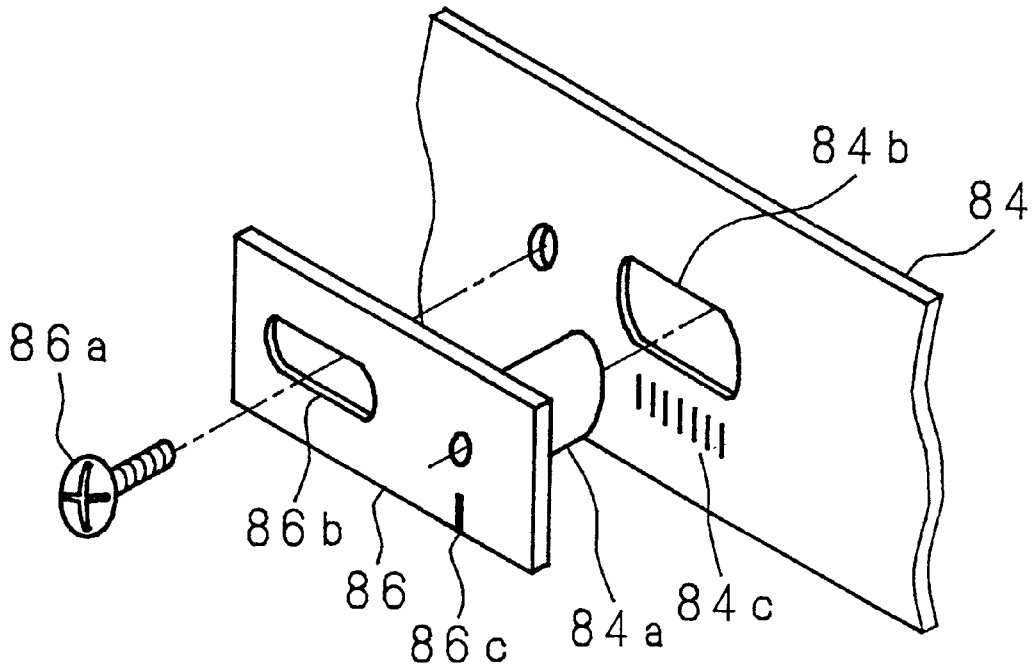
FIG. 54 is an enlarged perspective view of the positioning means shown in FIG. 53.

FIG. 53 is a schematic plan view showing a further different example of the thermal head 7 in a printing apparatus of the invention and its support structure, and FIG. 54 is a partially enlarged perspective view showing the mounting state of the guide pin shown in FIG. 53.

In this embodiment, instead of the guide pin 84*a* directly fitted to the side frame 84 as in the embodiment shown in FIG. 47, the guide pin 84*a* is disposed at a movable adjusting plate 86, and the movable adjusting plate 86 is fixed on the side frame 84 so as to be adjustable by means of set screw 86*a*. That is, as shown in FIG. 54, a slot 84*b* is disposed at the side frame 84 so as to extend in the direction parallel to the coupling shaft 83 (see FIG. 53), in other words, in the conveying direction of the printing paper P, and with the guide pin 84*a* projected inward of the side frame 84 through the slot 84*b*, it is screwed and tightened to the side frame 84 by the set screw 86*a* through the slot 86*b*. Numerals 84*c*, 86*c* are graduations as the guideline for moving stroke of the movable adjusting plate 86.

In such a constitution, within the range of slot 84*b*, moving and adjusting the movable adjusting plate 86 in the conveying direction of the printing paper P with respect to the side frame 84, the front and rear positions of the thermal head 7 to the platen roller 6 may be adjusted to be equal to the right and left.

Figure 55:
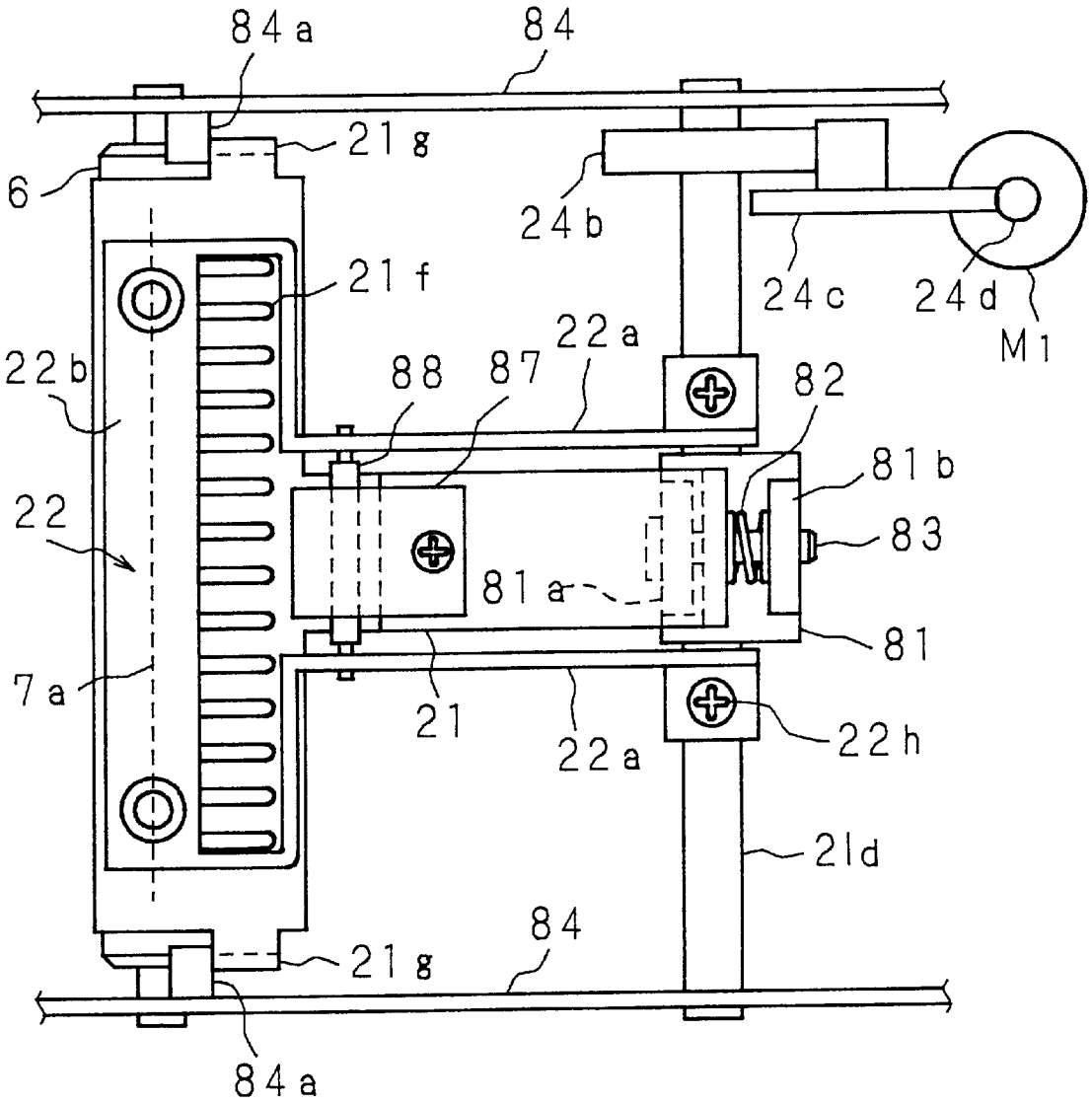
FIG. 55 is a schematic plan view showing the relation of thermal head and pressing member.
Figure 56:
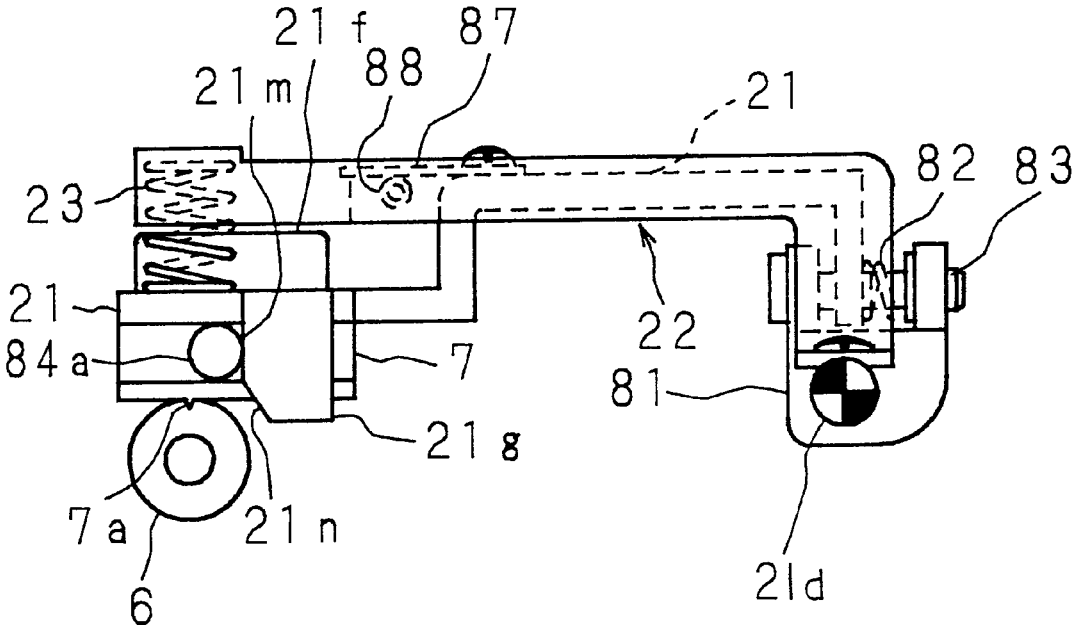
FIG. 56 is its side view.

FIG. 55 is a schematic plan view showing other example of thermal head and support structure thereof in a printing apparatus of the invention, and FIG. 56 is its schematic side view.

In this embodiment, as a relative positioning stopper of the holding member 21 and pressing member 22 of the thermal head 7, instead of the stopper 22*e* shown in FIG. 53, a holding plate 87 is disposed on the upper side of the curved portion in a downward U-shape at the holder member 21, and a roller 88 is pivoted at a lower position of the holding plate 87 between right and left support arms 22*a*, 22*a* of the pressing member 22, and only the upward movement of the roller 88 is regulated by the holding plate 87.

As a result, when positioning the thermal head 7 on the platen roller 6, the holding member 21 smoothly slides in the longitudinal direction by the rotation of the roller 88.

Figure 57:
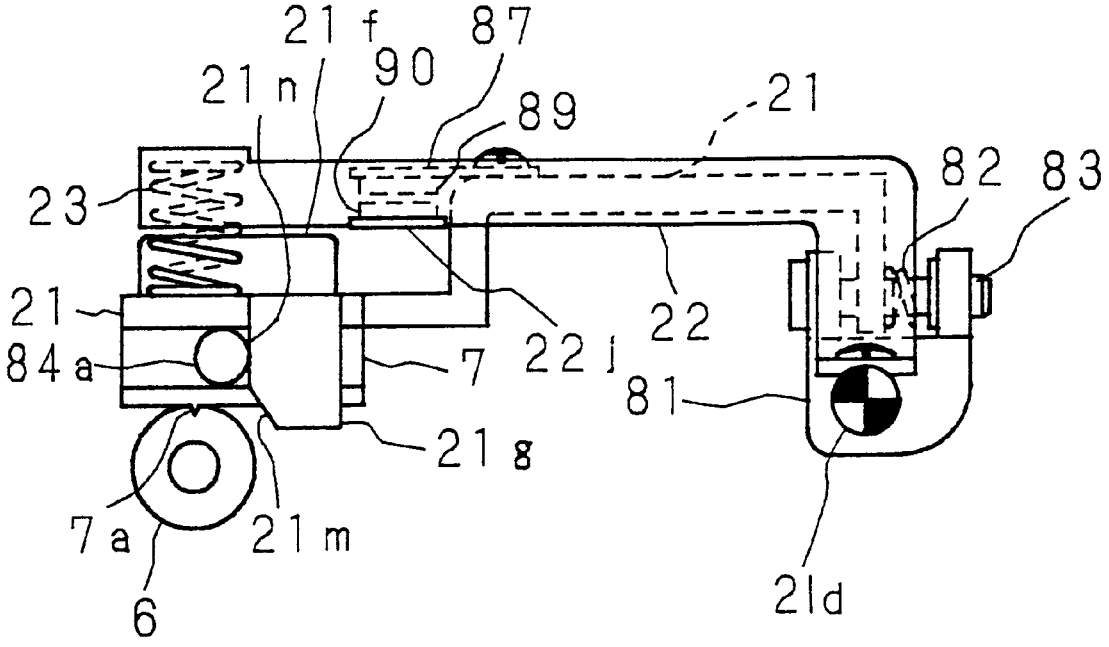
FIG. 57 is a schematic plan view showing other relation of thermal head and pressing member.
Figure 58:
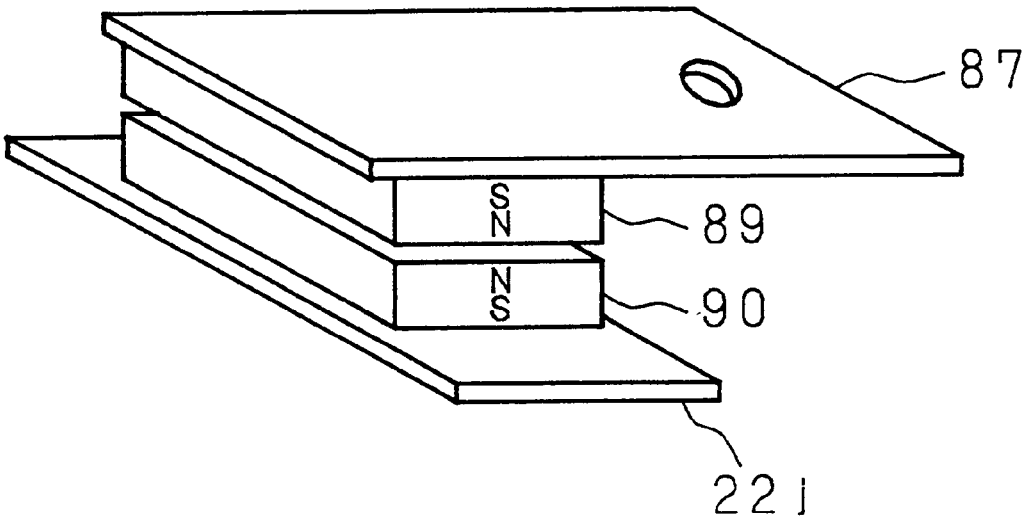
FIG. 58 is an enlarged perspective view of essential parts of FIG. 57.

FIG. 57 is a schematic side view showing a different example of the thermal head and its support mechanism in an printing apparatus of the invention, and FIG. 58 is its partially enlarged perspective view. In this embodiment, by making use of the repulsive force of two magnets 89, 90 magnetized in the vertical direction, only the upward motion of the pressing member 22 is regulated.

More specifically, the magnet 89 magnetized in the S pole at the upper side and N pole at the lower side as shown in FIG. 58 is fixed in the lower surface of the holding plate 87, and a mounting plate 22*j* is disposed between the support arms 22*a* of the pressing member 22 located beneath the holding plate 87, and the magnet 90 magnetized in the N pole at the upper side and S pole at the lower side is fixed on the mounting plate 22*j*. Hence, the opposing polarities repel against each other to regulate only the upward motion of the pressing member 22, while the longitudinal motion of the holding member 21 in the contact operation is not regulated, so that the smooth motion of the thermal head 7 is guaranteed.

Figure 59:
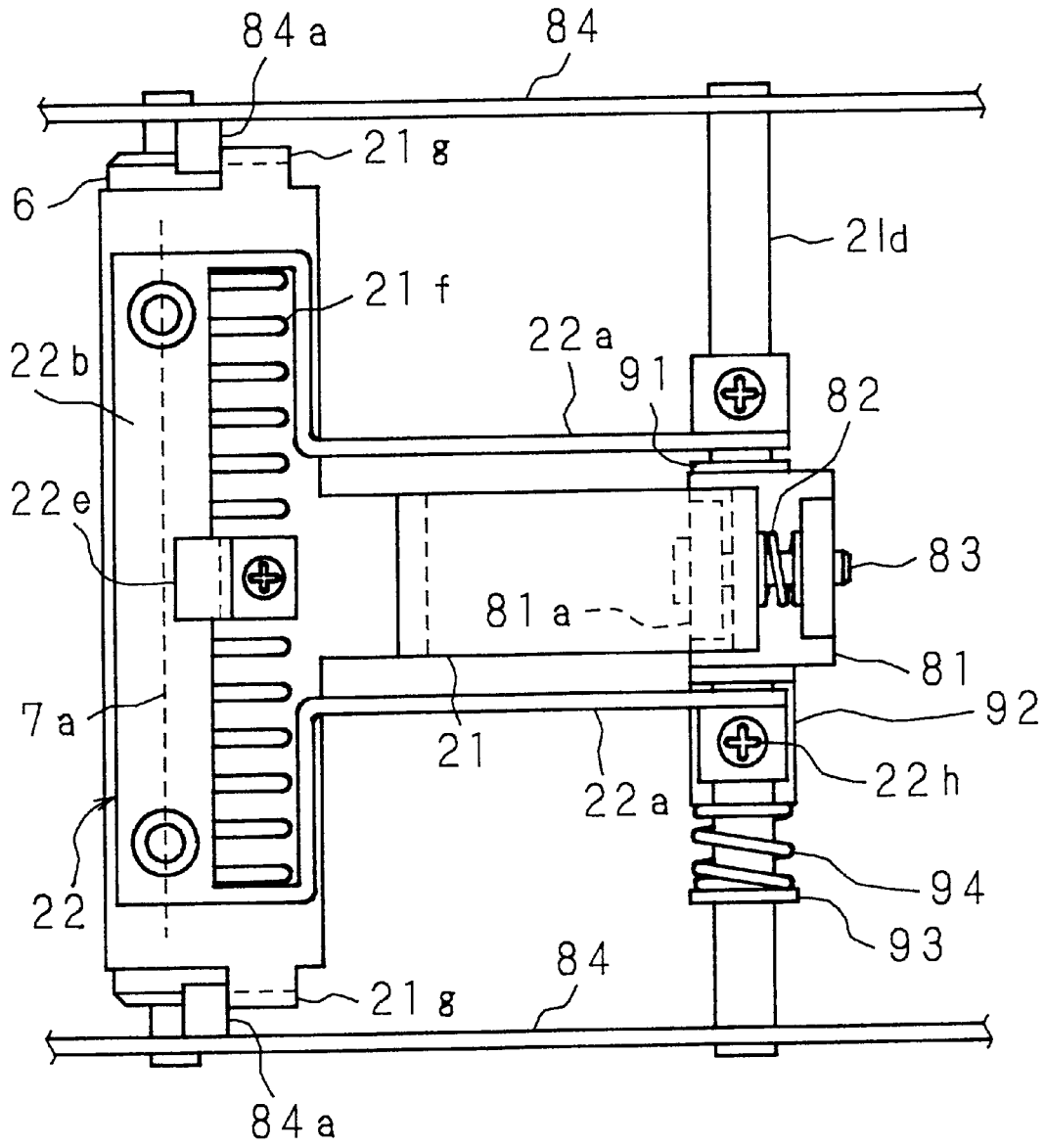
FIG. 59 is a schematic plan view showing a further different example of thermal head and its positioning means.
Figure 60:
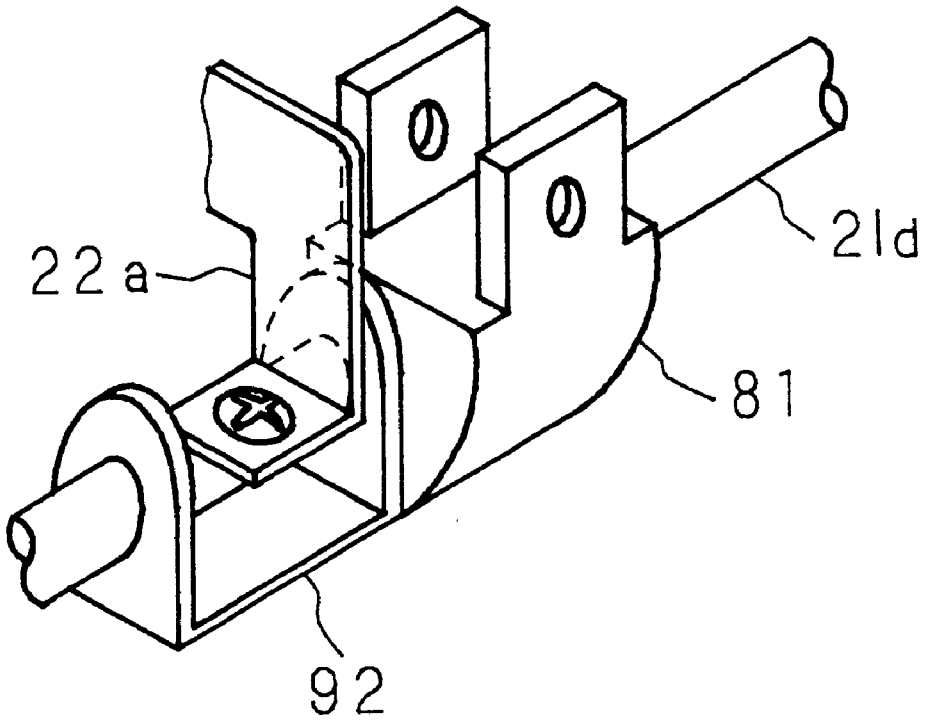
FIG. 60 is an enlarged perspective view showing essential parts of FIG. 59.

FIG. 59 is a schematic plan view showing a still different example of the thermal head and its support structure in a printing apparatus of the invention, and FIG. 60 is its partially enlarged perspective view. In this embodiment, in order to regulate the movement of the thermal head 7 in the axial length direction of the shaft 21*d* a stopper ring 91 abutting against one side of the bush 81 as shown in FIG. 59 and the spacer member 92 abutting against the other side, are fixed on the shaft, respectively, and outside the spacer member 92, a spring retainer 93 is fixed on the shaft 21*d* and a coil spring 94 is intervening between the spring retainer 93 and spacer member 92.

The spacer member 92 is formed in an upward U-shape as shown in FIG. 60, and the support arm 22*a* of the pressing member 22 is engaged with the shaft 21*d* in a manner of straddling over the portion fixed on the shaft 21*d* and by the dilating force of the coil spring 94, the bush 81 is thrust to the stopper ring 91 side.

Cooling Means of Thermal Head

Figure 61:
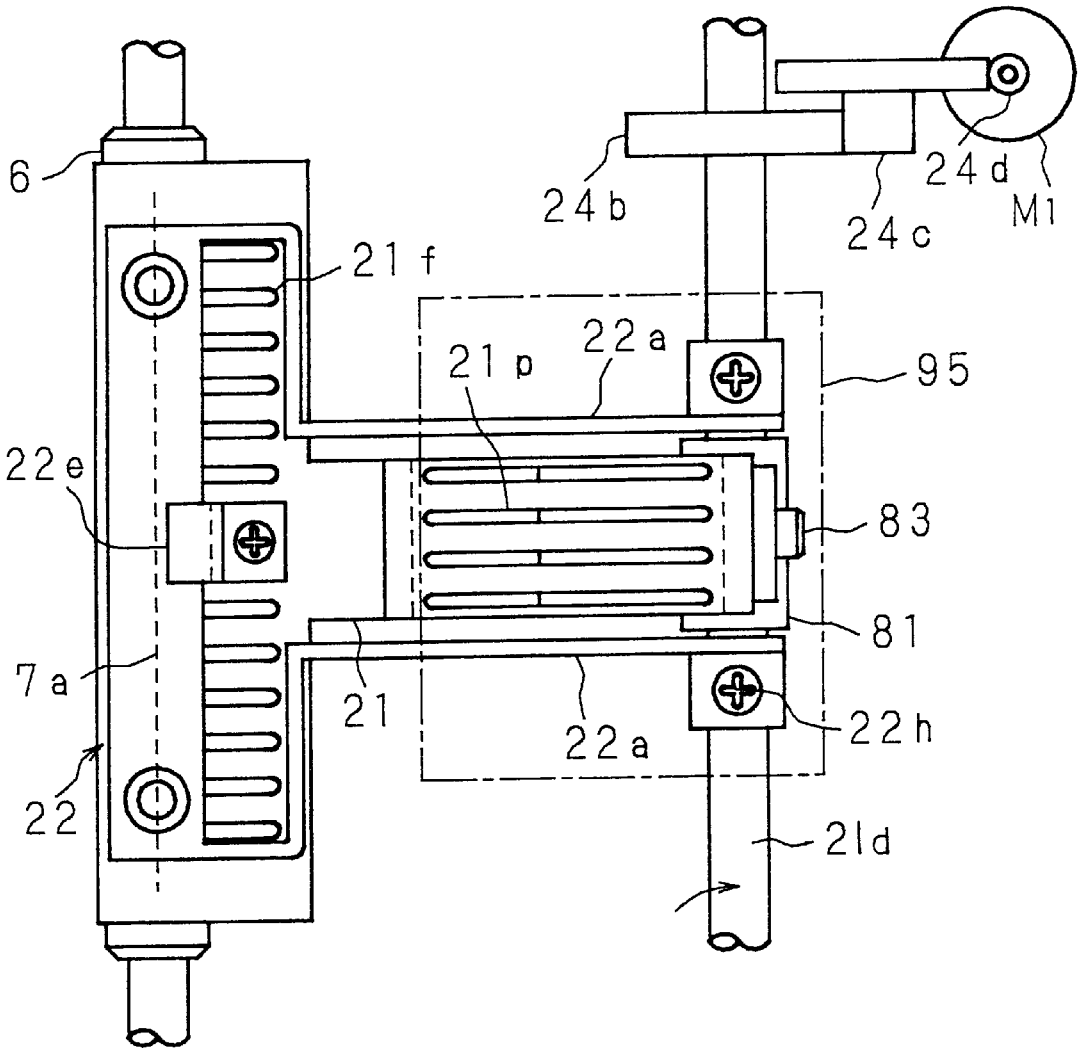
FIG. 61 is a schematic plan view showing cooling means of thermal head.
Figure 62:
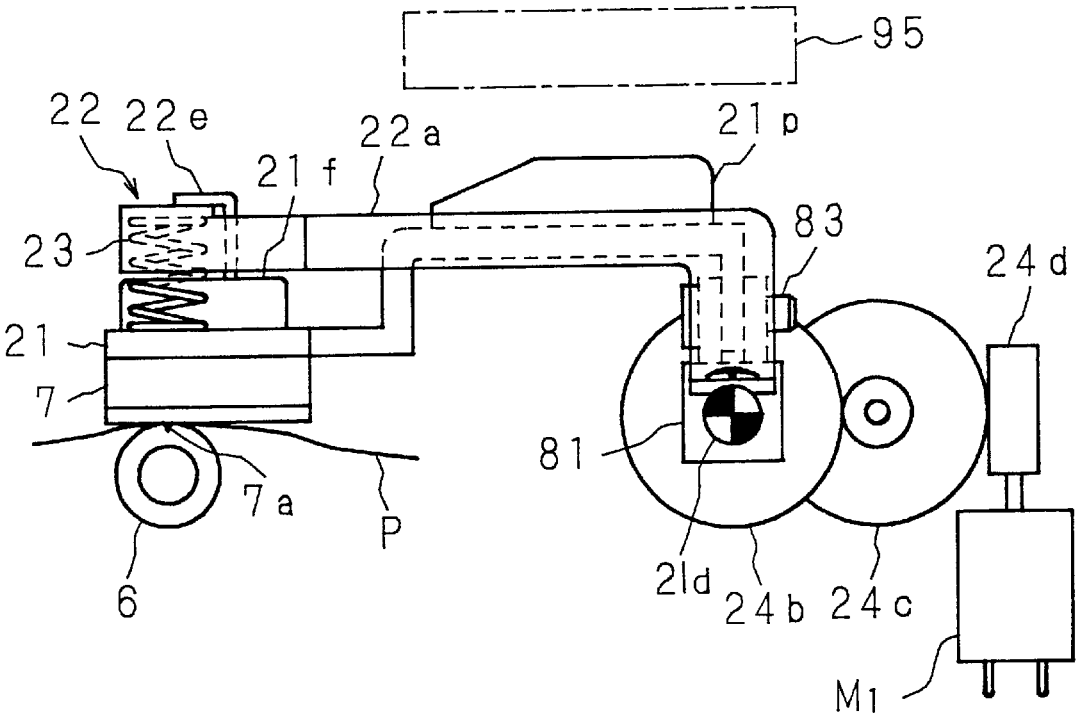
FIG. 62 is its schematic side view, FIGS. 63(*a*), (*b*) are explanatory view of operation of the positioning of the thermal head.

FIG. 61 is a schematic plan view showing the configuration applied to the thermal head showing the cooling means of the thermal head, and FIG. 62 is its schematic side view.

In the holding member 21 of the thermal head 7, in addition to the radiation fins 21*f* disposed at the position corresponding to the mounting position of the thermal head 7, there are radiation fins 21*p* also on the upper surface of the curvature formed at the base end side of the holding member 21, and a cooling fan 95 is installed above the radiation fins 21*p*.

Concerning such cooling means of the thermal head, the operation is described below by reference to the explanatory view of operation shown in FIG. 63. In the cooling means of such a thermal head 7, the heat generated from the heat generation unit 7*a* of the thermal head 7 is led into the radiation fins 21*f*, 21*p* through the holding member 21 by heat conduction, and is radiated therefrom, and moreover from the cooling fan 95, air is blown out always toward the radiation fins 21*p* side to promote cooling as indicated by arrow while the thermal head 7 is in waiting state as shown in FIG. 63(*a*) or in the printing state as shown in FIG. 63(*b*).

Figure 15:
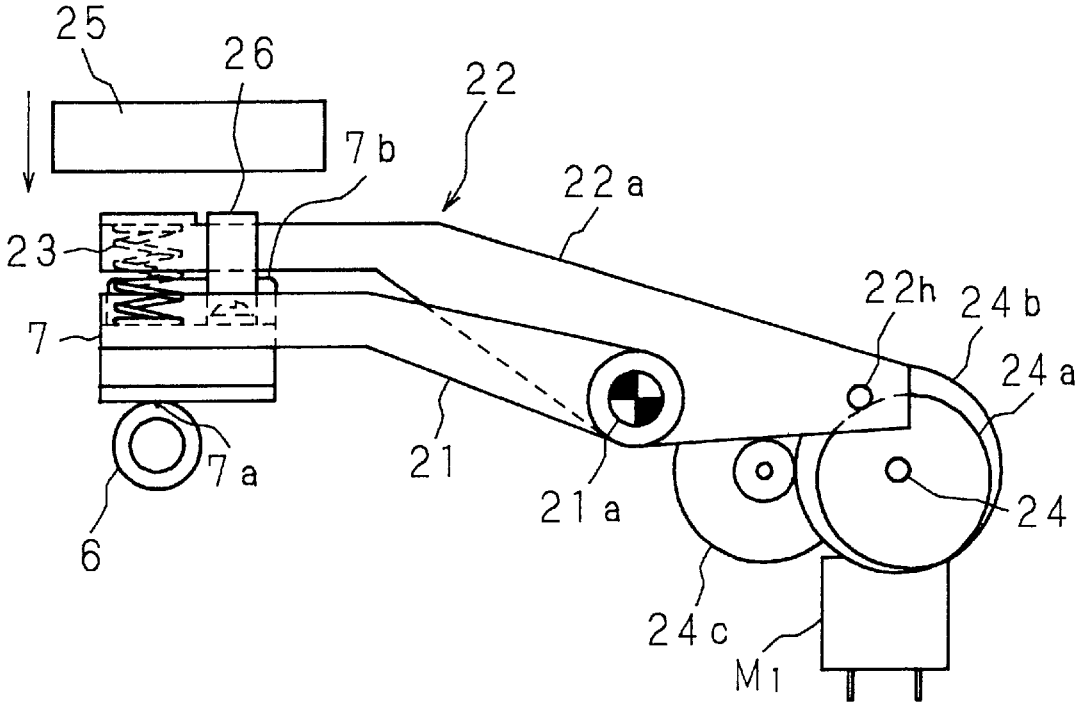
Fig. 15 Prior Art
FIG. 15 is its schematic side view.
Figure 16:
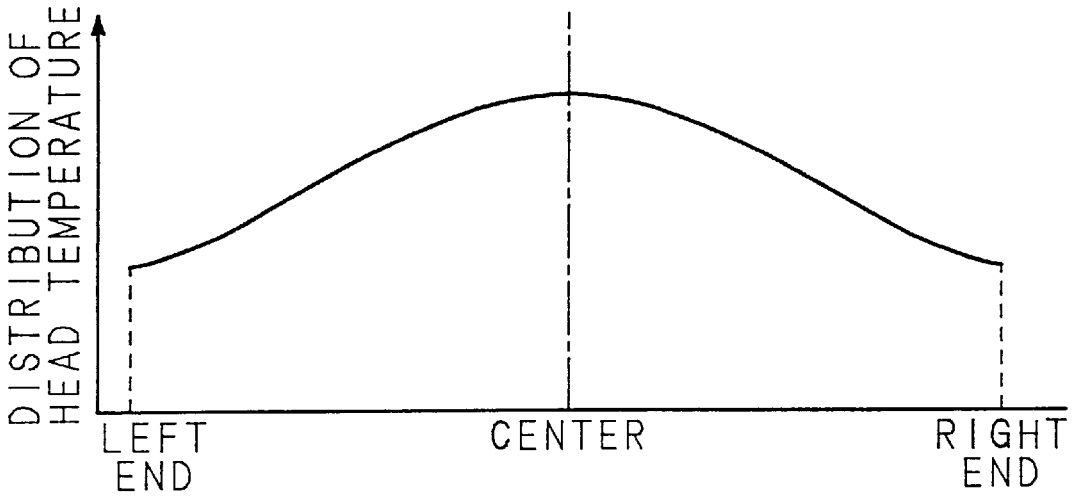
Fig. 16 Prior Art
FIG. 16 is an accumulated heat distribution drawing of a thermal head, FIG. 17(*a*) and 17(*b*) are explanatory views of an operation showing the relation between the thermal head operation and cooling means.
Figure 17A:
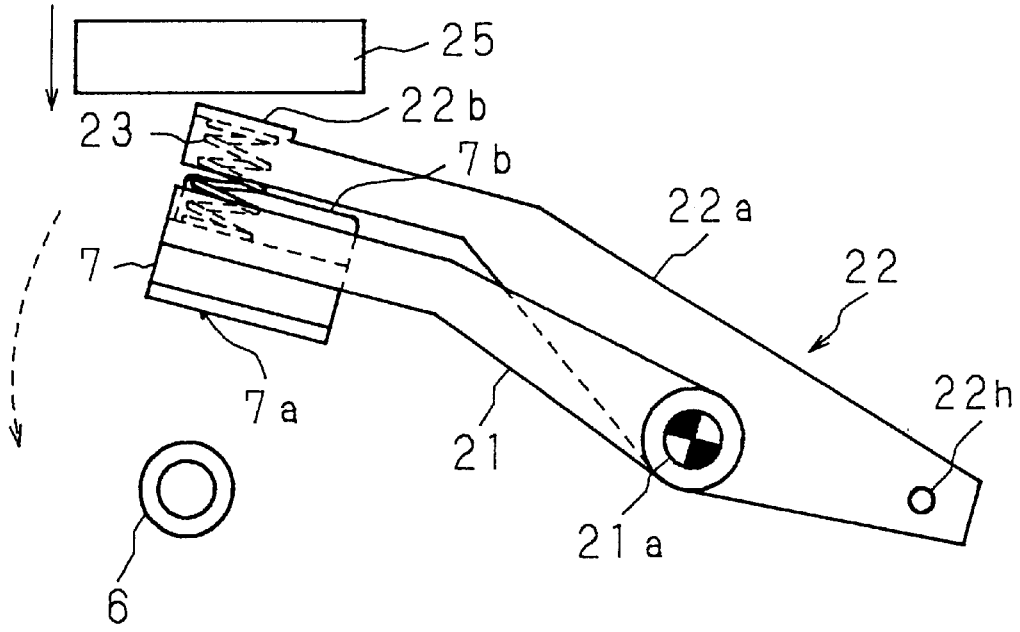
Fig. 17(a) Prior Art
Figure 17B:
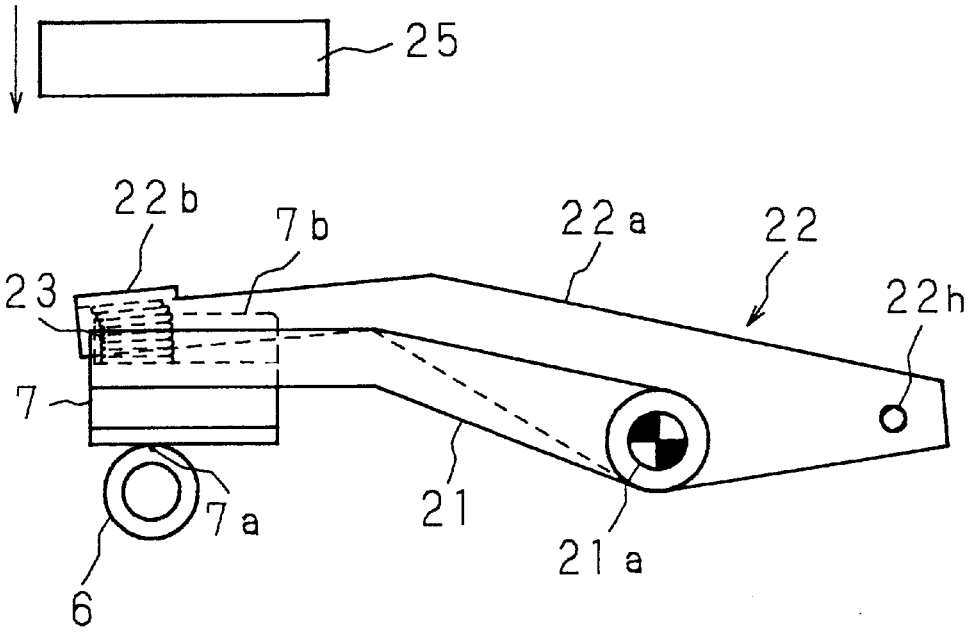
Fig. 17(b) Prior Art
Figure 63A:
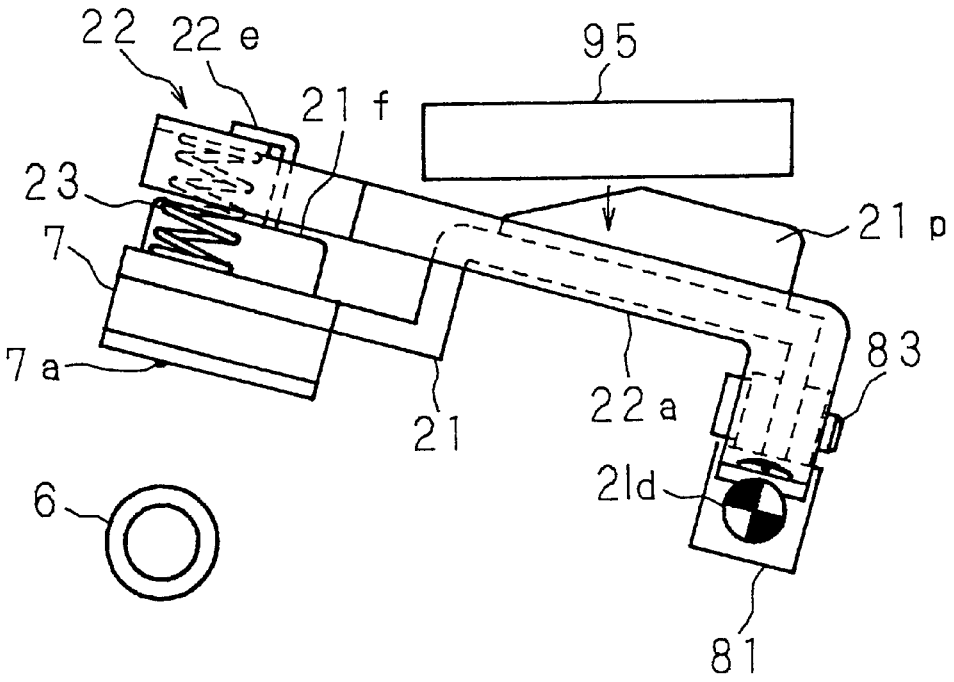
Figure 63B:
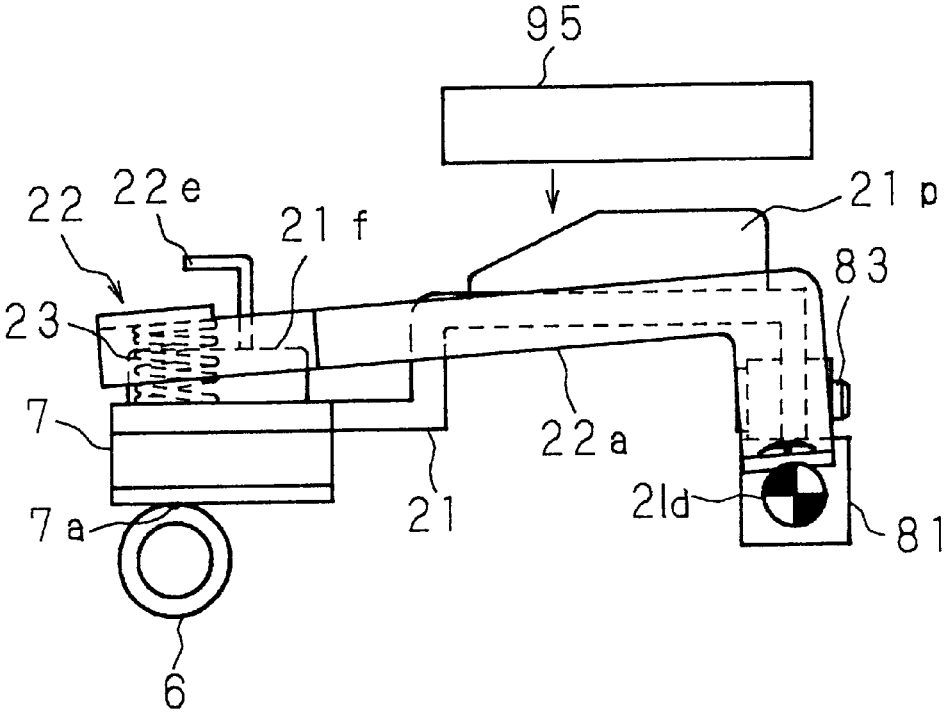

Besides, since the cooling fan 95 faces to the above of the radiation fins 21*p* disposed on the upper surface of the middle portion of the holding member 21 being small in the radius of rotation, even during printing action when the distance between the cooling fan 95 and thermal head 7 is the longest as in FIG. 63(*b*), the distance to the radiation fins 21*p* is shorter than in the prior art as shown in FIG. 15, so that it is possible to cool effectively. The operations of the holding member 21 and pressing member 22 of the thermal head 7 are substantially same as the cases shown in FIG. 47 and FIG. 48, and same reference numbers are given to the corresponding parts.

Figure 64:
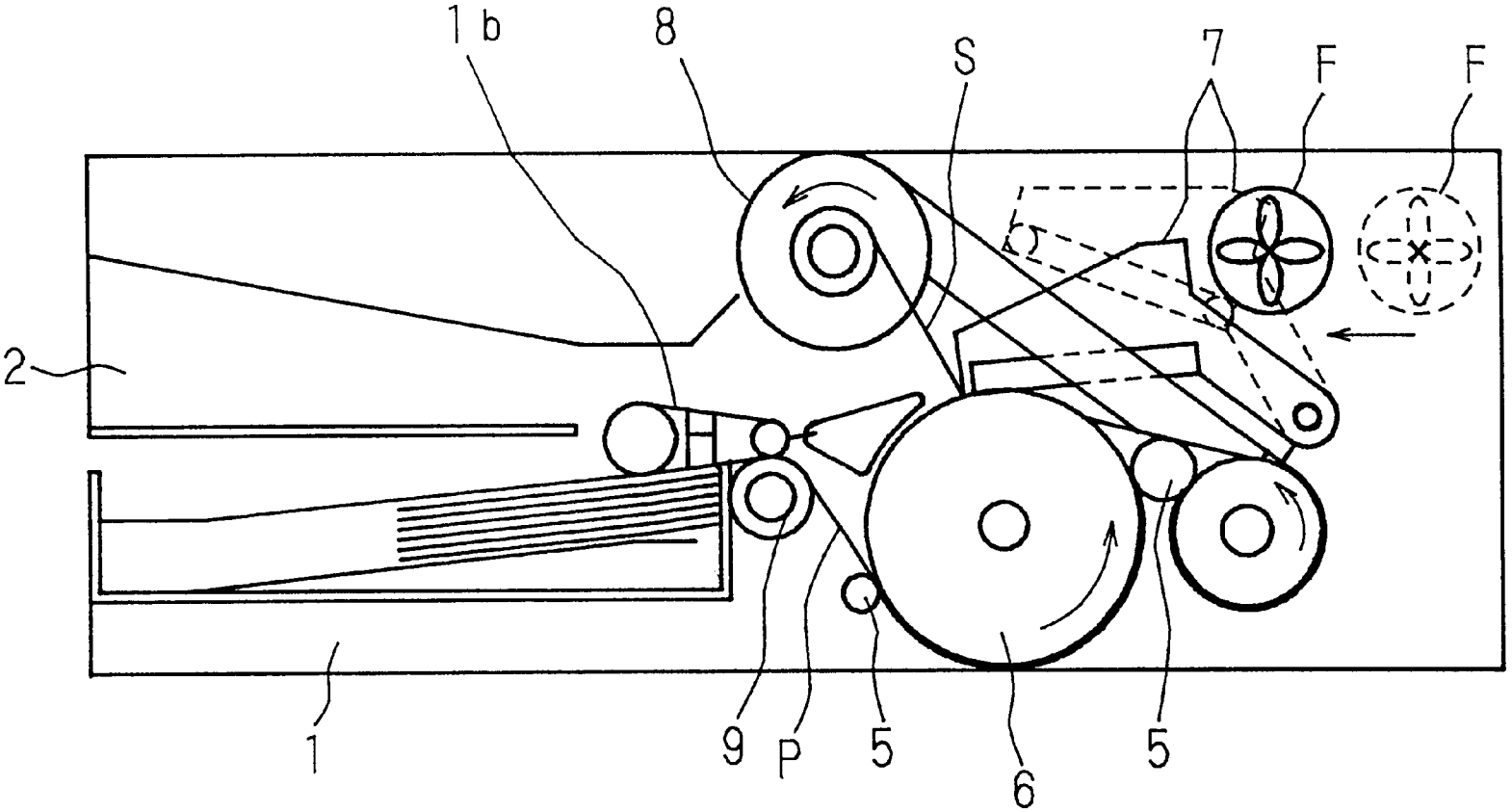
FIG. 64 is a schematic side view showing other example of cooling means of thermal head.
Figure 65:
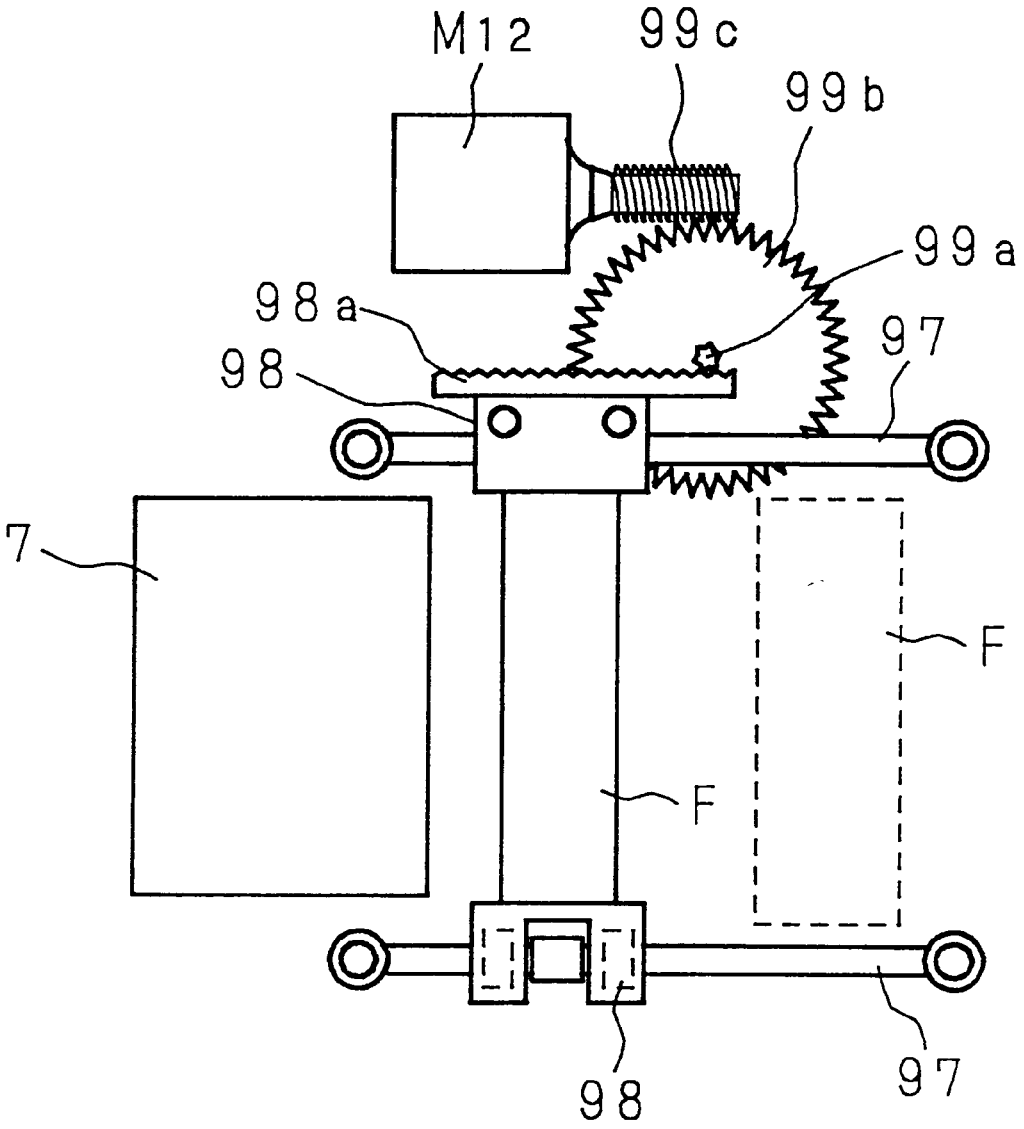
FIG. 65 is a schematic plan view showing the support structure of the cooling means shown in FIG. 64.

FIG. 64 is a schematic side view showing other example of the cooling means of the thermal head 7 in the printing apparatus, and FIG. 65 is a schematic plan view showing the moving mechanism of the cooling fan.

In the embodiment, the cooling fan F for cooling the thermal head 7 is movable, and while the thermal head 7 is in printing action, it comes closer to the thermal head 7, and when the thermal head 7 returns to the waiting position, it is drawn back to the position for avoiding interference.

Figure 3:
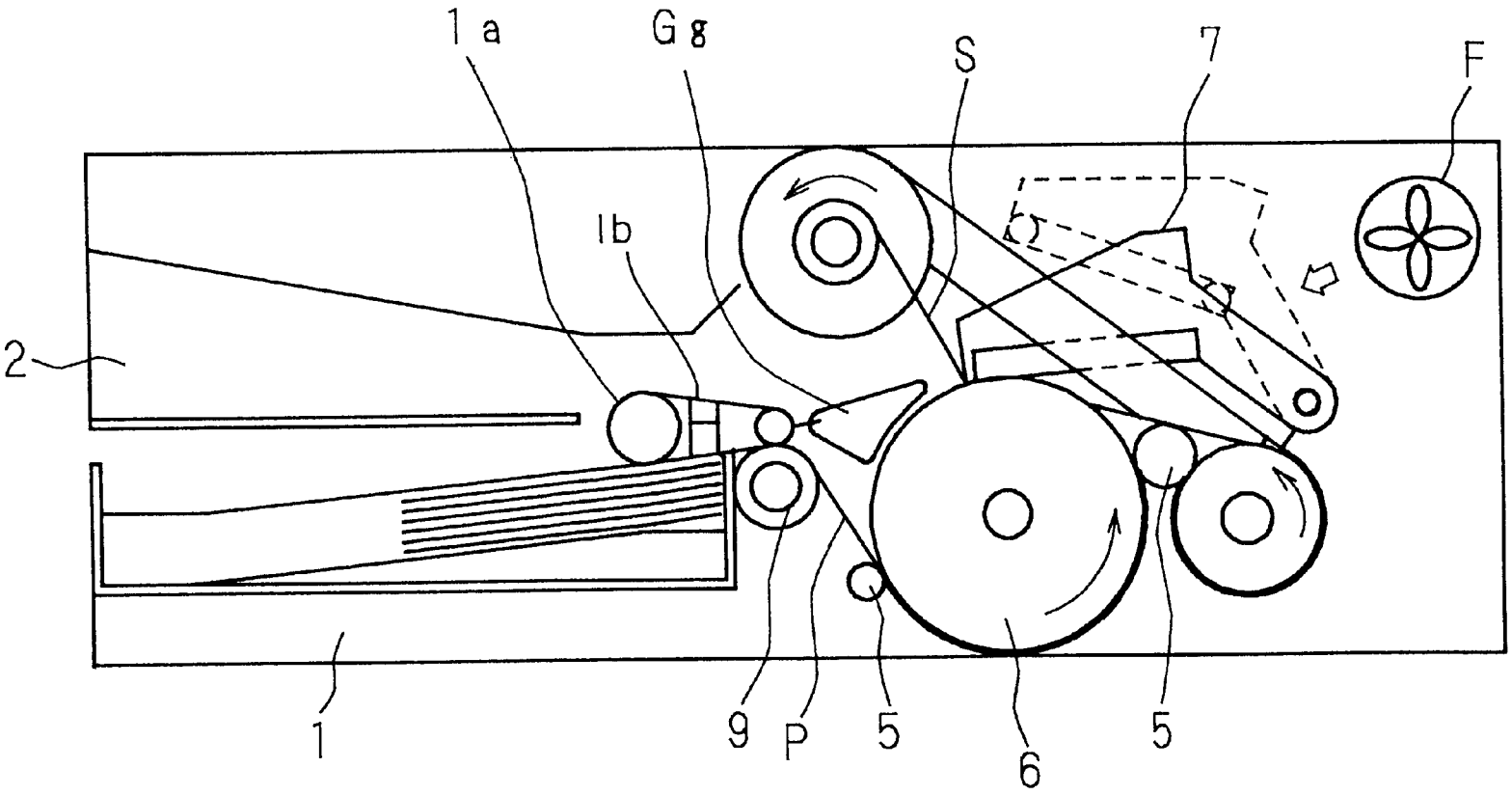
Fig. 3 Prior Art
FIG. 3 is a schematic side view showing a different conventional printing apparatus.
Figure 4:
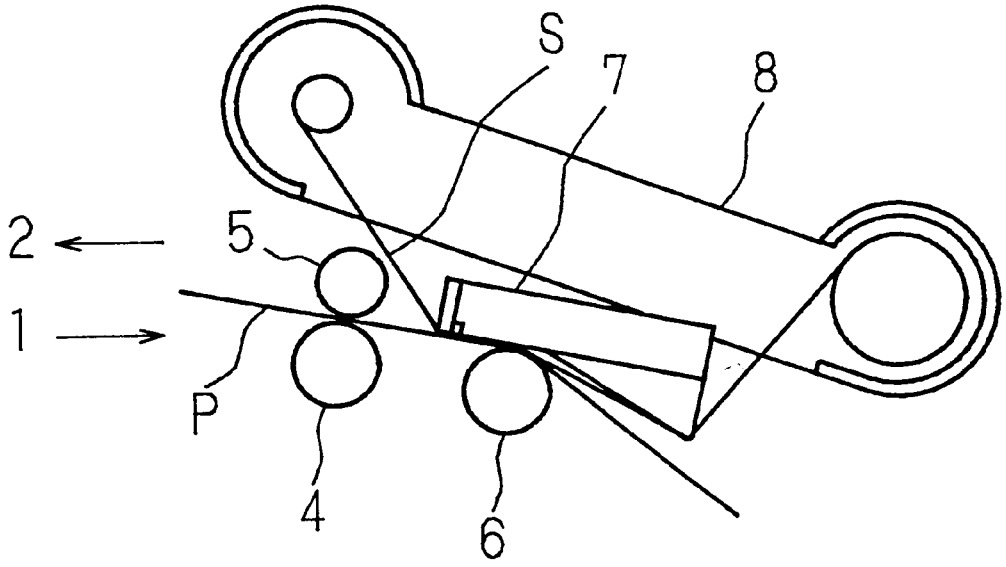
Fig. 4 Prior Art
FIG. 4 is a schematic side view showing a further different conventional printing apparatus.
Figure 5:
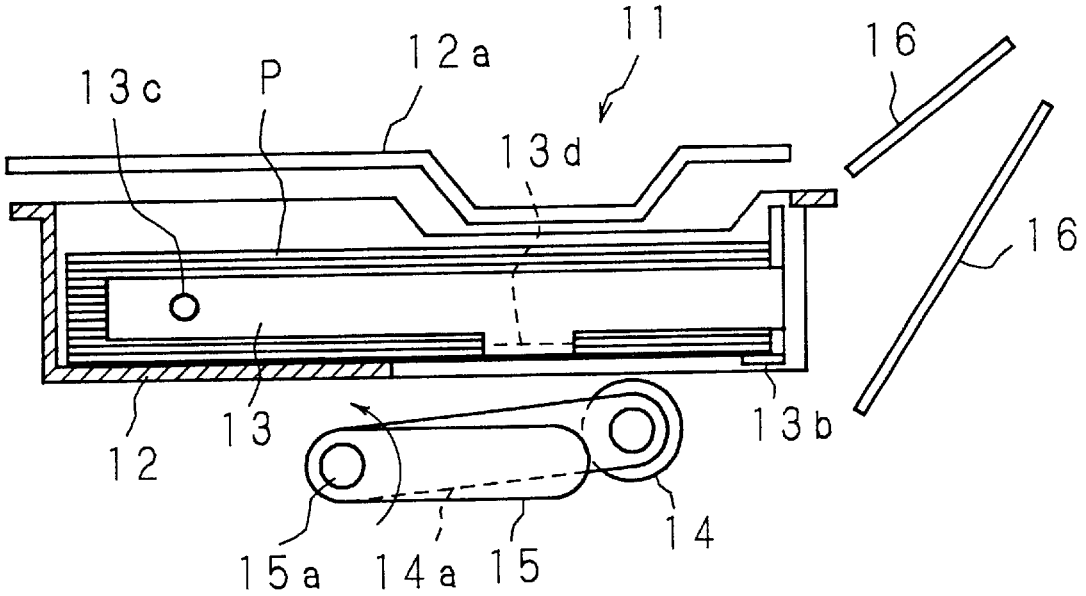
Fig. 5 Prior Art
FIG. 5 is a schematic side view showing a practical structure of paper supply unit in a conventional printing apparatus.
Figure 6:
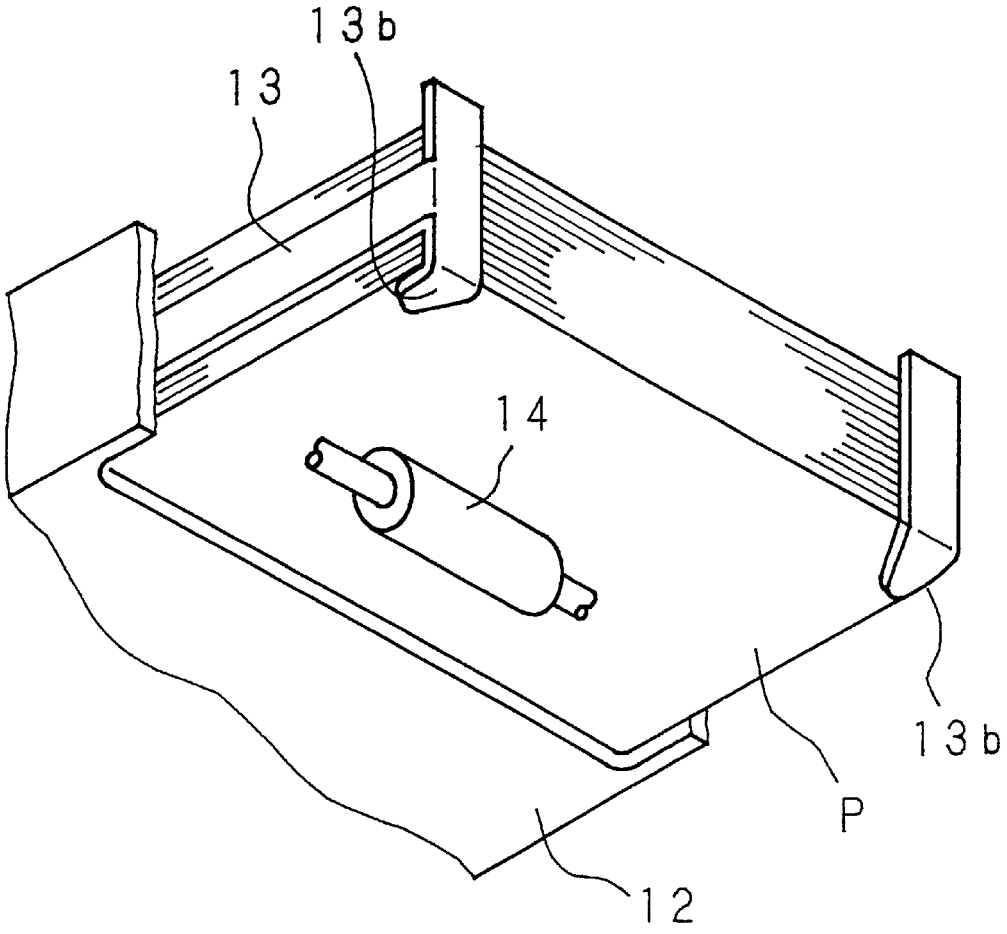
Fig. 6 Prior Art
FIG. 6 is a perspective view of essential parts seeing the paper supply unit in FIG. 5 from the bottom side, FIG. 7 an explanatory view of an operation of the paper supply unit in FIG. 5.
Figure 7:
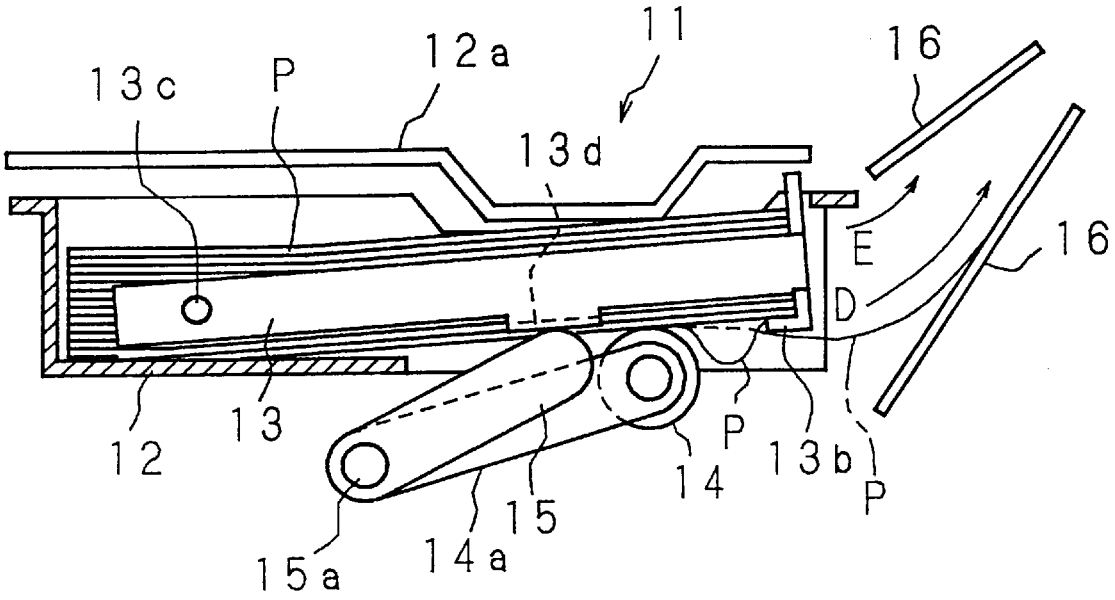
Fig. 7 Prior Art

FIG. 64 shows the constitution in which the cooling means of the invention in the conventional printing apparatus shown in FIG. 3 is applied, and while the thermal head 7 is at the printing position indicated by solid line in FIG. 64, the cooling fan F is moved to the position indicated by solid line, and while the thermal head 7 is at the waiting position indicated by broken line, the cooling fan F is moved to the position indicated by broken line.

FIG. 65 shows the moving mechanism of the cooling fan F, in which numerals 97, 97 are guide rods disposed parallel to each other, and the cooling fan F is movably mounted on the both guide rods 97, 97 at its both ends through linear guides 98, 98. At the linear guide 98 of one side, a rack 98*a* is fixed, and this rack 98*a* is engaged and linked with a worm gear 99*c* disposed on the output shaft of a motor M12 through pinion 99*a* and gear 99*b*.

The operation of the above moving mechanism is explained below. In FIG. 64, when the thermal head 7 moves from the position of the broken line to the position of the solid line, the motor M12 begins to rotate simultaneously or somewhat later, and this operation is transmitted to the rack 98*a* by way of the worm gear 99*c*, gear 99*b*, and pinion 99*a*, and the cooling fan F is moved in the axial direction of the guide rods 97, 97 through the linear guides 98, 98, and stops near the thermal head 7.

When the thermal head 7 returns to the position of broken line, the motor M12 begins to rotate reversely at the same time or somewhat before and the cooling fan F is drawn back to avoid interference with the thermal head 7.

Figure 2A:
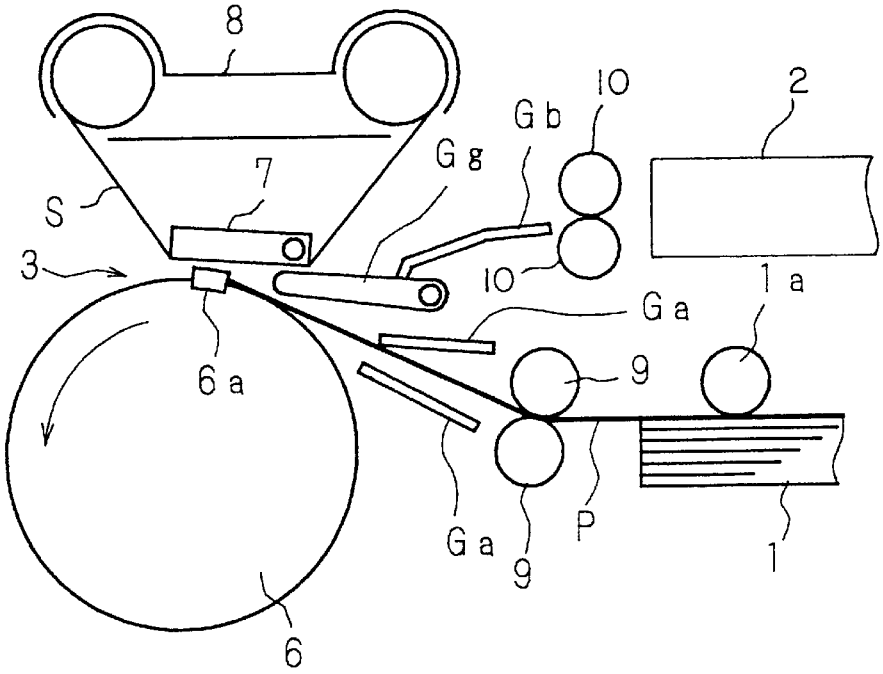
Fig. 2(a) Prior Art
FIGS. 2(*a*) and 2(*b*) are schematic side views showing another conventional printing apparatus in two alternative operation modes.
Figure 2B:
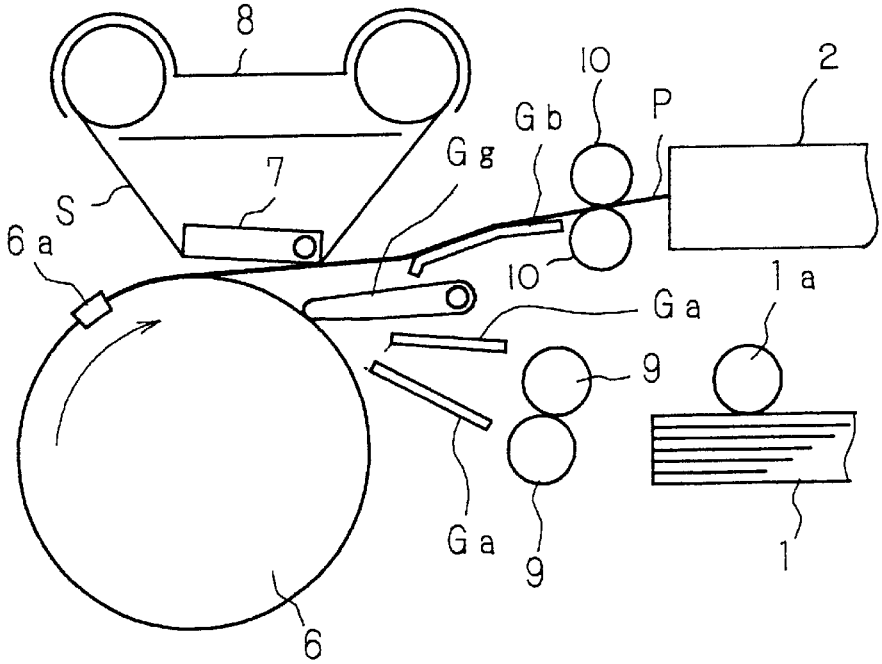
Fig. 2(b) Prior Art

The other constitution and operation are substantially same as in the conventional apparatus shown in FIG. 2, and corresponding parts are identified with the same reference numbers, and are not explained again.

Figure 66:
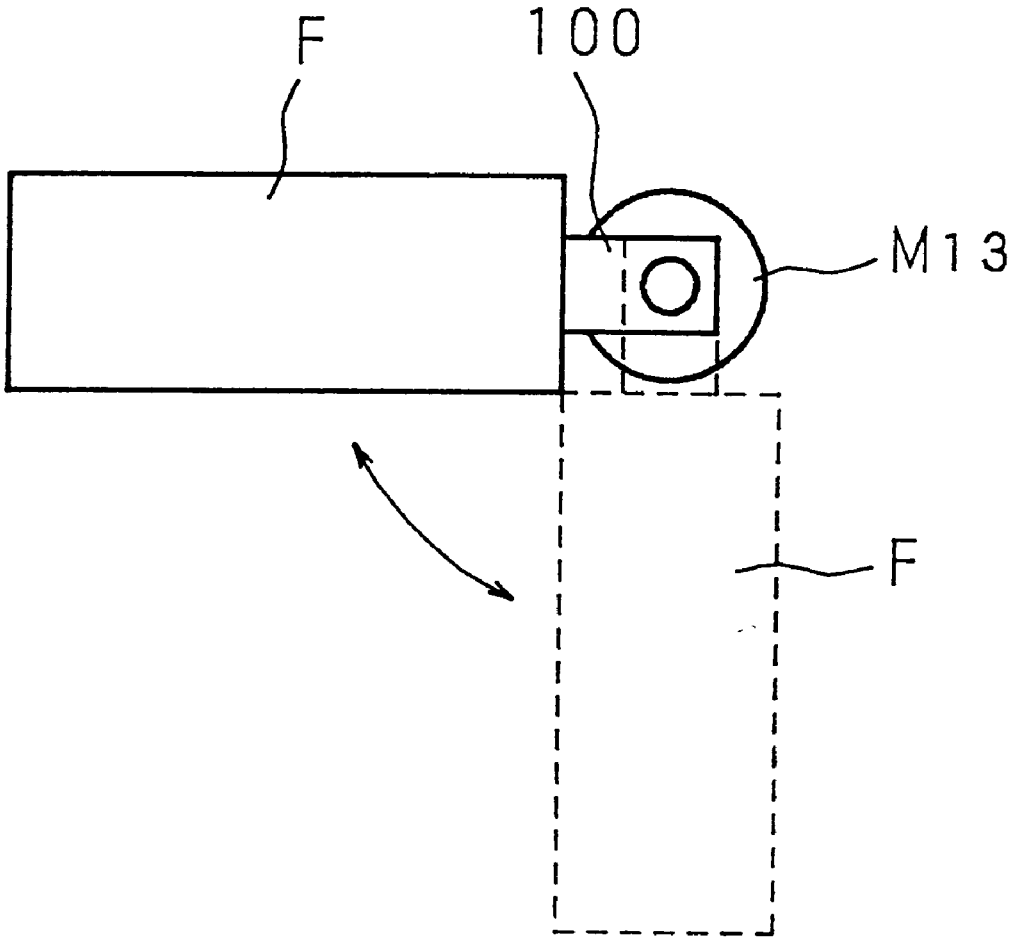
FIG. 66 is a schematic view showing a different example of cooling portion of thermal head.

FIG. 66 is a schematic plan view showing other example of a cooling fan F, in which the cooling fan F has a support rod 100 disposed at one end, and the end of the support rod 100 is fixed on the output shaft of a motor M13. Such a cooling fan F is moved in an arc form within the horizontal plane according to normal and reverse rotation of the motor M13, and when the thermal head 7 is at the printing position, it moves to the position indicated by solid line, and when the thermal head 7 returns to the waiting position, it escapes in advance to the position indicated by broken line.

Practical Constitution of Ink Sheet Cassette and Its Drive Unit

Figure 67:
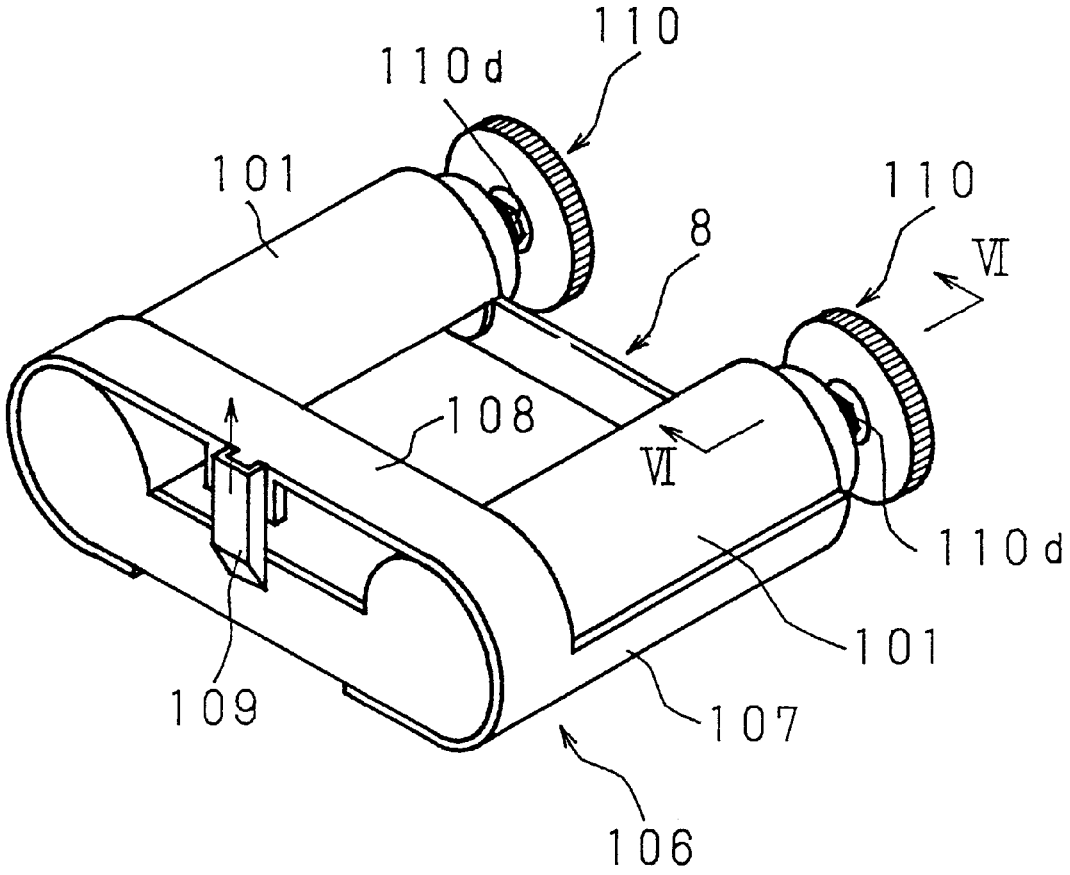
FIG. 67 is a perspective view showing a practical structure of an ink sheet cassette in a printing apparatus of the invention.
Figure 68:
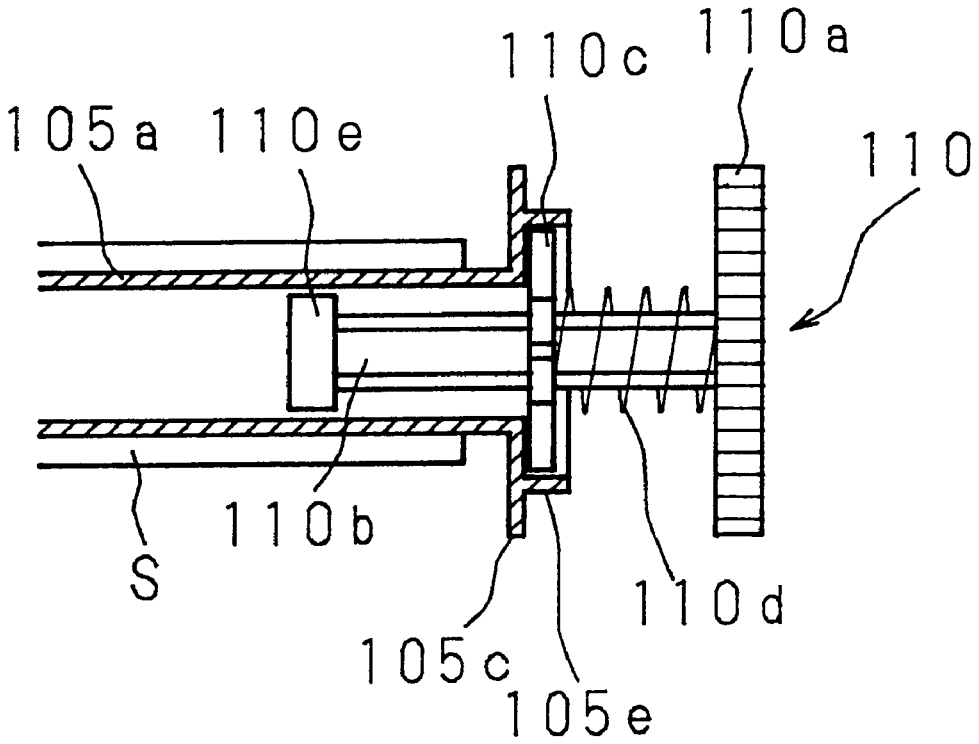
FIG. 68 is a sectional view along line VI—VI in FIG. 67.
Figure 69:
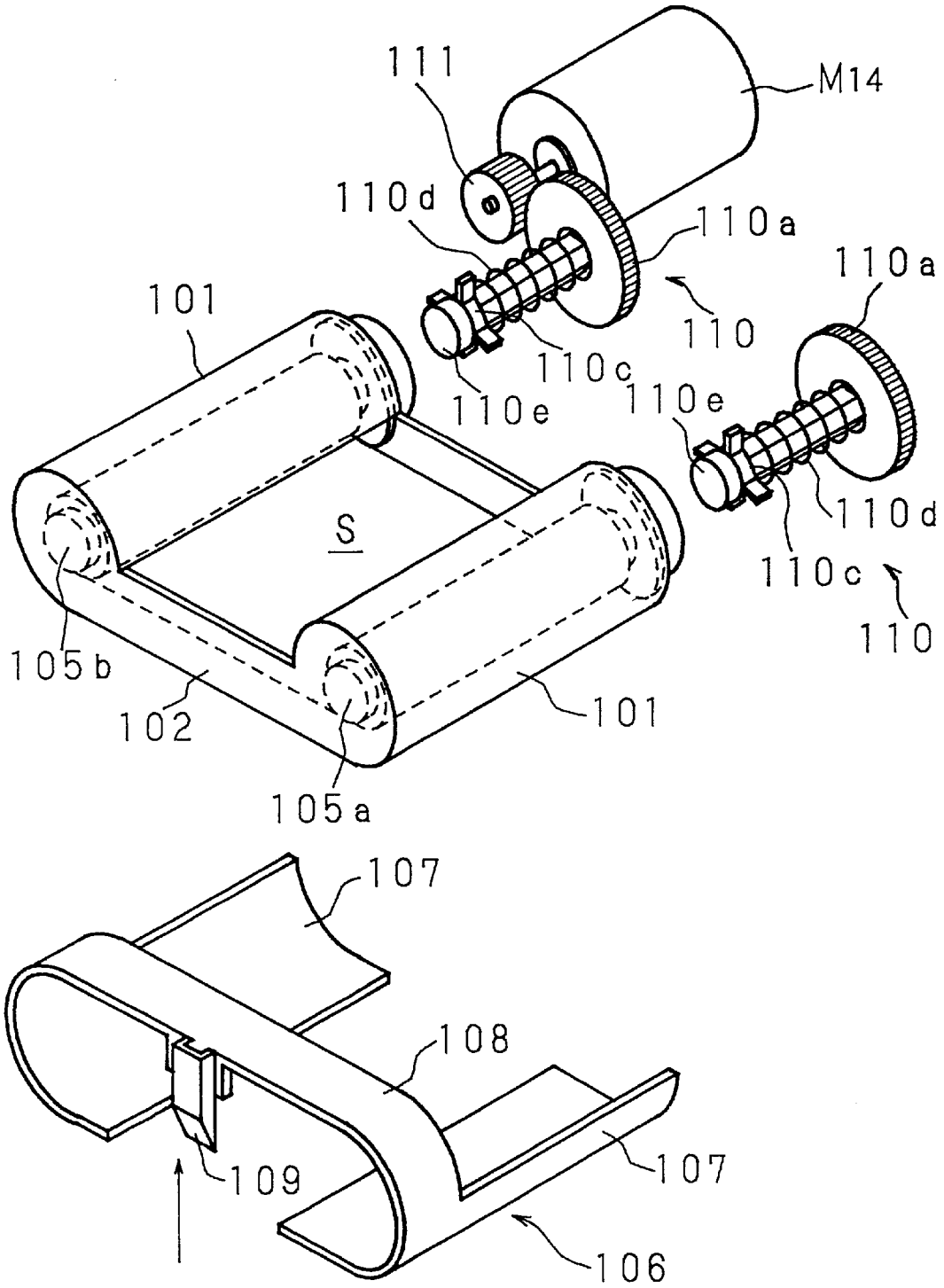
FIG. 69 is an exploded perspective view of an ink sheet cassette.
Figure 70:
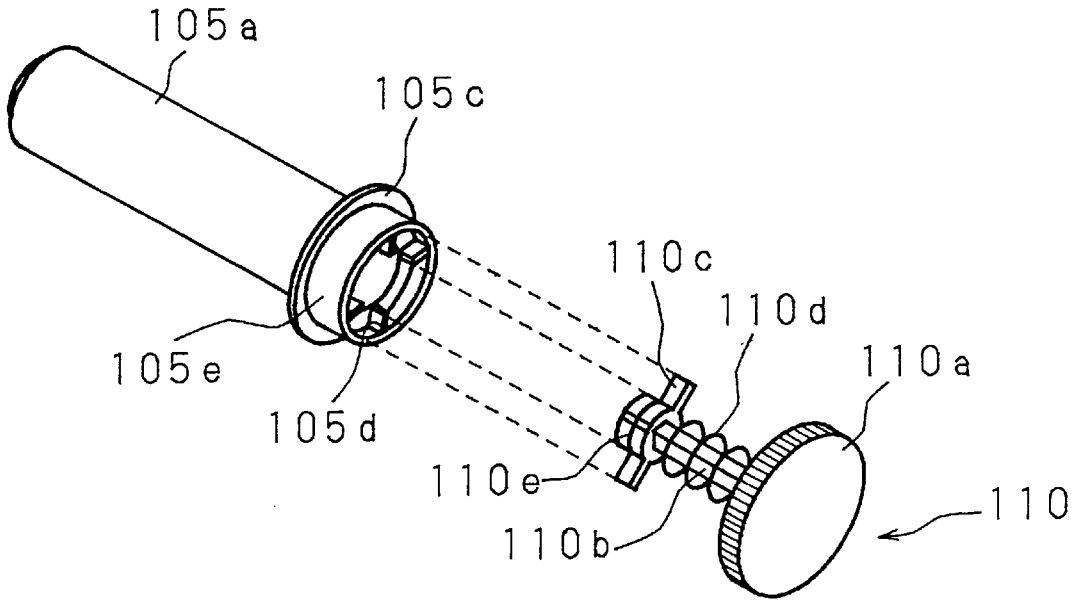
FIG. 70 is a perspective view showing the relation of bobbin and reel device in an ink sheet cassette.
Figure 71:
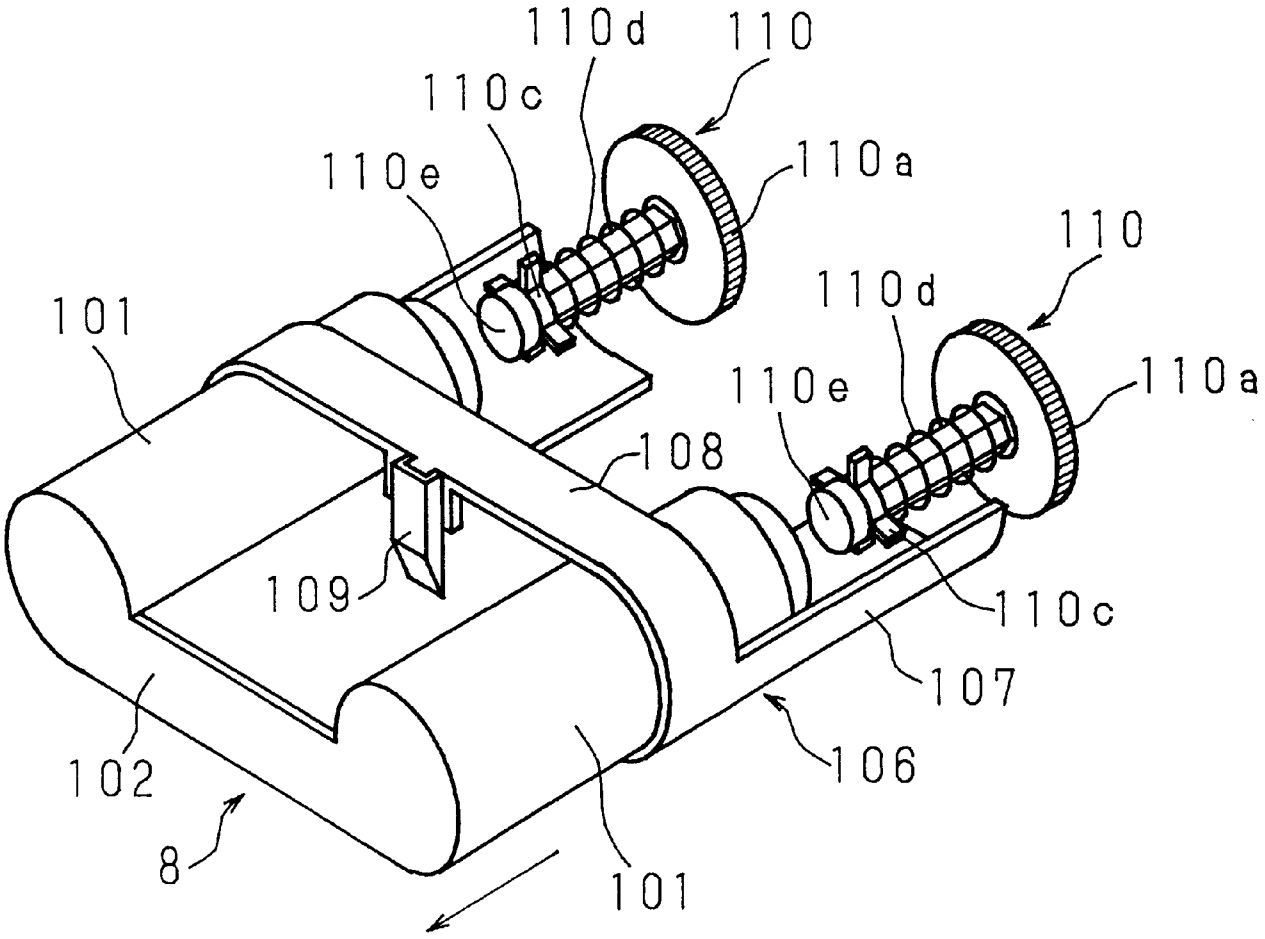
FIG. 71 is an explanatory view of an operation showing the relation of ink sheet cassette and cassette case.

FIG. 67 is a perspective view showing the state of mounting the ink sheet cassette 8 on a cassette case 106, FIG. 68 is a partial sectional view along line of VI—VI in FIG. 67, FIG. 69 is an exploded view, FIG. 70 is a perspective view showing the coupling state of the reel device and bobbin of the ink sheet cassette, and FIG. 71 is a perspective view of the state of dismounting the ink sheet cassette 8 from the case 106.

The ink sheet cassette 8 comprises, as shown in FIG. 69, cylindrical portions 101, 101 for incorporating a bobbin 105*a* containing an unused ink sheet S, and a bobbin 105*b* for taking up the used ink sheet S, which are coupled into one body by means of a coupling portion 102 having a communicating passage. The cassette case 106 is composed by integrally coupling with a coupling portion 108 cylindrical holding portions 107, 107 for holding the cylindrical portions 101, 101 of the ink sheet cassette 8, and the coupling portion 108 is provided with a stopper 109 for preventing the cassette 8 from slipping out so as to be movable in the vertical direction, or specifically between the detaching region of the ink sheet cassette 8 and the withdrawn position.

The ink sheet cassette 8, as shown in FIG. 69, contains bobbins 105*a*, 105*b* in its cylindrical portions 101, 101, and the ink sheet S is installed in the cassette case 106 as being put on the cylindrical portions 101, 101 through the passage of the coupling portion 102, and the front end portions of the bobbins 105*a*, 105*b* are coupled to the reel devices 110, 110 respectively as shown in FIG. 67.

The bobbins 105*a*, 105*b* are substantially identical in structure, and a practical structure of the bobbin 105*a* is shown in FIG. 70. A flange 105*c* is disposed on the outer circumference of the opening at one end of the bobbin 105*a*, and a guide tube 105*e* having inner blades 105*d* at plural positions in the inner circumference is provided in the opening.

The reel device 110 has a shaft 110*b* of polygonal column form in the middle of one side of the gear 110*a*, and a ring with blade 110*c* having a polygonal hole is fitted therein, and a coil spring 110*d* is intervening between the ring with blade 110*c* and gear 110*a*, and the ring with blade 110*c* is thrust toward the shaft end side. Numeral 110*e* is a stopper externally fixed to the shaft end portion. On the other hand, the gear 110*a* of the reel device 110 coupled with the bobbin 105*a* is engaged with a gear 111 fixed on the output shaft of a motor M14 as shown in FIG. 69.

Figure 72:
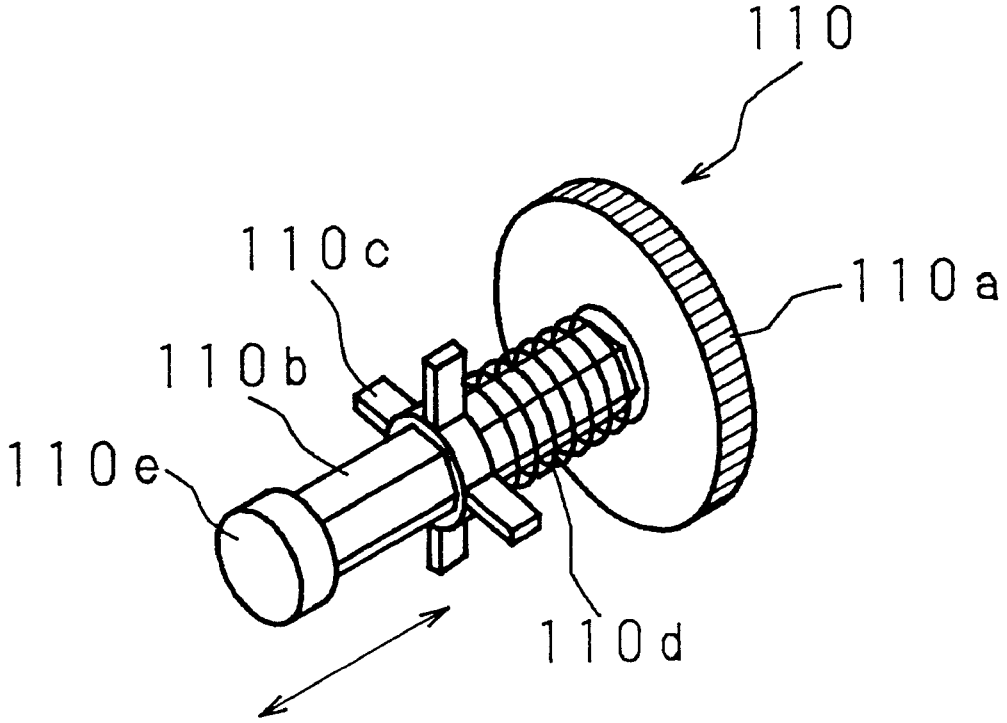
FIG. 72 is an explanatory view of an operation of the reel device.

The operation of such a cassette is explained together with the explanatory views in FIG. 71 and FIG. 72. The ink sheet cassette 8 is usually installed in the cassette case 107 as shown in FIG. 67 by against the dilating force of the coil spring 110*d* shown in FIG. 68 and a shaft 110*b* of the reel device 110 is inserted into the bobbins 105*a*, 105*b*, and the ring with blade 110*c* is engaged in the guide tube 105*e* of the bobbins 105*a*, 105*b* to be stopped together with the inner blade 105*d*, and when the motor M14 is rotated, the bobbin 105*b* is rotated through the gear 111 and gear 110*a*, so that the ink sheet S is moved from the bobbin 105*a* to 105*b*.

On the other hand, in the state shown in FIG. 67, when the stopper 109 is moved in the direction of arrow, the dilating force of the coil spring 110*d* of each reel device 110 thrust with dilating force in the state shown in FIG. 72 is released, and the ink sheet cassette 8 is pushed out in the arrow direction from the cassette case 106 as shown in FIG. 71, and at the same time coupling of ink sheet cassette 8 with reel device 110 is released.

Figure 18:
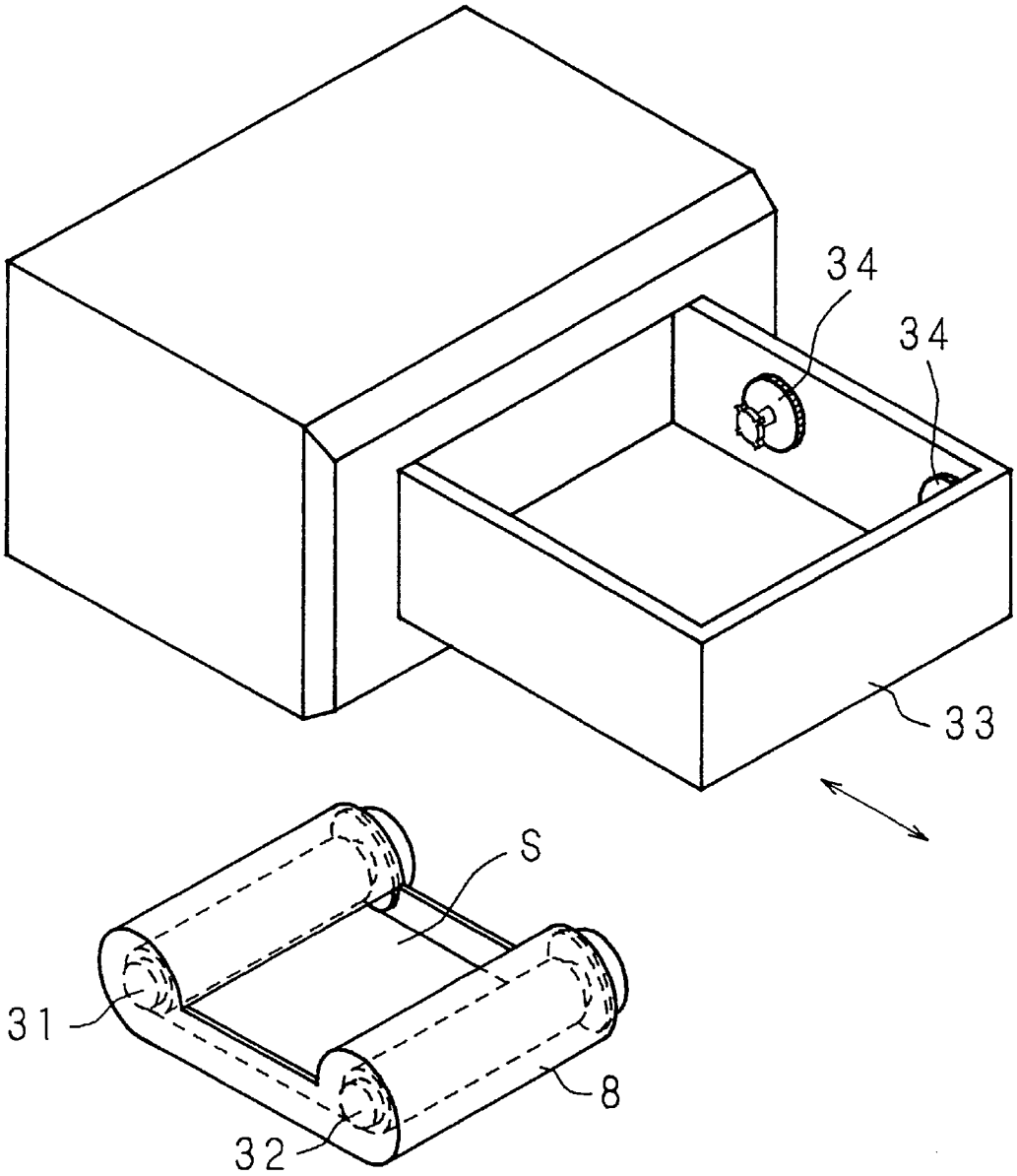
Fig. 18 Prior Art
FIG. 18 is a perspective view of an ink sheet cassette in a conventional printing apparatus.
Figure 19:
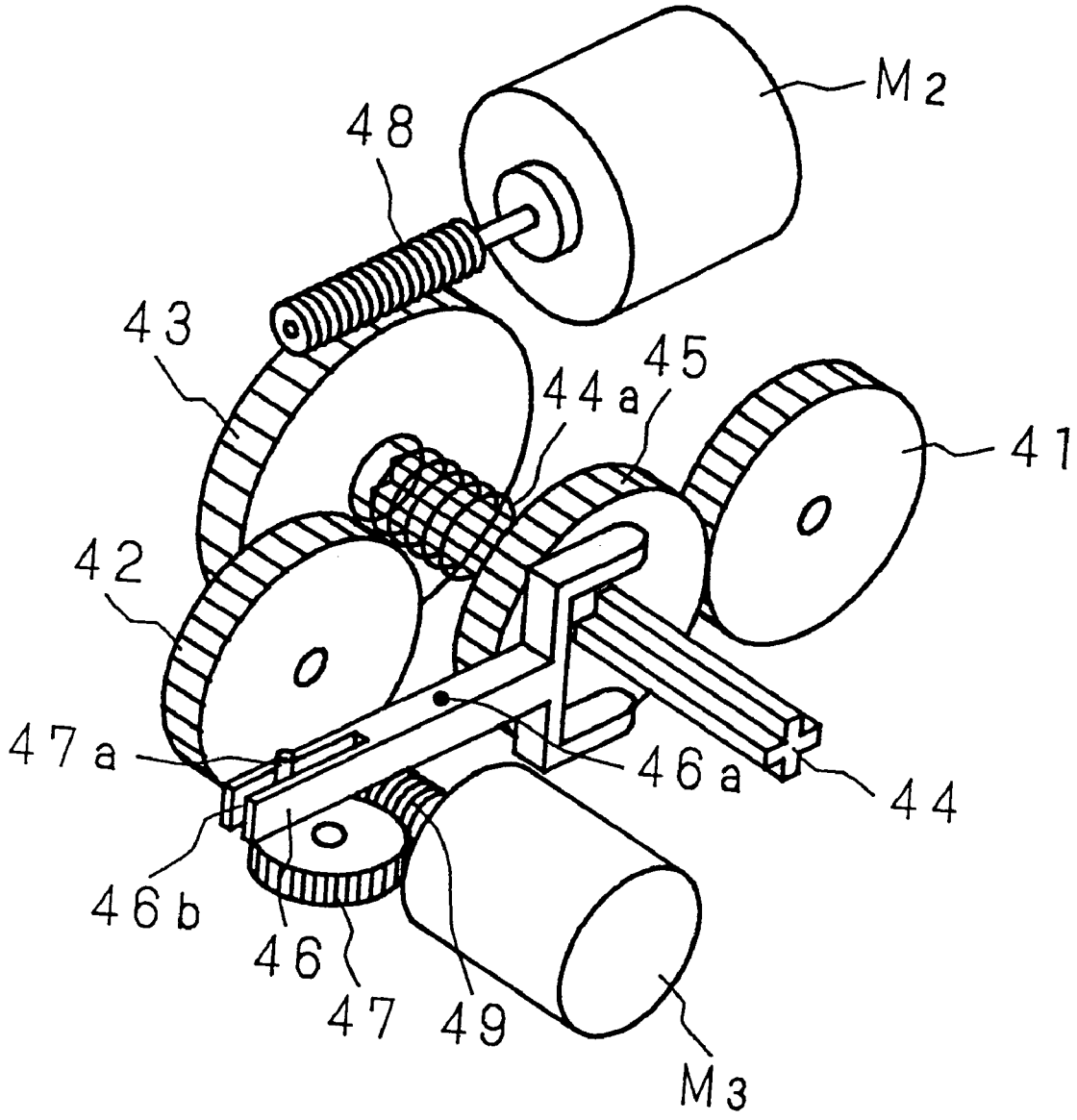
Fig. 19 Prior Art
FIG. 19 is a perspective view showing a drive system of reel device and discharge roller in a conventional printing apparatus.
Figure 20:
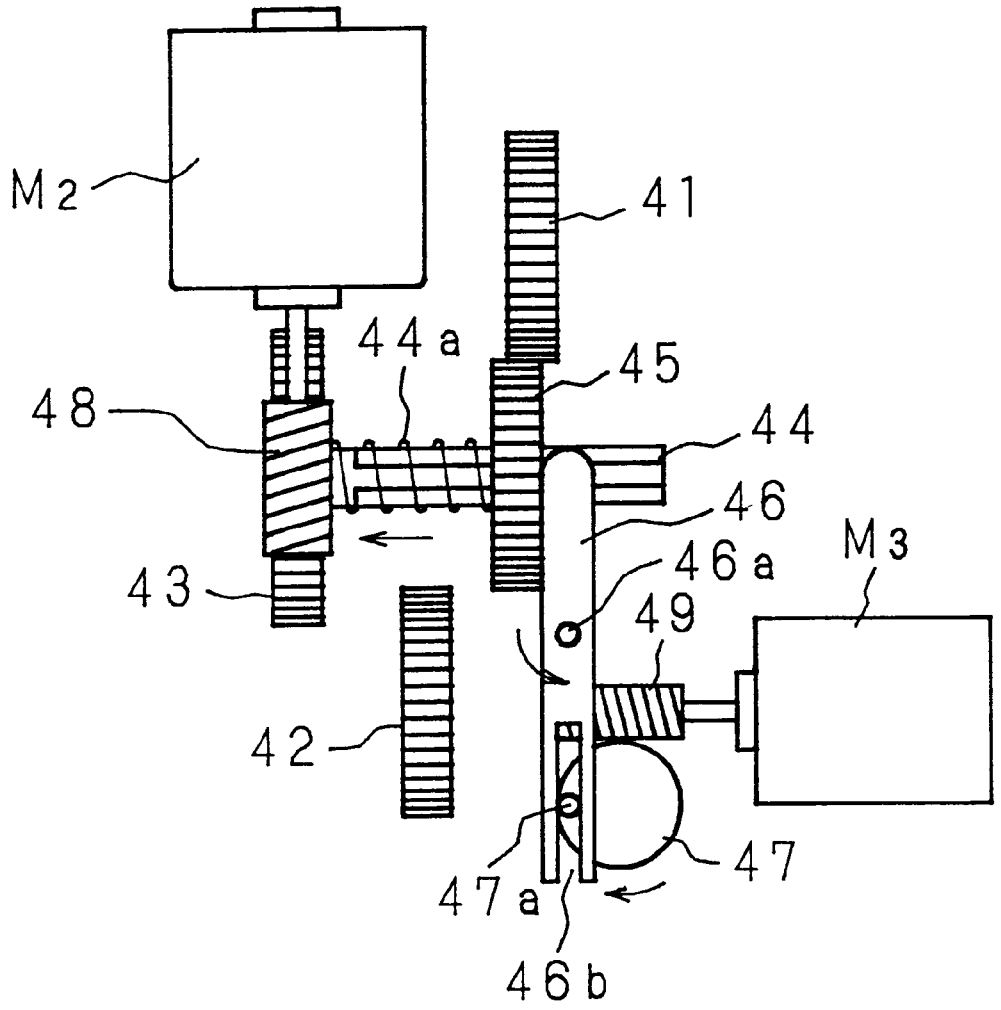
Fig. 20 Prior Art
FIG. 20 is an explanatory view of an operation of the drive system shown in FIG. 19.
Figure 21:
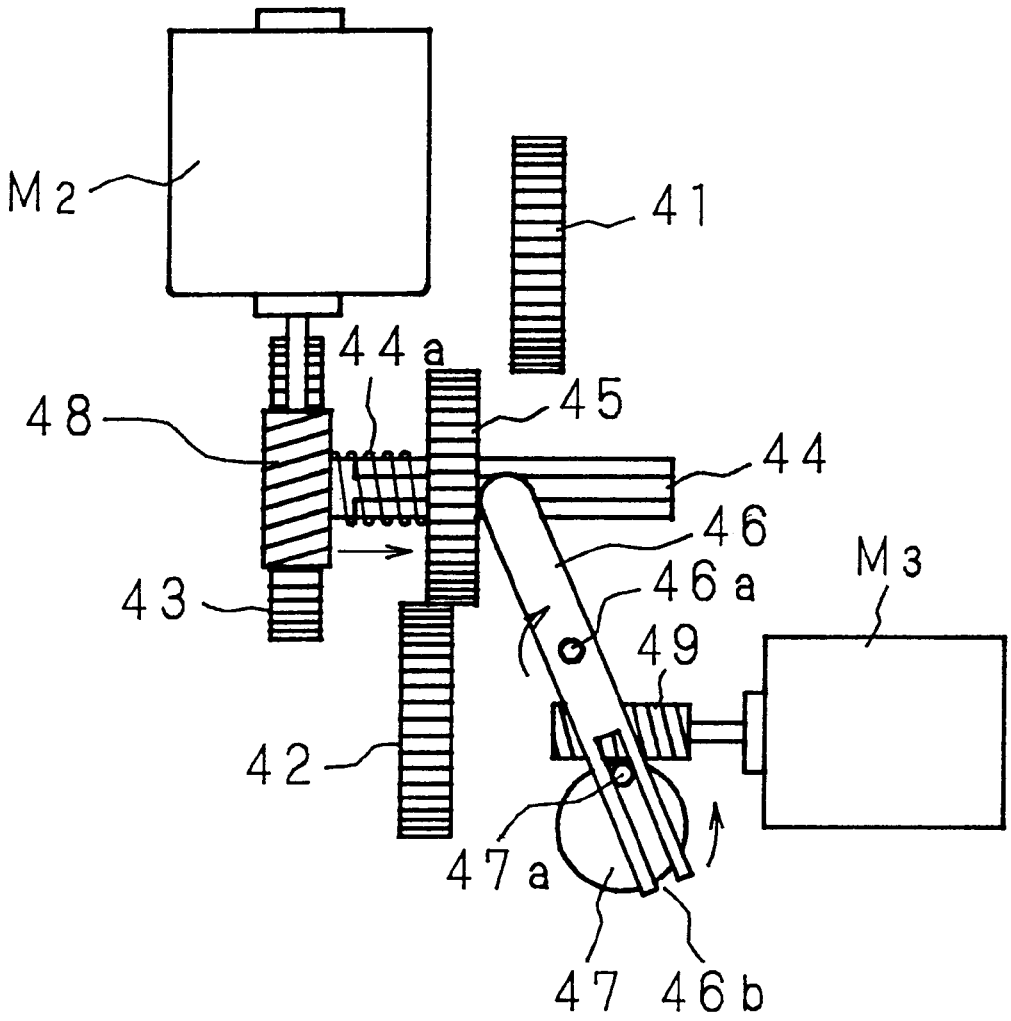
Fig. 21 Prior Art
FIG. 21 is an explanatory view of an operation of the drive system shown in FIG. 19.

In such an embodiment, only by moving the stopper 109 to the release position, the ink sheet cassette 8 may be easily taken out of the cassette case 106 by making use of the dilating force of the coil spring 110*d*, and the slide mechanism of the cassette storage magazine 33 and ink sheet cassette 8 as in the prior art shown in FIG. 18 is not needed, and the number of parts may be decreased.

Figure 73:
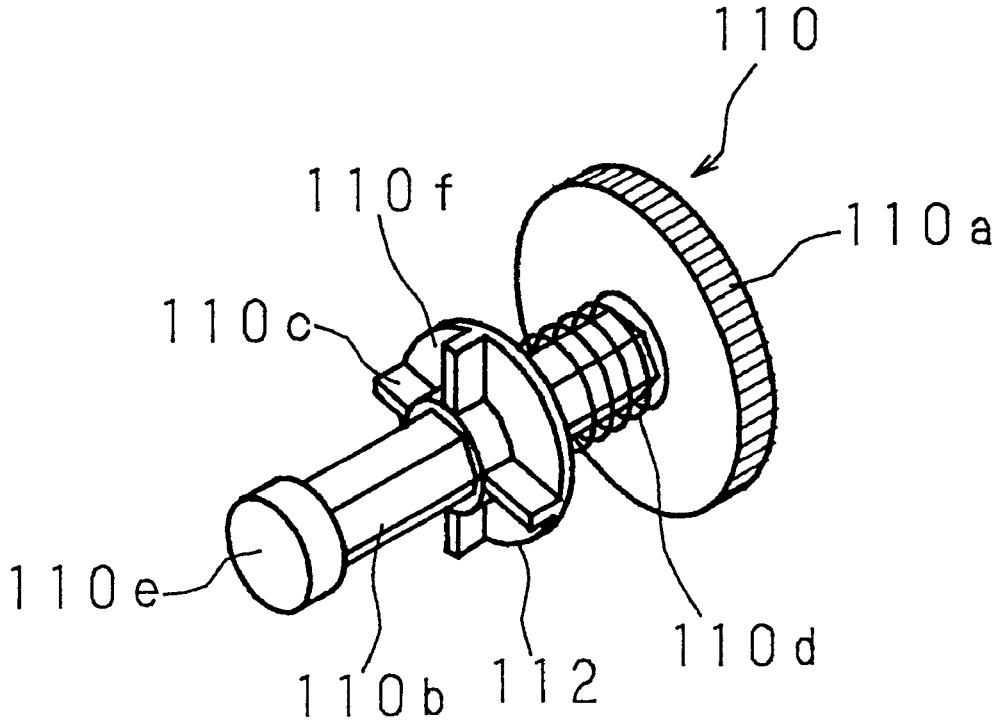
FIG. 73 is a perspective view showing other example of reel device.

FIG. 73 is a perspective view showing other example of the reel device, in which, instead of the ring with blade 110*c* in FIG. 72, a ring with blade 112 having a base portion 110*f* is used in a state of integrally coupling portions between the blades at one end of the gear 110*a* side.

The other constitution is same as in FIG. 72, and corresponding parts are identified with same reference numbers, and explanations are omitted.

In such a constitution, the contact area of the reel device 110 and each bobbin increases, and the dilating force of the coil spring 110*d* is uniformly transmitted to all bobbins, so that the ink sheet cassette 8 may be pushed out securely.

Figure 74:
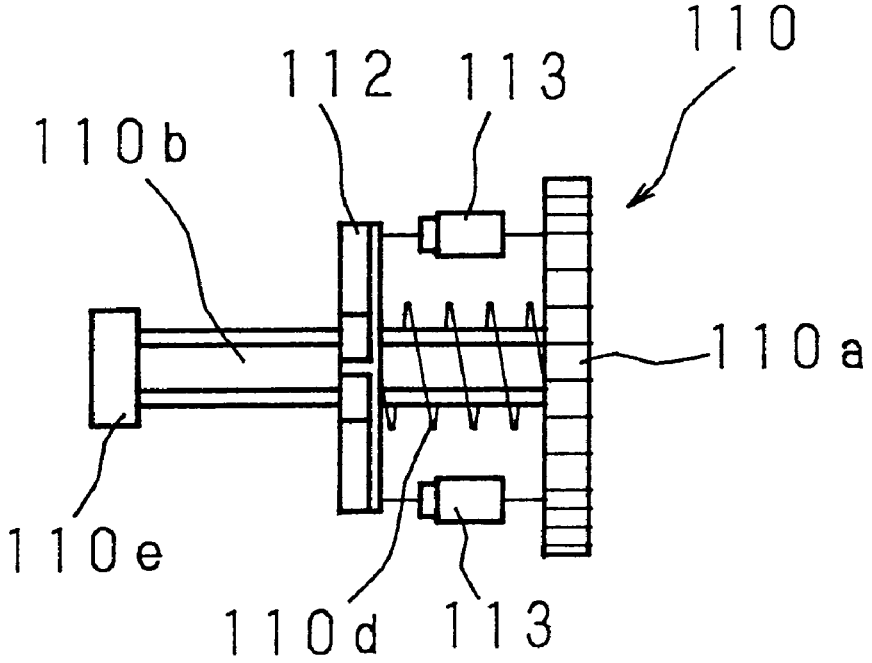
FIG. 74 is a side view showing a different example of reel device.

FIG. 74 is a side view showing a different embodiment of the reel device, in which plural dampers 113 are installed between gear 110*a* and ring 112 with blade of the same structure as shown in FIG. 73.

In this constitution, the dilating force of the coil spring 110*d* is relaxed and transmitted to the ring 112 with blade, and the ink sheet cassette 8 is moderately pushed out from the cassette case 106.

The other constitution and operation are substantially same as the embodiment shown in FIG. 73, and corresponding parts are identified with same reference numbers, and explanations are omitted.

Ink Sheet Head Detecting Sensor

Figure 75:
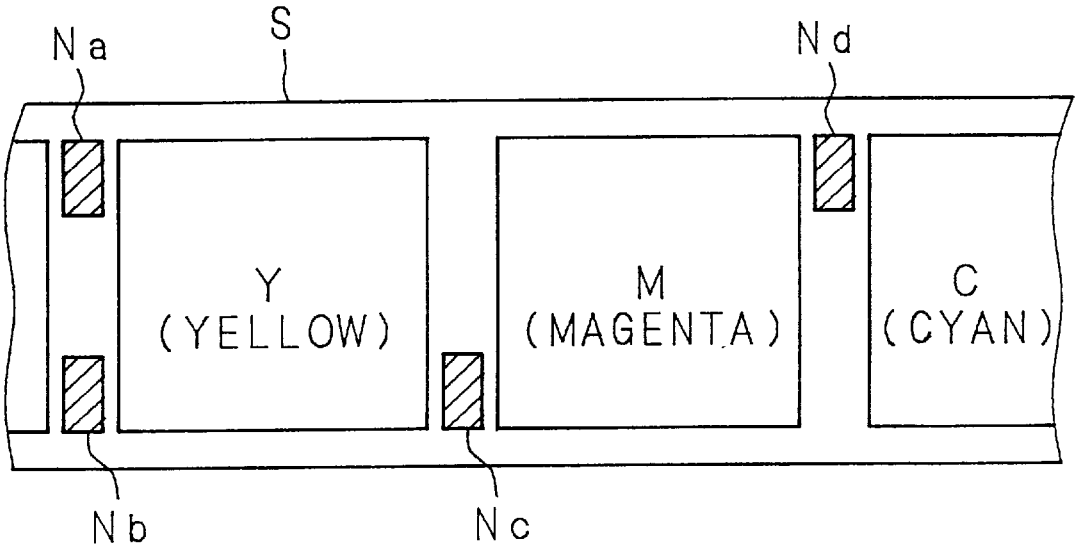
FIG. 75 is a schematic plan view of an ink sheet.

FIG. 75 is a schematic plan view of ink sheet S. The ink sheet S has leader marks Na, Nb, Nc, Nd at the beginning of each color region of Y, M, C, that is, at the moving direction side, as shown in FIG. 75. For example, when detecting the beginning of the yellow region Y, the ink sheet S is stopped at the position where the marks Na and Nb are simultaneously detected by the head detecting sensors SE1, SE1 (see FIG. 23). To detect the beginning of the magenta region M, the mark Nc is detected by one sensor SE1, and for the cyan region C, the mark Nd is detected by one sensor SE1, so that each color region of the ink sheet S is detected Thus, as each of said sensors SE, has only two detection states, the marks Na–Nd form a kind of binary code.

Figure 8:
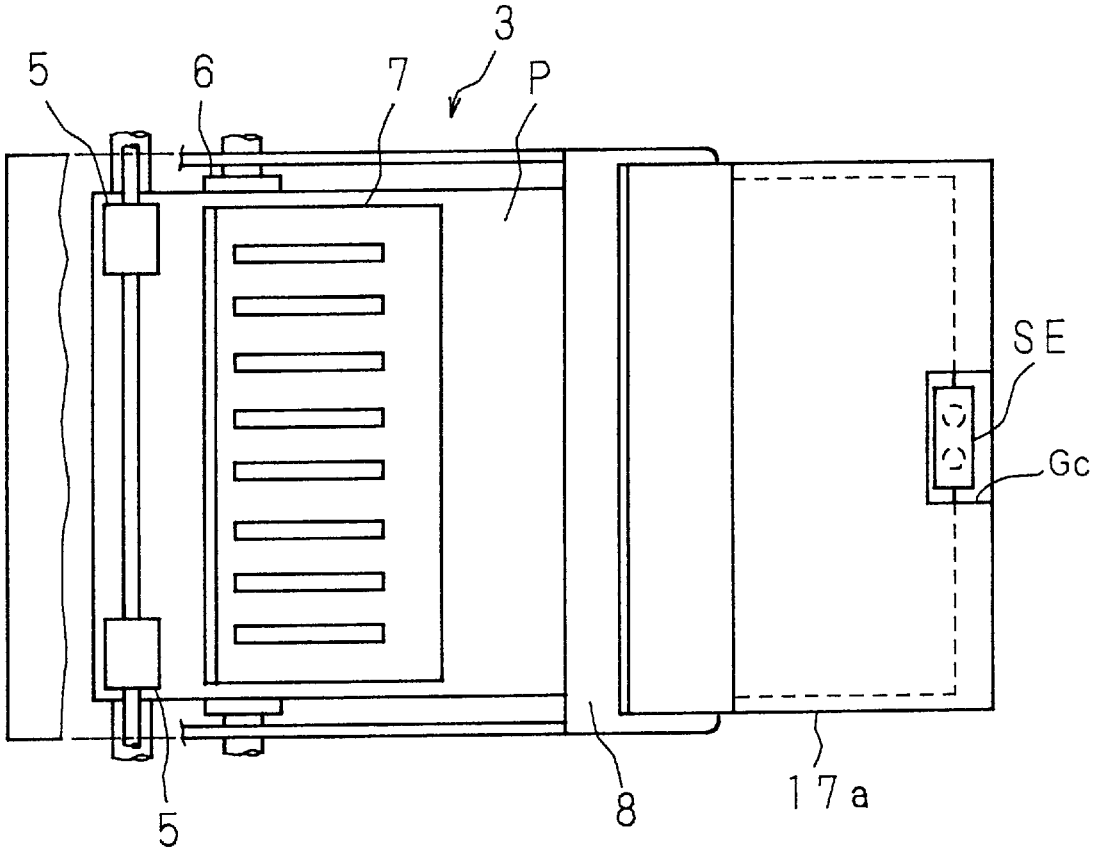
Fig. 8 Prior Art
FIG. 8 is a schematic plan view showing a positioning sensor for printing paper in a conventional printing apparatus.
Figure 76:
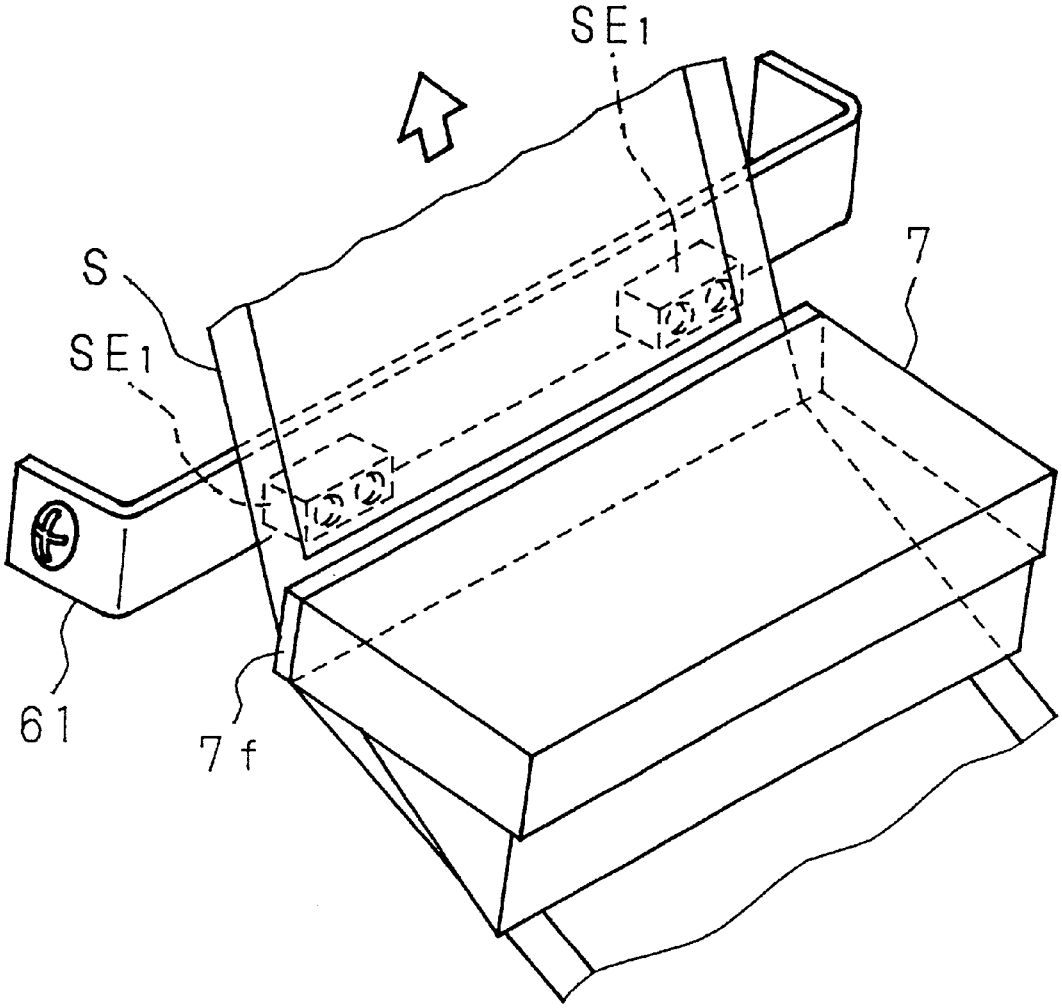
FIG. 76 is a perspective view showing a mounting state of a head detecting sensor of an ink sheet.
Figure 77:
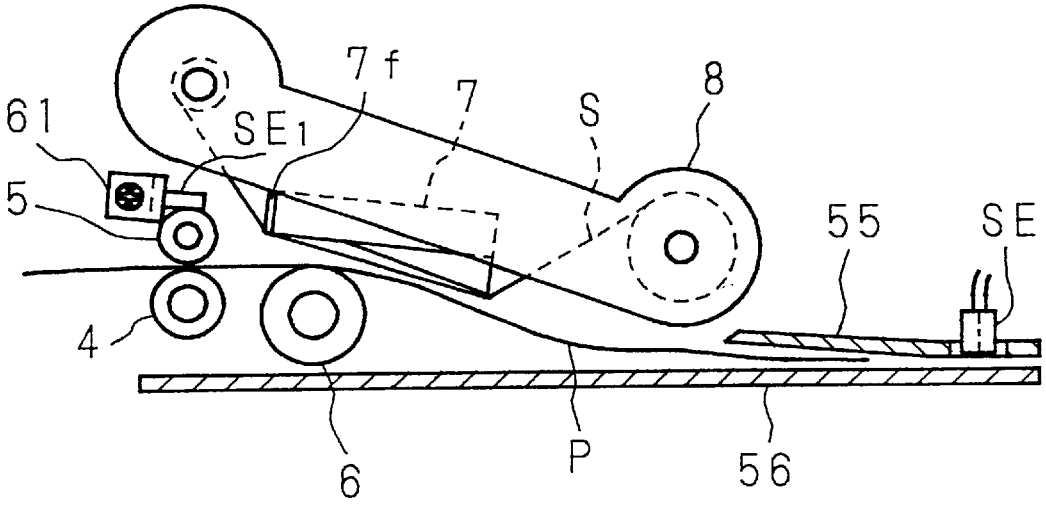
FIG. 77 is its schematic side view, FIGS. 78(*a*)–(*b*) are explanatory views of an operation showing the head detecting operation of the ink sheet.

FIG. 76 is a perspective view showing a case of applying the ink sheet detecting sensor to the conventional apparatus shown in FIG. 8 and FIG. 9, and FIG. 77 is its side view. As the head detecting sensor SE1 for ink sheet S, the reflection type sensor is disposed at the stay 61, so that it is less affected by the heat of the thermal head 7.

A pair of detecting sensors SE1, SE1 are installed at a predetermined interval on a stay 61 so as to confront with a reflector 7*f* disposed on the front surface of the thermal head 7 at the waiting position above the platen roller 6. The lower end edge of the reflector 7*f* has the front end formed in a curvature so as to serve also as the guide of the ink sheet S.

Figure 78A:
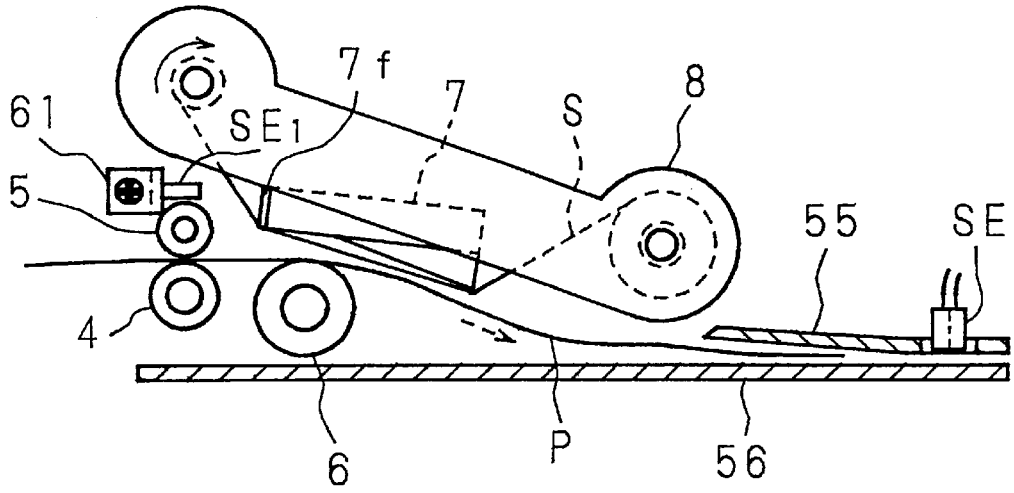
Figure 78B:
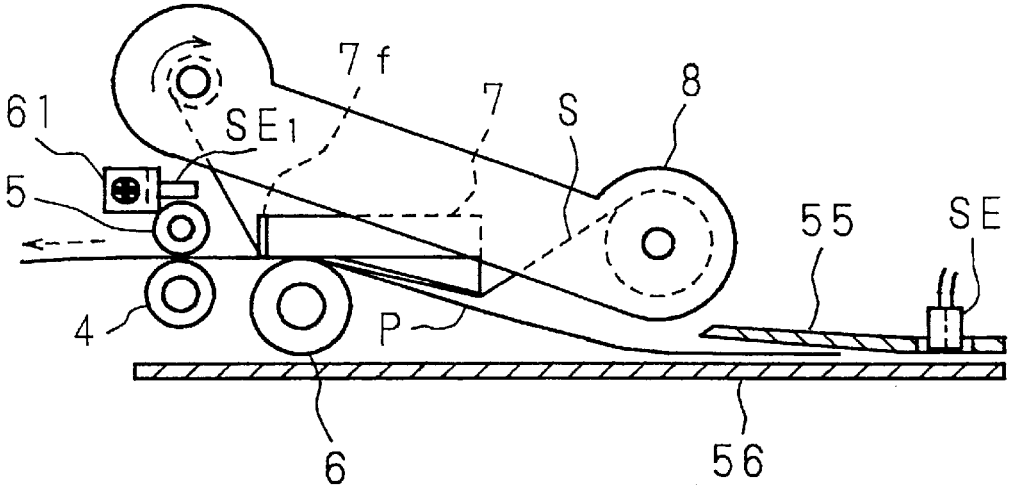

The head detecting motion of ink sheet S is explained by reference to the explanatory view of operation shown in FIG. 78. FIG. 78(*a*) shows the head detecting state of the printing paper P and ink sheet S, in which the printing paper P is conveyed from the arrow direction by the pinch roller 5 and capstan roller 4, and it stops at the position where the front end thereof is detected by the sensor SE, and the leader is pulled out.

On the other hand, the thermal head 7 is lowered until its reflector 7*f* confronts the sensors SE1, SE1, and in the process of the ink sheet S being taken up in the arrow direction, when the marks Na and Nb shown in FIG. 75 are detected, the movement of the ink sheet S stops, and the yellow region Y is led out.

FIG. 78 (*b*) shows the printing state, in which the thermal head 7 descends to press the ink sheet S to the printing paper P, and the printing paper P is conveyed in the arrow direction by the pinch roller 5 and capstan roller 4, and the thermal head 7 is heated to make printing.

In such a constitution, the detecting sensors SE1, SE1 confront the reflector 7*f* when the thermal head 7 comes to the head position of the ink sheet S, and therefore the time exposed to the heat effect of the thermal head 7 is short, so that its function may not be sacrificed.

Constitution of Discharge Roller

Figure 79:
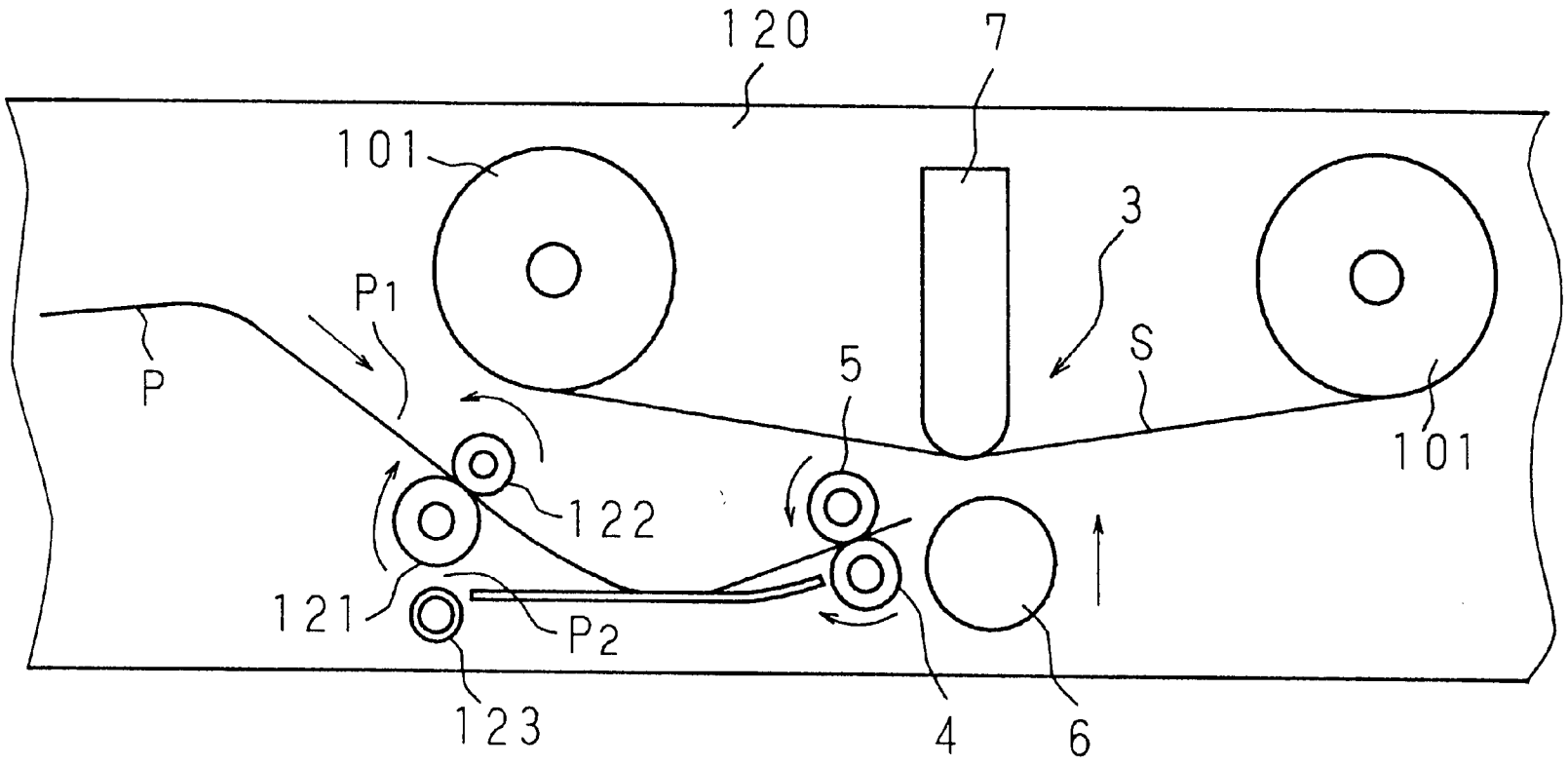
FIG. 79 is a schematic side view showing other example of discharge roller.
Figure 80:
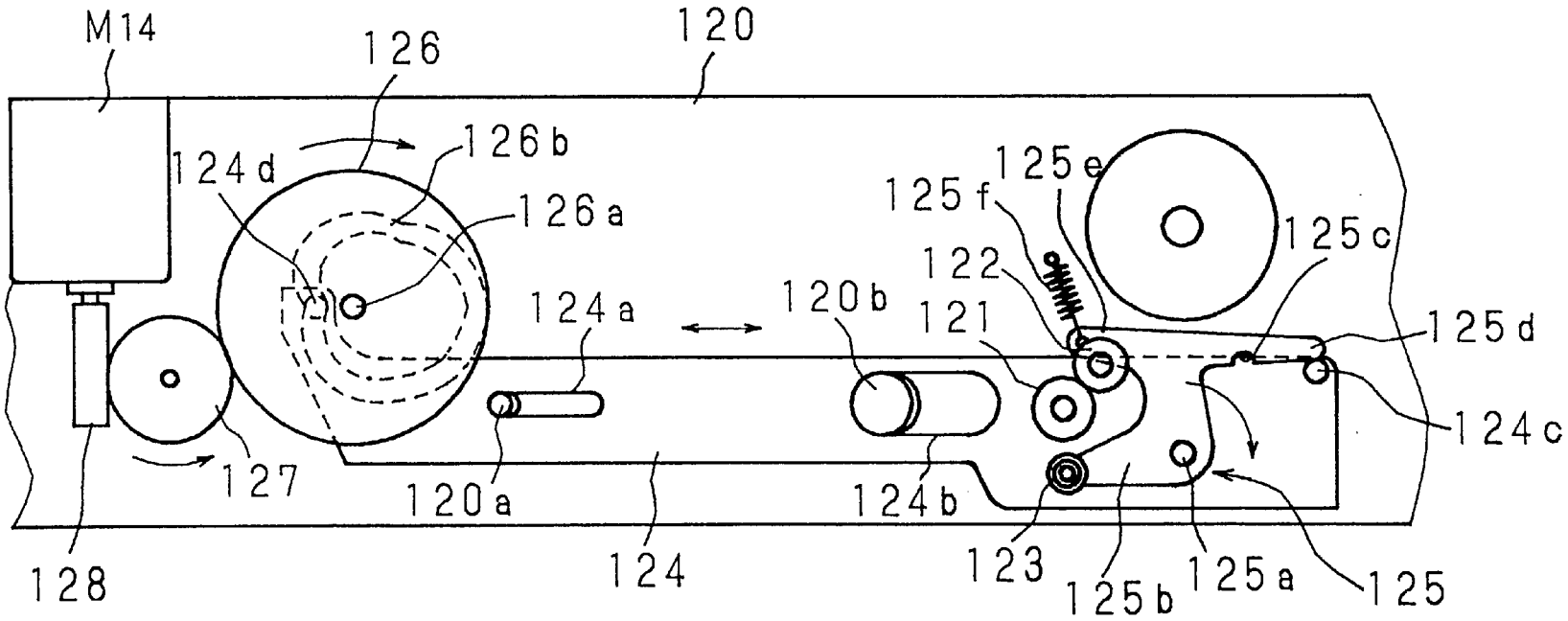
FIG. 80 is a schematic side view showing a drive system of discharge roller.

FIG. 79 is a schematic side view showing other constitution of a paper discharge roller in a printing apparatus of the invention, and FIG. 80 is a schematic side view showing the drive system in the state shown in FIG. 79. In this embodiment, instead of the discharge roller 10 shown in FIG. 24, a supply discharge roller 121 is used as the drive roller serving both supplying and discharging, and as the driven rollers to roll thereon, pinch rollers 122, 123 are disposed.

The supply discharge roller 121 is located between conveying paths P1, P2 near the junction point of the conveying path P1 for paper supplying and conveying path P2, and the pinch roller 122 is disposed to roll on the supply discharge roller 121 across the conveying path P1, and the pinch roller 123 is disposed to contact with and depart from the supply discharge roller 121 across the conveying path P2.

In FIG. 80, a rotary lever 125 which supports the supply discharge roller 121, pinch roller 122, and pinch roller 123 is directly pivoted on a frame 120 or on a support frame not shown through a shaft 125*a* in a state of not interfering with an sliding lever 124. The sliding lever 124 is formed like a rod, and in the middle of the longitudinal direction, slots 124*a*, 124*b* extending in the longitudinal direction are engaged with guide pins 120*a*, 120*b* projecting to the side face of the frame 120 so as to be movable reciprocally in the lateral direction, and at one end thereof a pin 124*c* is provided to contact with a stopping piece 125*d* of a rotary lever 125, while a pin 124*d* engaged with a cam groove 126*b* of a cam gear 126 is provided at the other end side.

The rotary lever 125 has at its support piece 125*b* pivoting with the pinch roller 123, and a stopping piece 125*d* having an engaging recess 125*c* abuts against a pin 124*c* projecting from the sliding lever 124, and furthermore the stopping piece 125*e* is linked with the frame 120 through a tension spring 125*f*, and it is always thrust and held in the arrow direction by the tension spring 125*f*. A cam gear 126 is pivoted on the frame 120 through a shaft 126*a*, and is engaged and linked with a worm gear 128 of a motor M14 through a worm wheel 127.

On the side surface of the cam gear 126, a groove 126*b* is formed, and a pin 124*d* projecting from the sliding lever 124 is inserted into this groove 126*b*, and the sliding lever 124 is moved reciprocally in the arrow direction by the rotary shaft of the motor M14.

Figure 81:
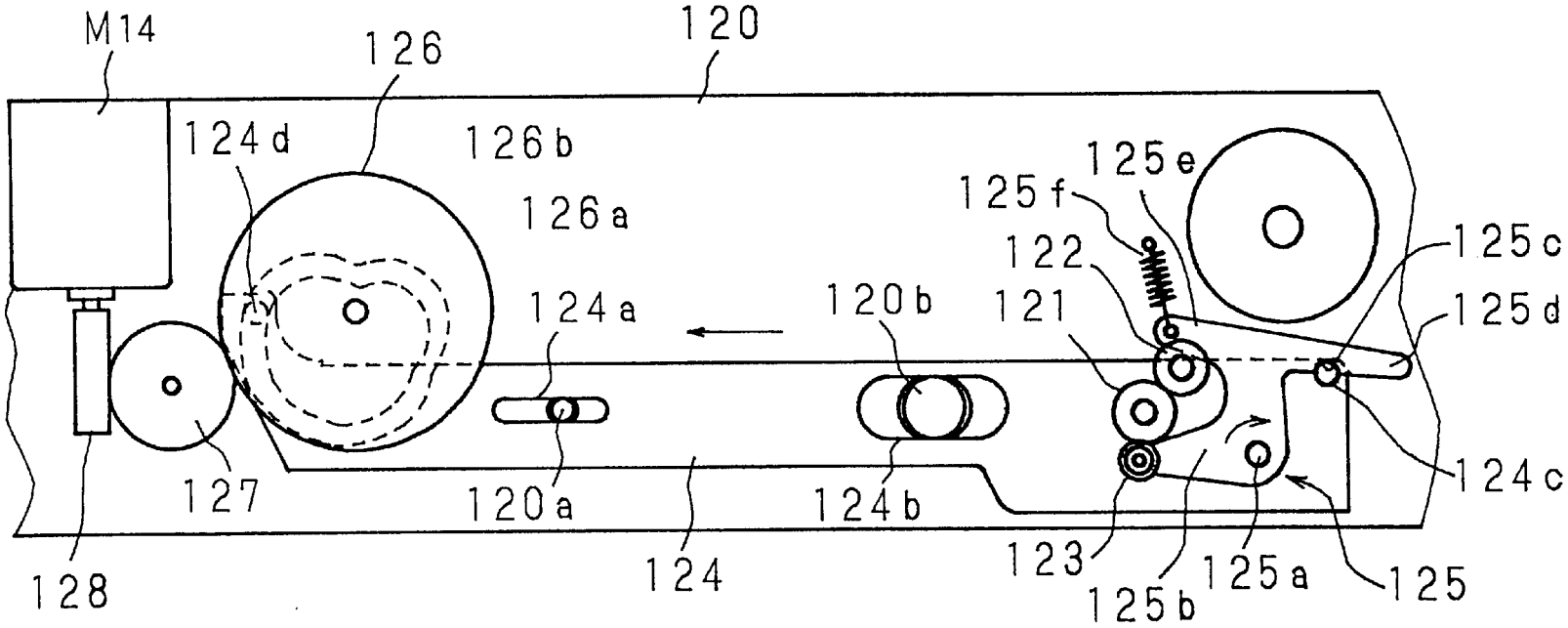
FIG. 81 is an explanatory view of an operation of the drive system shown in FIG. 80.

FIG. 81 is an explanatory view of operation of the drive system shown in FIG. 80, in which both pinch rollers 122, 123 are rolling on the supply discharge roller 121. That is, in FIG. 80, when the motor M14 is driven and the cam gear 126 is rotated in the arrow direction, the pin 124*d* engaged in the groove 126*b* is moved away from the center of rotation of the cam gear 126, and the sliding lever 124 is moved in the direction of arrow in FIG. 81, and the pin 124*c* abutting against the stopping piece 125*d* of the rotary lever 125 is engaged with the engaging recess 125*c*. As a result, the rotary lever 125 thrust by the tension spring 125*f* is rotated in the direction of arrow, so that the pinch roller 123 rolls on the supply discharge roller 121.

Figure 82:
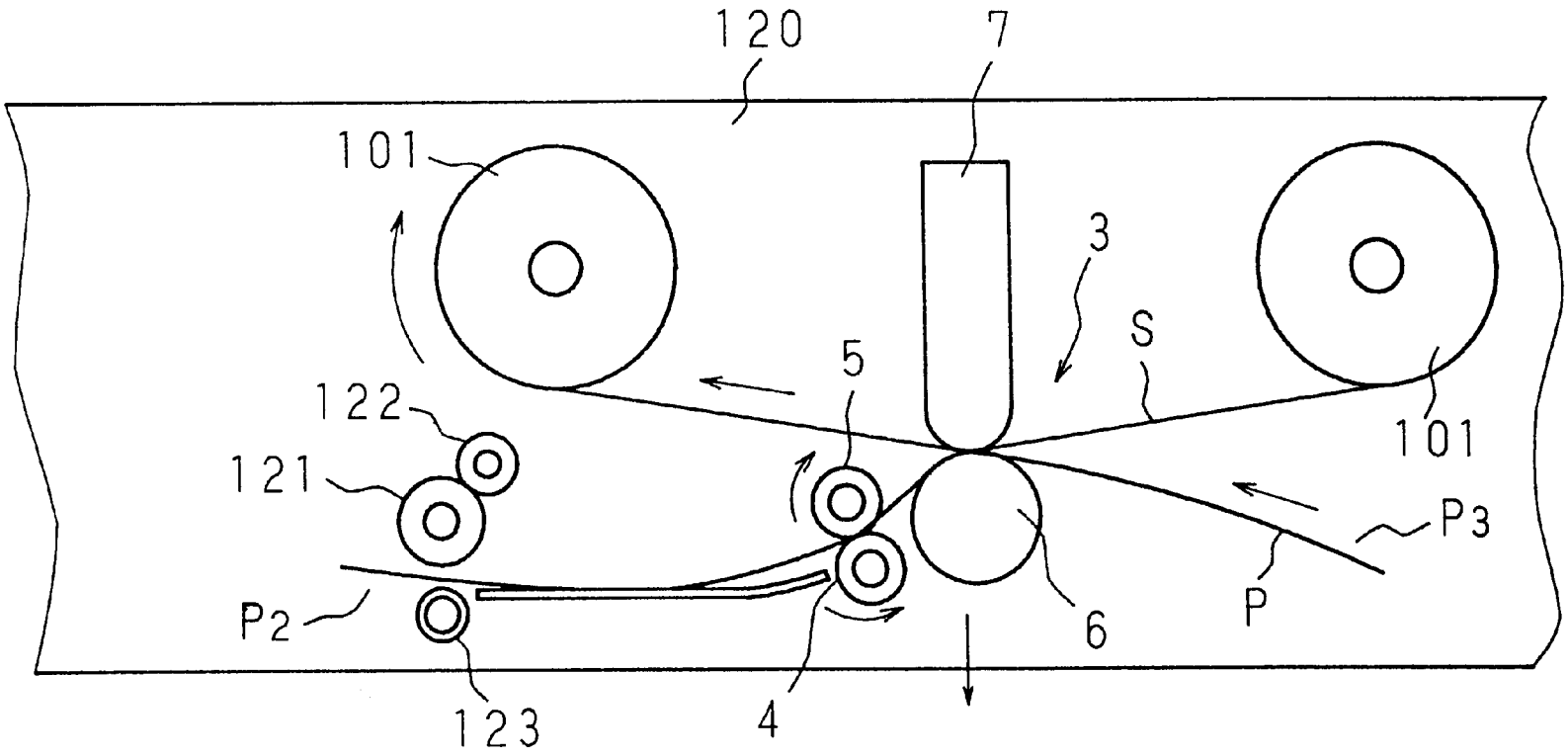
FIG. 82 is an explanatory view of an operation of supplying and discharge roller shown in FIG. 79.
Figure 83:
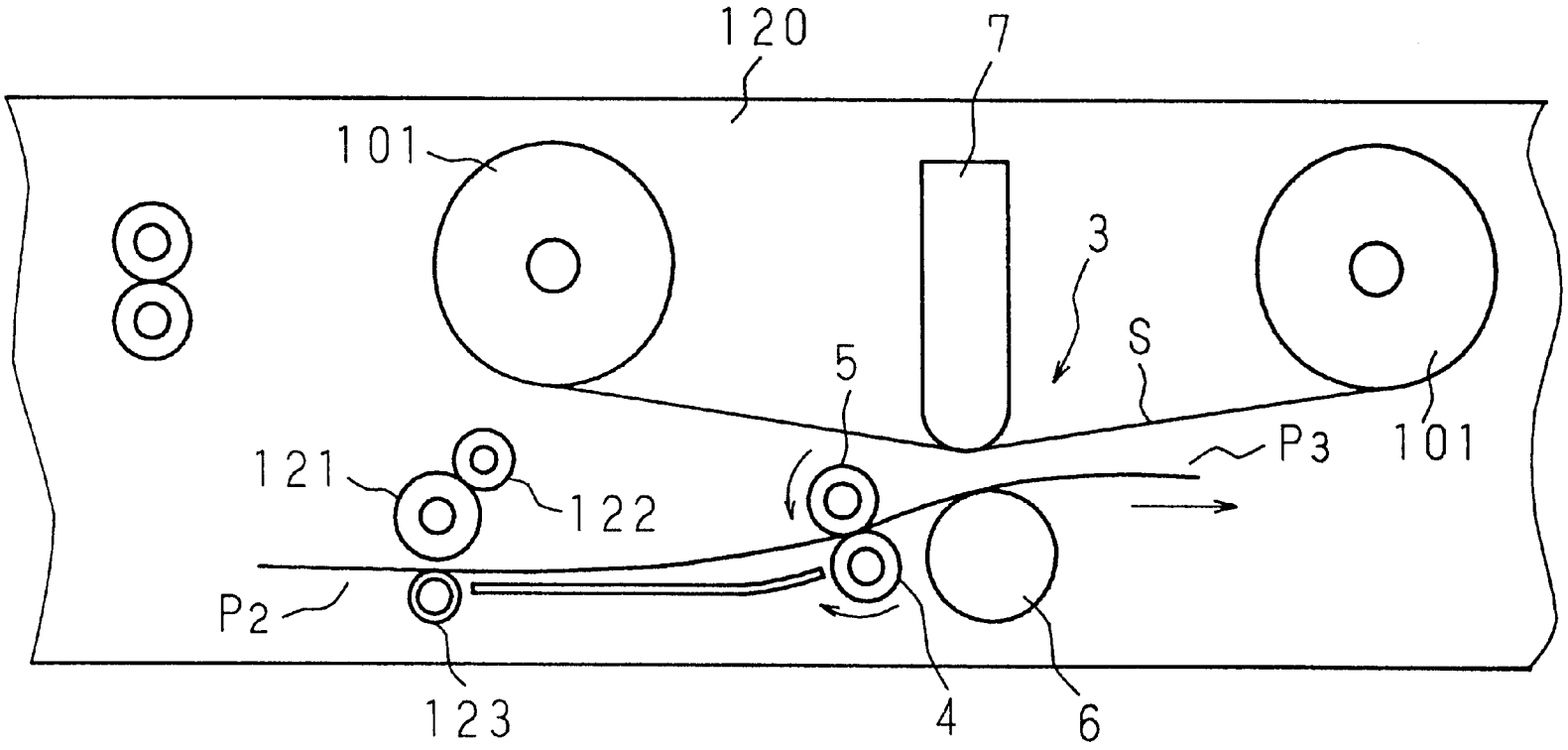
FIG. 83 is its explanatory view of operation.
Figure 84:
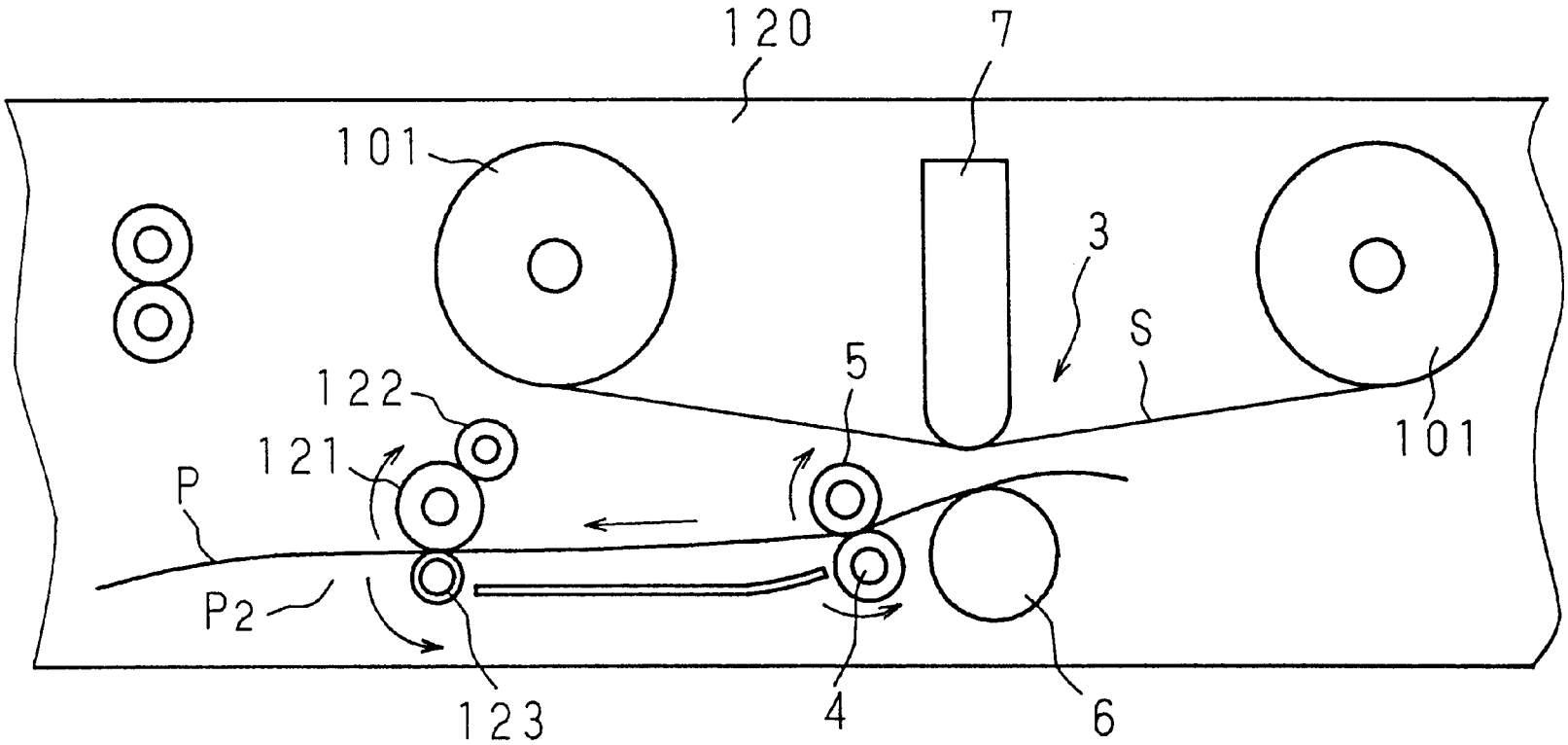
FIG. 84 is its explanatory view of operation.

The operation of such supply discharge roller 121 and pinch rollers 122, 123 is explained together with the explanatory views of operation shown in FIG. 82 to FIG. 84.

FIG. 79, FIG. 80 show the state of paper supply in which the supply discharge roller 121 and supply pinch roller 122 are rotated in the direction of arrow respectively, and the printing paper P is conveyed from the paper supply unit 1 to the printing unit 3 side in the arrow direction. At this time, the capstan roller 4 and pinch roller 5 are rotating respectively in each arrow direction, and the printing paper P is conveyed into the conveying path P3 through the portion between the platen roller 6 and thermal head 7 by the capstan roller 4 and pinch roller 5. When the rear end of the printing paper P reaches the specified position and is detected, the rotations of the supply discharge roller 121 and capstan roller 4 stop temporarily, and the platen roller 6 moves upward, and the printing paper P is pressed against the thermal head 7 through the intervening ink sheet S as shown in FIG. 82.

At the position contacting with the printing paper P, the head of yellow region Y of the ink sheet S is detected, and the thermal head 7 is heated and the yellow ink is transferred on the printing paper P to record the yellow image, while the printing paper P is conveyed to the conveying path P2 side. When recording of the yellow image is over, after the capstan roller 4 stops temporarily, the platen roller 6 descends in the arrow direction and is departed from the thermal head 7, and, as shown in FIG. 83, the capstan roller 4 and pinch roller 5 are rotated and driven in the arrow direction, and the head of printing paper P is returned to the beginning position. At the same time, the ink sheet S is forwarded to search the head of next magenta region M.

When the printing paper P returns to the head position again, the capstan roller 4 stops rotating temporarily, and the platen roller 6 goes up again in the arrow direction, and the printing paper P is pressed against the thermal head 7 through the ink sheet S, and the magenta image is recorded over the already recorded yellow image. When the recording of magenta image is over, the cyan image is similarly recorded, and color printing is over.

When color printing is over, as shown in FIG. 81 and FIG. 84, the pinch roller 123 is pressed against the supply discharge roller 121, and the printing paper P is discharged toward the discharge unit 2.

In such an embodiment, the printing paper P is fed by the supply discharge roller 121 and pinch roller 122 for supplying paper which is always pressed thereto, working in pair, when the pinch roller 123 is pressed against the supply discharge roller 121, they work as a pair to discharge printing paper P, so that one supply discharge roller 121 may be used for both supplying and discharging paper, and the number of rollers required for supplying and discharging the printing paper P may be reduced, while the driving force transmitting mechanism may be simplified, and the number of parts decreases.

Practical Constitution of Discharge Unit

Figure 85:
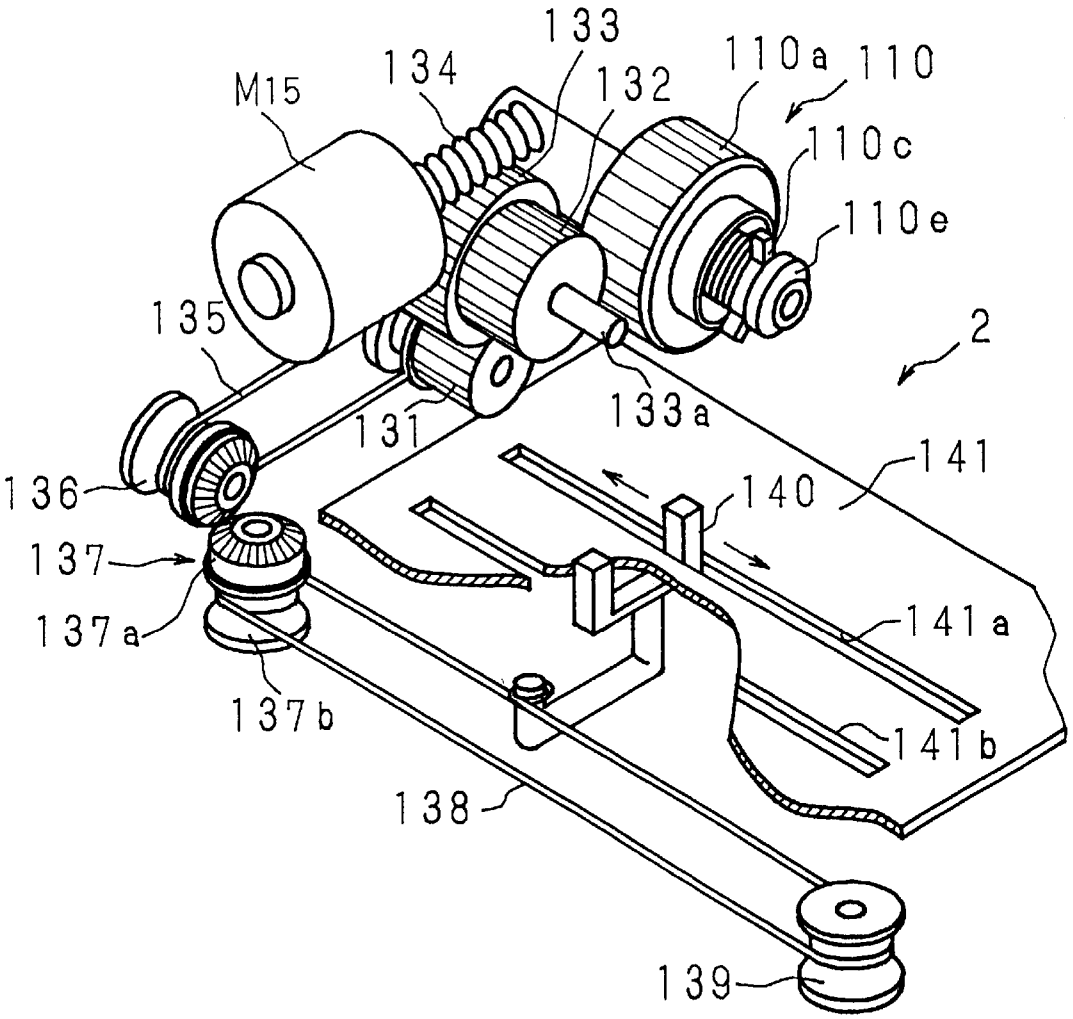
FIG. 85 is a perspective view showing a paper discharge unit and its drive system in a printing apparatus of the invention, FIGS. 86(*a*)–(*c*) are exploded perspective views of a one-way clutch and its explanatory view of operation, FIGS. 87(*a*), (*b*) are explanatory views of an operation of a torque limiter.

FIG. 85 is a perspective view showing the drive system in the discharge unit 2, in which a reel device 110 linking with the ink sheet cassette and discharge unit 2 of printing paper P which has finished printing are driven by one motor M15. At a predetermined interval from the gear 110*a* installed in the reel device 110 shown in FIG. 67 and FIG. 68, a pulley integrated gear 131 and gear 132 with one-way clutch function are provided. The gear 110*a*, pulley integrated gear 131, and gear 132 composing one-way clutch are disposed with their axial center lines mutually directed parallel to each other, and the pulley integrated gear 131 and gear 132 are engaged with a worm wheel 133 disposed coaxially, and the gear 110*a* with a gear 132, respectively.

Figure 86A:
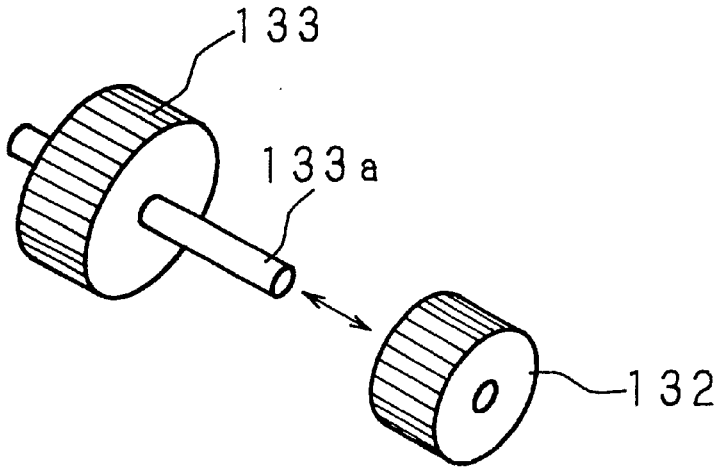
Figure 86B:
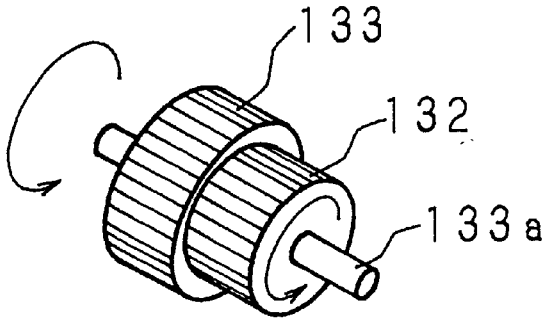
Figure 86C:
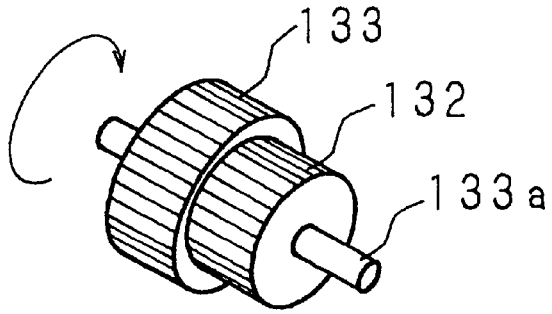

FIG. 86 is an exploded perspective view and explanatory view of operation of one-way clutch. The gear 132 composing the one-way clutch is fitted to slide in the axial length direction on a shaft 133*a* of the worm wheel 133 as shown in FIG. 86(*a*), and as shown in FIG. 86(*b*) the torque of the worm wheel 133 is transmitted to the gear 132 through the shaft 133*a* when the worm wheel 133 rotates about the shaft 133*a* in the direction of arrow, and the gear 132 also rotates together in the arrow direction, and on the other hand, as shown in FIG. 86(*c*), when the worm wheel 133 rotates in the arrow direction, if the gear 132 is loaded, the shaft 133*a* and gear 132 idle, and the torque of the worm wheel 133 is not transmitted to the gear 132.

Therefore, the pulley integrated gear 131 is rotated together with the motor M15 even when the motor M15 rotates in any direction, but when the reel device 110 is rotated together with the motor M15 when the motor M15 runs in one direction, but is not rotated when the motor M15 runs in the opposite direction.

Therefore, the pulley of the pulley integrated type gear 131 is linked with the pulley of the pulley integrated bevel gear 136 through the rubber belt 135, and this pulley integrated bevel gear 136 is engaged with the bevel gear 137*a* which composes a torque limiter 137. The torque limiter 137 has a bevel gear 137*a* and pulley 137*b* disposed coaxially, and as shown in FIG. 87(*a*), while the bevel gear 137*a* is rotating in the arrow direction, unless the pulley 137*b* is loaded as specified, the torque of the bevel gear 137*a* is transmitted to the pulley 137*b*, so that the pulley 137*b* also rotates together in the arrow direction.

Figure 87A:
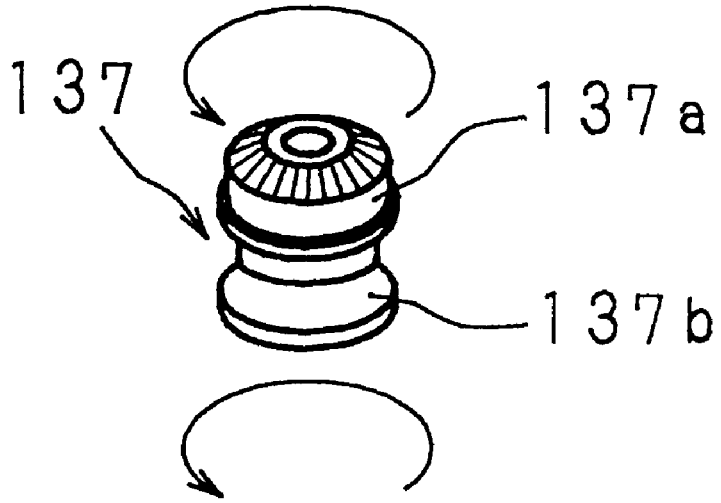
Figure 87B:
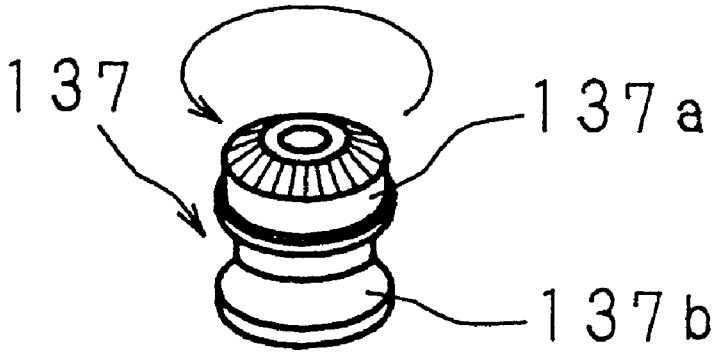

On the other hand, as shown in FIG. 87(*b*), when the pulley 137*b* is loaded more than specified, slipping occurs between the bevel gear 137*a* and pulley 137*b*, and the torque of the bevel gear 137*a* is not transmitted to the pulley 137*b*. The pulley 137*b*, as clear from FIG. 85, is linked to a pulley 139 through a rubber belt 138 on which a discharge lever 140 is mounted on the way. The front end portion of the discharge lever 140 is formed like a fork, and this front end portion is projecting upward from beneath the paper guide plate 141 through the guide grooves 141*a*, 141*b*, and by the rotation of the rubber belt 138, the discharge lever 140 is designed to move reciprocally in the arrow direction along the guide grooves 141*a*, 141*b*.

Figure 88:
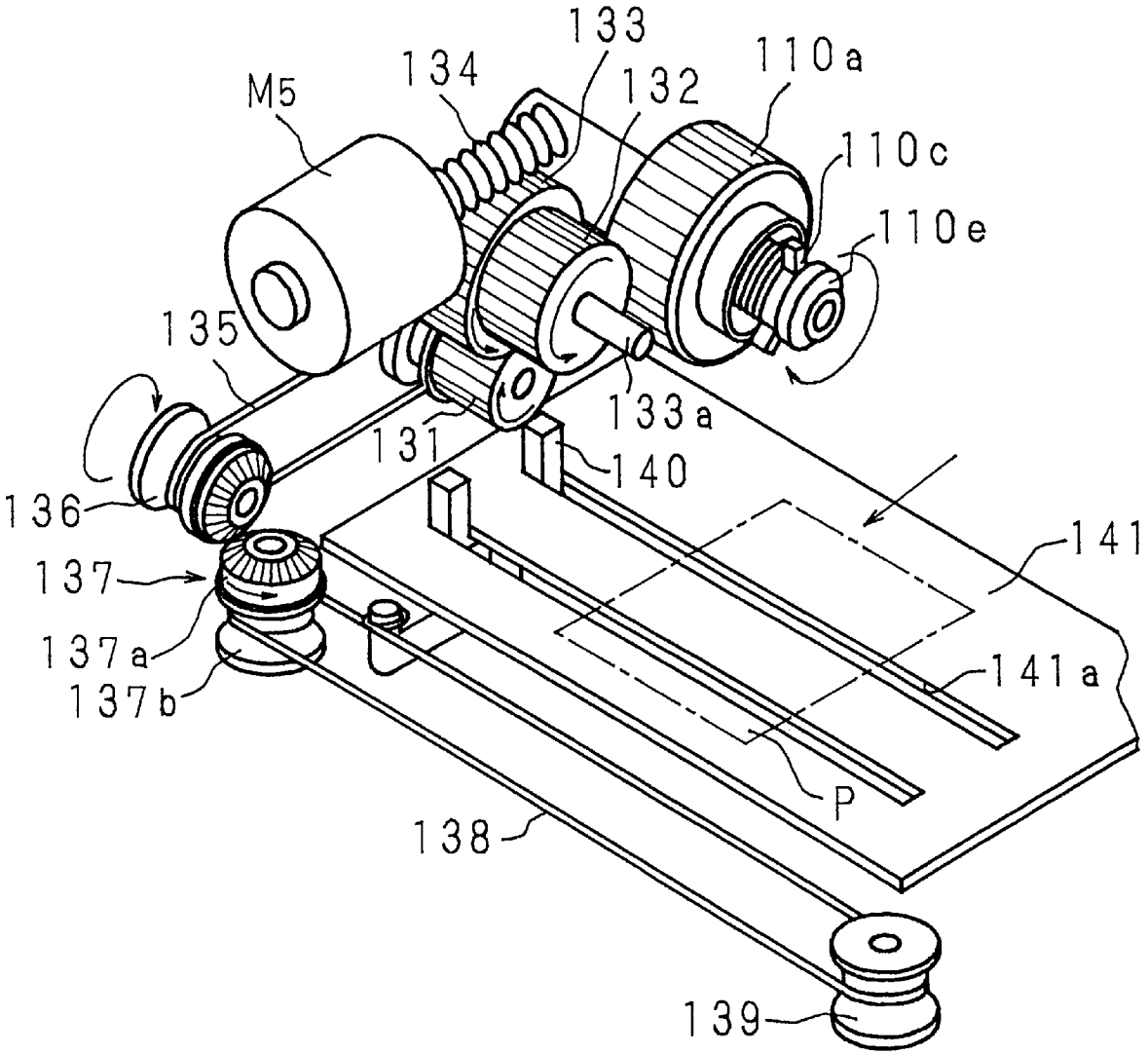
FIG. 88 is an explanatory view of an operation of a paper discharge unit and its drive system.
Figure 89:
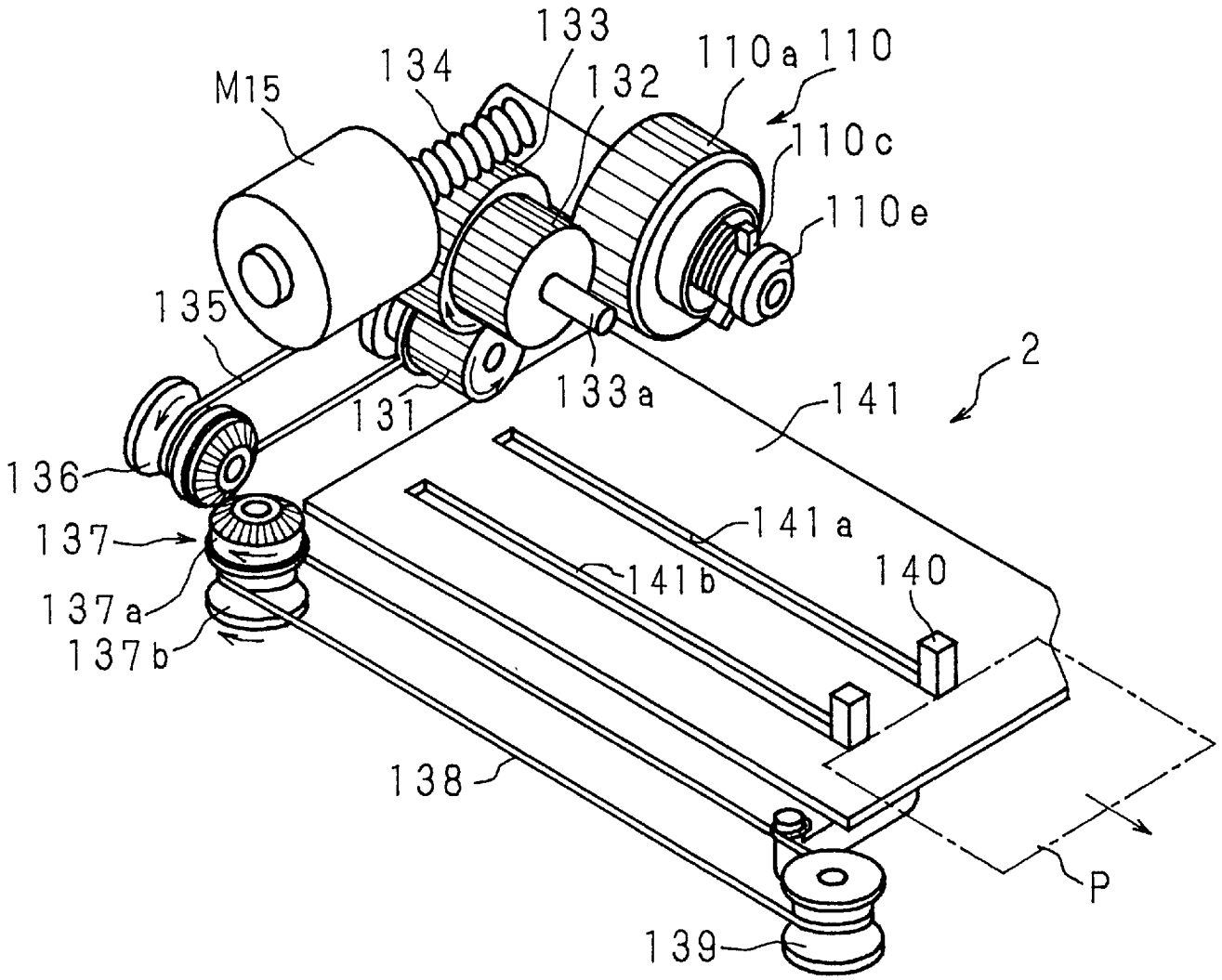
FIG. 89 is an explanatory view of an operation of a paper discharge unit and its drive system.

The operation of thus composed drive system is explained together with the explanatory views of operation shown in FIG. 88 and FIG. 89. In FIG. 88, the worm wheel 133 is rotated in the arrow direction by the rotation of the motor M15, and in this case as shown in FIG. 86(*b*), the gear 132 having the one-way clutch mechanism is rotated together in the arrow direction, and the gear 110*a* of the reel device 110 engaged therewith rotates in the arrow direction, thereby taking up to detect the beginning of the ink sheet S.

Besides, by the rotation of the pulley integrated gear 131, the pulley integrated bevel gear 136 rotates in the arrow direction, but since the discharge lever 140 abuts against the ends of the grooves 141*a*, 141*b* disposed in the paper guide plate 140 and the rotation in the arrow direction of the pulley 137*b* is loaded, slipping occurs between the bevel gear 137*a* and pulley 137*b*, and the pulley 137*b* does not rotate.

The printing paper P having been finished to be printed is sent out onto the paper guide plate 141 from the arrow direction as indicated by single dot chain line in FIG. 88, and is positioned by the guide plate not shown.

FIG. 89 shows the case where the motor M15 rotates reversely from the state shown in FIG. 88, and the worm wheel 133 is rotated in the direction of the arrow, in which as shown in FIG. 86(*c*), the shaft 133*a* and gear 132 idle, and the gear 110*a* does not rotate, and the reel device 110 stops. On the other hand, the pulley integrated gear 133 is rotated in the arrow direction, and the pulley integrated bevel gear 136 is rotated through the rubber belt 135, and the bevel gear 137*a* of the torque limiter 137 is rotated in the arrow direction.

In this state, since load is not applied to the rotation of the pulley 137*b* in the arrow direction, and the pulley 137*b* is also rotated together in the arrow direction, and moves the discharge lever 140, and discharges the printing paper P in the direction orthogonal to the previous conveying-in direction. As the discharge lever 140 is further moved to reach the ends of the grooves 141*a*, 141*b* provided in the paper guide 141 as shown in FIG. 89, the pulley 137*b* is loaded, and slipping occurs between the bevel gear 137*a* and pulley 137*b*, and the rotation of the pulley 137*b* stops.

Figure 90:
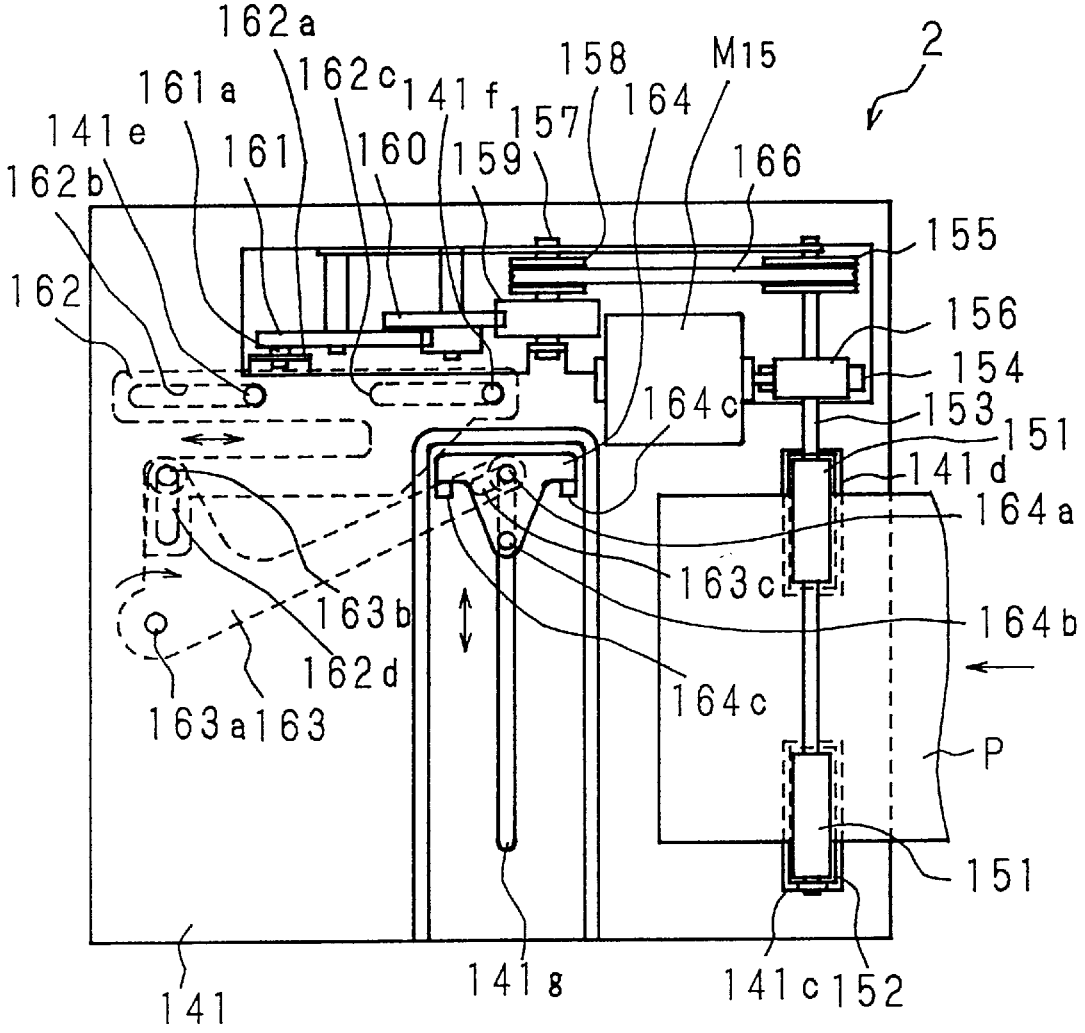
FIG. 90 is a schematic plan view showing a different example of paper discharge unit and its drive system.
Figure 91:
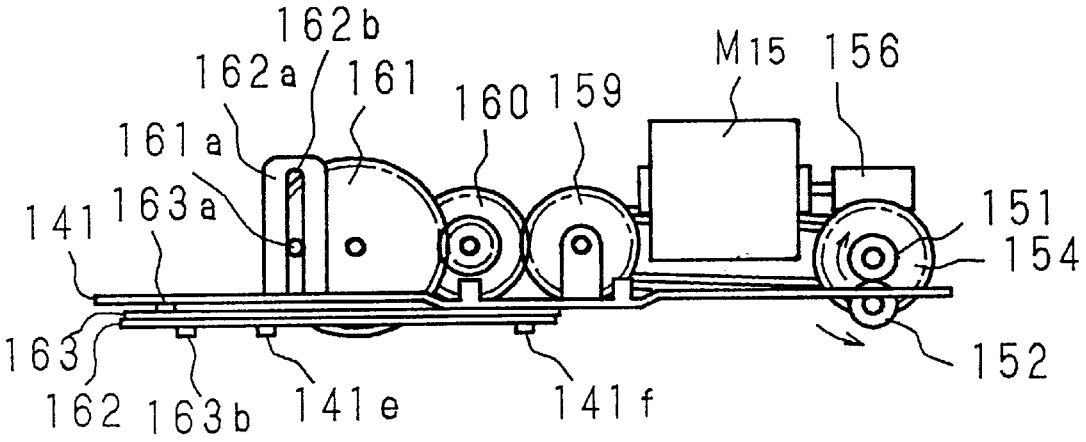
FIG. 91 is its schematic side view, FIGS. 92(*a*), (*b*) are its explanatory views of operation of the paper discharge unit, and FIGS. 93(*a*), (*b*) are its explanatory views of operations of the paper discharge unit.

FIG. 90 is a schematic plan view showing other example of the discharge unit 2, and FIG. 91 is its schematic side view. On the paper guide plate 141, the printing paper P is conveyed from the arrow direction in the same way as in the previous embodiment.

In the region of the conveyance of the printing paper P onto the paper guide plate 141, holes 141*c*, 141*d* are formed against both sides of the conveying direction of the printing paper P, and conveying rollers 151, 152 are disposed above and beneath the paper guide plate 141 against these holes 141*c*, 141*d* in mutually contacting state. The upper conveying roller 151 is a driving roller, and is fixed on the shaft 153.

The shaft 153 is provided with worm wheel 154 and pulley 155, and is coupled with the motor M15 through a worm gear 156 engaged with the worm wheel 154, and is linked with a pulley 158 disposed on the shaft 157 through the pulley 155 and worm gear 156.

The shaft 157 is provided with a gear 159 with one-way clutch function, together with a pulley 158, and the gear 159 idles on the shaft 157 while the conveying roller 151 is driven so as to convey the printing paper P onto the paper guide plate 141, or the motor M15 is rotating normally, and rotates together with the shaft 157 when the motor M15 is rotating reversely, thereby transmitting the output of the motor M15 to a cam gear 161 through a reduction gear 160.

The cam gear 161 has a pin 161*a* projecting at a position closer to the peripheral portion of the side face as shown in FIG. 91, and the pin 161*a* is inserted into a slot 162*b* in the longitudinal direction formed in an erecting piece 162*a* of an sliding lever 162. The sliding lever 162 is linked with a discharge block 164 through an swinging lever 163.

The sliding lever 162 and swinging lever 163 are disposed beneath the paper guide plate 141 parallel thereto. Pins 141*e*, 141*f* provided on the paper guide plate 141 are inserted into slots 162*b*, 162*c* formed at the sliding lever 162 in a direction parallel to the conveying direction of the printing paper P, and a pin 163*b* provided on the swinging lever 163 is inserted in a slot 162*d* formed in a direction orthogonal to the extending direction of the slots 162*b*, 162*c*, so as to move reciprocally in the arrow direction accompanying the rotation of the cam gear 161.

On the other hand, the swinging lever 163 is pivoted beneath the paper guide 141 by the shaft 163*a*, and is linked with the sliding lever 162 through the pin 163*c* disposed on one arm thereof, while a pin 164*a* disposed at the discharge block 164 is inserted in the hole 163*c* disposed on the other arm, thereby rotating about the shaft 163*a* accompanying the reciprocal move of the swinging lever 163.

The discharge block 164 is installed in a guide groove 141*g* extending in a direction orthogonal to the conveying direction of the printing paper P formed in the middle of the paper guide plate 141, so as to be movable reciprocally in the arrow direction through pins 164*a*, 164*b*, and a pair of stopping pieces 164*c* for pushing out the printing paper P are disposed in the upper portion, and as the swinging lever 163 rotates about the shaft 163*a*, the printing paper P is carried out in the arrow direction orthogonal to the conveying direction, so as to be discharged into a discharge tray not shown.

Figure 92A:
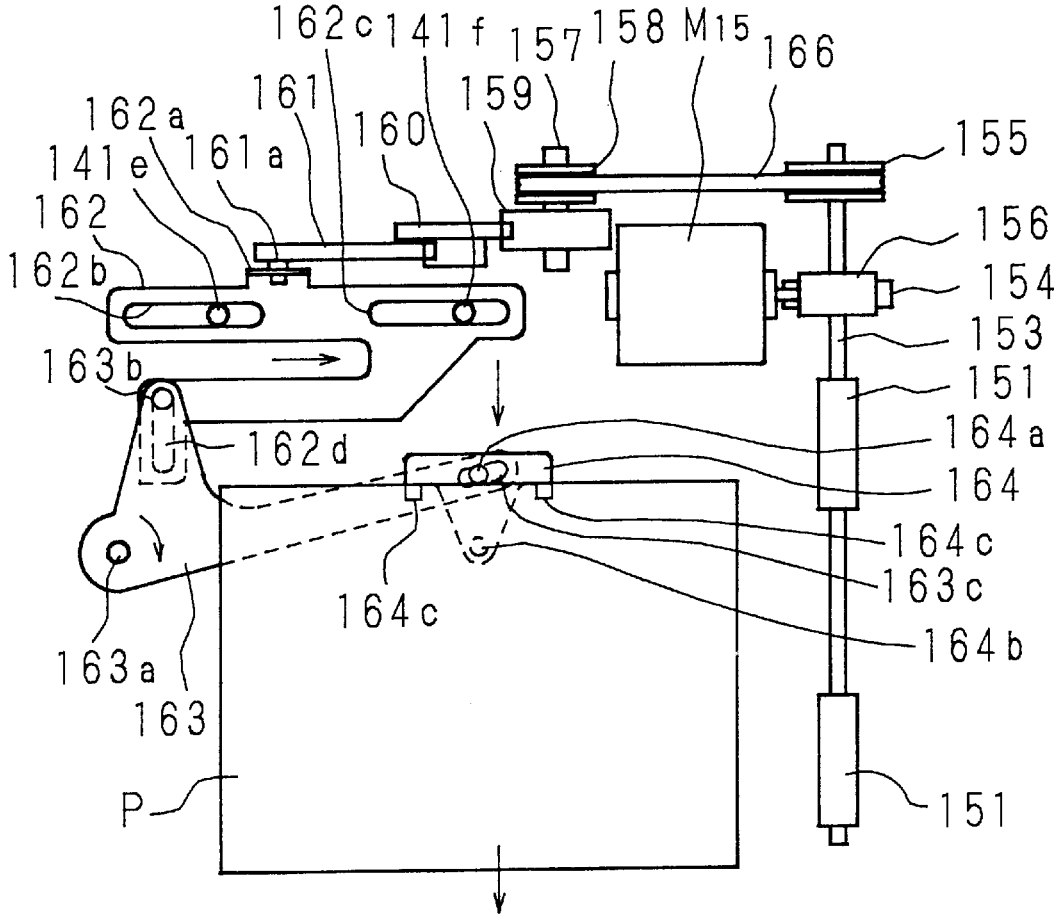
Figure 92B:
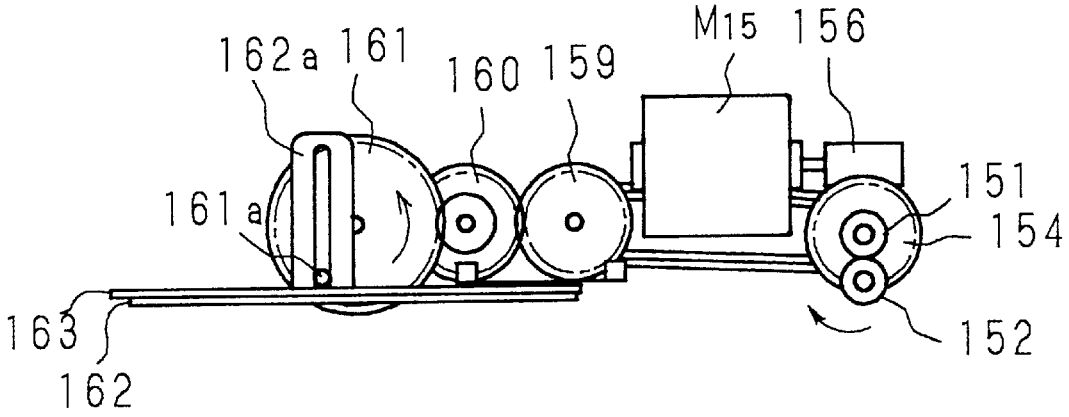

The operation of thus composed discharge unit 2 is described below while referring to the explanatory views of operation in FIG. 92 and FIG. 93. First, in FIG. 90 and FIG. 91, the torque of the motor M15 is transmitted to conveying rollers 151, 151 through worm gear 156, worm wheel 154 and shaft 153, and the conveying rollers 151, 151 are rotated in the arrow direction respectively as shown in FIG. 92, and the Printing paper P is conveyed into the paper guide plate 141 from the arrow direction shown in FIG. 90. At this time, idling occurs between the shaft 157 and the gear 159 having one-way clutch function, and the discharge block 164 is in stationary state.

When the printing paper P is completely pushed out onto the paper guide plate 141, it is released from between the conveying rollers 151, 152, and the motor M15 rotates reversely. The torque of the motor M15 is transmitted to the cam gear 161 through the worm gear 156, worm wheel 154, shaft 153, rubber belt 166, shaft 157, gear 159 and reduction gear 160, and the cam gear 161 is rotated in the arrow direction shown in FIG. 92. The sliding lever 162 moves parallel in the arrow direction shown in FIG. 92(*a*), and the swinging lever 163 rotates in the arrow direction about the shaft 163*a*, and the discharge block 164 moves in the arrow direction, thereby pushing out the printing paper P in the arrow direction by the stopping pieces 164*c*, 164*c*.

Figure 93A:
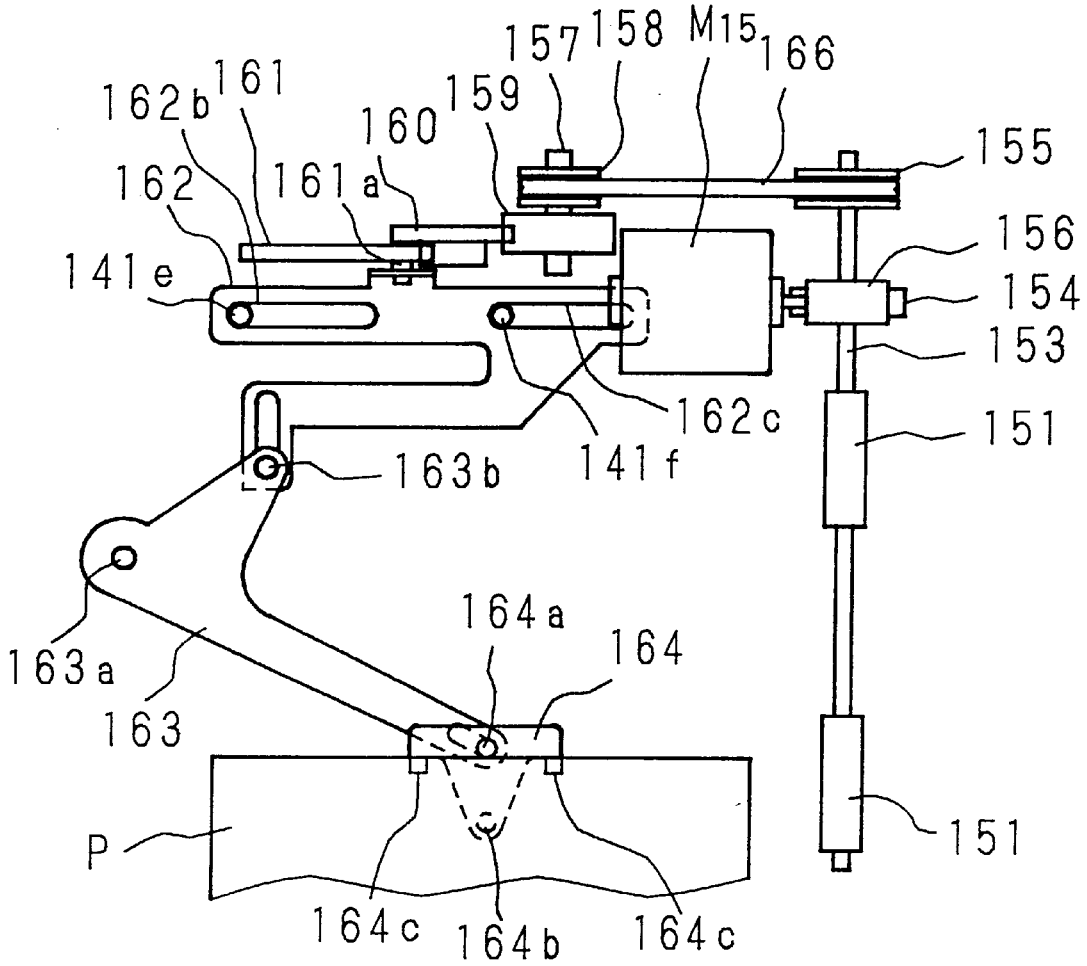
Figure 93B:
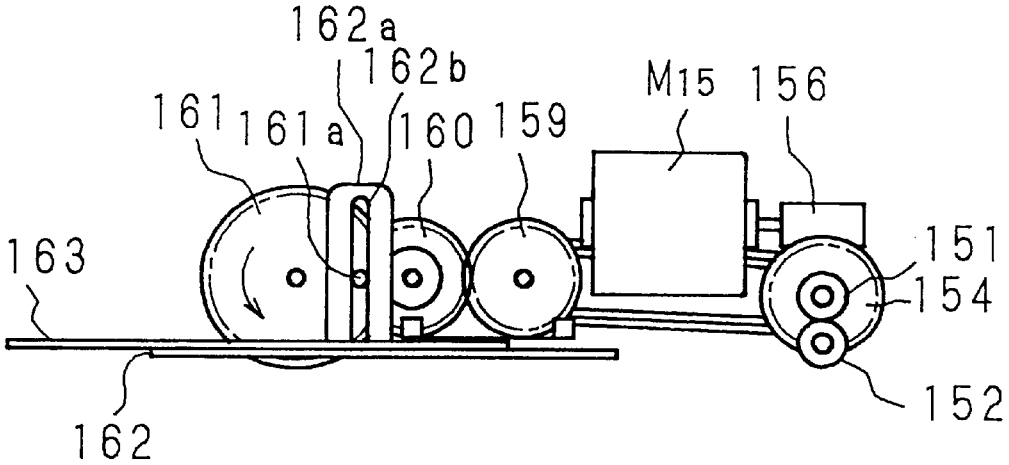

FIG. 93 shows the state where the cam gear 161 rotates by 180° from the state in FIG. 92 and the printing paper P is about to be discharged from the paper guide plate 141. The cam gear 161 keeps rotating further, rotating 360° from the state in FIG. 92 to return to the state in FIG. 92, when the discharge block 164 is pulled back to the former position shown in FIG. 90, and the motor M15 stops rotating, and discharge action is over. Again, the motor M15 is put in normal rotation, and the head of the ink sheet S is detected and led out, and thereafter the same operation is repeated.

In a such drive system, by discharging the printing paper P conveyed onto the paper guide plate 141 by the conveying roller 151 by force, the printing paper P is discharged securely to prevent paper jamming and other troubles, and since the specified discharge action is over when the cam gear 161 makes one revolution, the discharge block 164 may be removed reciprocally only by varying the rotating direction of the motor M15, and moreover by using the gear 159 having one-way clutch function, transfer of the printing paper P by the conveying roller and discharge of the printing paper P by the discharge block 164 may be effected by one motor M15, and the number of motors required is smaller, which contributes to downsizing of the apparatus and enhancement of the reliability.

In the present invention, the first conveying path from the printing unit to the discharge unit is nearly linear, and it joins on its way with the second conveying path from the feed unit to the printing unit, so that the conveying path of the printing paper is shortened, and conveying troubles of the printing paper may be decreased, and the size may be further reduced.

In the present invention, also, since the paper supply port is disposed at the bottom of the paper cassette, the conveying path until the paper to be fed is taken into the conveying path is shortened, and the constitution is simplified, and the reliability is heightened by decreasing the paper conveying and supplying troubles.

In the present invention, also, since the conveying roller is provided with slide preventive means on the printing paper, the printing paper may be positioned accurately, and dislocation of printing position and color deviation may be prevented, and hence the printing quality may be improved.

Further, in the present invention, the printing head is accurately moved and positioned on the platen roller, and color deviation in color printing may be prevented, and the printing quality may be enhanced further.

Furthermore, in the present invention, since the printing head is held tiltably so as not to be parallel to the platen roller, and therefore the printing head is pressed with a uniform pressure on the platen roller, that is, on the printing paper, so that the printing density may be uniform.

As this invention may be embodied in several forms without departing from the spirit of essential characteristics thereof, and the present embodiments are therefore illustrative and not restrictive, since the scope of the invention is defined by the appended claims rather than by the description preceding them, and all changes that fall within meets and bounds of the claims,or equivalent of such meets and bounds thereof are therefore intended to be embraced by the claims.

What is claimed is:

1. A printing apparatus comprising:

a printing paper supply unit providing a printing paper by outputting printing paper from the bottom thereof;

a printing unit positioned on one side of said printing paper supply unit for printing on the printing paper;

a printing paper discharge unit positioned below said printing paper supply unit; and a printing paper conveying path for connecting said printing paper supply unit and discharge unit with said printing unit, said conveying path including a first conveying path linking said printing unit and said discharge unit and extending substantially linearly and horizontally to allow said printing paper to move reciprocally, a second conveying path linking said paper supply unit and printing unit and joining said first conveying path at an intermediate position between said printing unit and said discharge unit with a predetermined angle, and a third conveying path positioned at an extended region of the function of said first conveying path and said second conveying path, and extending from behind said printing unit to a side wall of an outer housing, from which said third conveying path curves upwardly alone the side wall.

2. A printing apparatus comprising:

a printing paper supply unit providing printing paper from a printing paper stack, said printing paper supply unit including;

a paper cassette containing a casing unit, pivotable about an axis located toward one end of said casing unit, for supporting said printing paper stack, a paper supply roller positioned beneath said paper cassette, a push-down lever which, during an active state, pushes down said casing unit to a predetermined position to fix relative positional relation between said paper cassette and said casing unit, and a pressing lever which, during an active state, presses against the top of said printing paper stack with specified pressure thereby creating friction between said paper supply roller and the bottom piece of printing paper on said printing paper stack sufficient to convey said bottom piece of printing paper, wherein as successive pieces of printing paper are conveyed from the bottom of said paper stack thereby decreasing the size of said printing paper stack, the pressure applied to the top of said printing paper stack causes said casing unit to pivot downward to ensure the proper conveyance of each piece of printing paper without moving the location of said supply roller;

a printing unit for printing on said printing paper; a printing paper discharge unit; and a printing paper conveying path for connecting said printing paper supply unit and discharge unit with said printing unit.

3. A thermal printing apparatus comprising;

a printing paper feed unit;

a printing unit including a thermal head for printing on the printing paper by transferring ink from an ink sheet interposed between the thermal head and printing paper by applying a predetermined electric signal to said thermal head and passing the printing paper and said interposed ink sheet between said thermal head and a platen; and a printing paper discharge unit;

said printing paper feed unit including;

a paper cassette containing a casing unit, pivotable about an axis located toward one end of said casing, for supporting a printing paper stack, a paper supply roller positioned beneath said paper cassette, a push-down lever which, during an active state, pushes down said casing unit to a predetermined position to fix relative positional relation between said paper cassette and said casing unit, and a pressing lever which, during an active state, presses against the top of said printing paper stack with specified pressure thereby creating friction between said paper supply roller and the bottom piece of printing paper on said printing paper stack sufficient to convey said bottom piece of printing paper, wherein as successive pieces of printing paper are conveyed from the bottom of said paper stack thereby decreasing the size of said printing paper stack, the pressure applied to the top of said printing paper stack causes said casing unit to pivot downward to ensure the proper conveyance path of each piece of printing paper without moving the location of said supply roller;

said printing unit including an ink sheet feed unit including;

an ink sheet winding roll which winds up the used ink sheet, an ink sheet feeding roll which feeds the unused ink sheet, and an ink sheet cassette which contains said ink sheet winding roll and said ink sheet feeding roll, and is mounted at the position where said platen contacts with the ink side of said ink sheet;

said printing paper discharge unit including;

a discharge roller which discharges the printing paper after printing, and a paper guide which guides the printing paper to move the printing paper in a predetermined direction during paper conveying and printing processing.

4. A thermal printing apparatus comprising:

a printing paper feed unit;

a printing unit including a thermal head for printing on the printing paper by transferring ink from an ink sheet interposed between the thermal head and printing paper by applying a predetermined electric signal to said thermal head and passing the printing paper and said interposed ink sheet between said thermal head and a platen; and a printing paper discharge unit;

said printing paper feed unit including, a paper cassette containing a casing unit, pivotable about an axis located toward one end of said casing, for supporting a printing paper stack and including a paper feed port for feeding the printing paper from lower side thereof, a paper supply roller positioned beneath said paper cassette, a push-down lever which, during an active state pushes down said casing unit to the predetermined position to fix relative positional relation between said paper cassette and said casing unit, a pressing lever which, during an active state, presses against the top of said printing paper stack with specified pressure thereby creating friction between said paper supply roller and the bottom piece of printing paper on said printing paper stack sufficient to convey said bottom piece of printing paper, wherein as successive pieces of printing paper are conveyed from the bottom of said paper stack thereby decreasing the size of said printing paper stack, the pressure applied to the top of said printing paper stack causes said casing unit to pivot downward to ensure the proper conveyance path of each piece of printing paper without moving the location of said supply roller, and a paper guide which guides the printing paper to move the printing paper in a predetermined direction.

5. A printing apparatus comprising:

a printing paper supply unit; and a printing unit for printing on the printing paper, said printing unit including a printing paper feed unit including, a capstan roller as a driving roller which conveys the printing paper and a pinch roller as a driven roller which is disposed opposite to said capstan roller, said capstan roller being disposed at the side of the printing paper opposite the printing face thereof and said pinch roller is disposed at the printing side of the printing paper, said capstan roller having, on a surface thereof, projection rows regularly arranged at an angle direction with respect to the paper conveying direction within a predetermined range and at an interval whose direction is perpendicular to said angle direction within a predetermined range.

6. A printing apparatus as set forth in claim 5, wherein said predetermined range of angle direction is 20° to 40°, and said predetermined range of interval is 0.1 mm to 1.0 mm.

7. A printing apparatus as set forth in claim 5, wherein said projection rows on the surface of said capstan roller are divided into two portions along an axial direction of said capstan roller and each portion is disposed adjacent an end portion of the printing paper.

8. A printing apparatus comprising:

a printing paper supply unit, and a printing unit for printing on the printing paper, said printing unit including a printing paper feed unit including, a capstan roller as a driving roller which conveys the printing paper and a pinch roller as a driven roller which is disposed opposite to said capstan roller, said capstan roller being disposed at the side of the printing paper opposite the printing face thereof and said pinch roller being disposed at the printing side of the printing paper, said capstan roller having, on a surface thereof, projection rows regularly arranged at an angle direction with respect to the paper conveying direction within a predetermined range and at an interval whose direction is perpendicular to said angle direction within a predetermined range;

wherein said capstan roller is provided with a handle which enables manual rotation of said capstan roller.

9. A printing apparatus comprising:

a printing paper supply unit;

a printing unit for printing on the printing paper, said printing unit including a printing paper feed unit including, a capstan roller as a driving roller which conveys the printing paper and a pinch roller as a driven roller which is disposed opposite to said capstan roller, said capstan roller being disposed at the side of the printing paper opposite the printing face thereof and said pinch roller is disposed at the printing side of the printing paper, said capstan roller having, on a surface thereof, projection rows regularly arranged at an angle direction with respect to the paper conveying direction within a predetermined range and at an interval whose direction is perpendicular to said angle direction within a predetermined range;

a handle provided on said capstan roller and enabling manual rotation of said capstan roller; and means for moving said handle in the axial direction of said capstan roller.

10. A printing apparatus as set forth in claim 9, comprising:

a sendor detecting whether said handle is moved axially away from said capstan roller;

a motor driving said capstan roller, said motor generating a holder torque for preventing said capstan roller from free rotation by disturbance of the applying voltage in the case where said motor does not drive; and means for cutting current to said motor in the case where said sensor detects that said handle is moved axially away from said capstan roller.

11. A printing apparatus comprising:

a printing paper feed unit; and a printing unit having a printing head which is selectively moved to a predetermined position adjacent to a platen roller;

said printing head being supported by a supporting member movable in forward and reverse direction with respect to the conveying direction of the printing paper, and being positioned at the predetermined position of said platen roller by a guide member when moved to the printing position, wherein said supporting member is attached to and movable along a coupling shaft positioned substantially parallel to the conveying direction of the printing paper.

12. A printing apparatus comprising:

a printing paper feed unit; and a printing unit having a printing head which is selectively moved to a predetermined position adjacent to a platen roller;

said printing head being supported by a supporting member tiltable with respect to the axis of said platen roller and movable in forward and reverse direction with respect to the conveying direction of the printing paper, and being positioned at the predetermined position of said platen roller by a guide member when moved to the printing position, wherein said supporting member is attached to and movable along a coupling shaft positioned substantially parallel to the conveying direction of the printing paper.

13. A thermal printing apparatus comprising:

a printing paper feed unit feeding printing paper along a paper path; and a printing unit including a thermal head for printing on the printing paper by transferring ink from an ink sheet interposed between the thermal head and printing paper by applying a predetermined electric signal to said thermal head and passing the printing paper and said interposed ink sheet between said thermal head and a platen;

said printing paper feed unit including a capstan roller and a pinch roller for feeding the printing paper, said pinch roller including a plurality of rollers which are suspended independently, and disposed coaxially and symmetrically in an axial direction;

a sensor for detecting the front end of the printing paper provided at center of said rollers adjacent said printing path; and a reflector for said sensor provided adjacent said printing path on one side thereof opposite said sensor and functioning as a paper conveying guide.

14. A thermal printing apparatus comprising:

a printing unit including a thermal head which transfers ink from an ink sheet while winding said ink sheet by an ink sheet conveying unit;

a discharge unit which discharges the printing paper after the transfer of said ink by said printing unit; and a driving power train which transmits driving power from a single motor serving as a power source, said driving power train transmitting driving power from said single motor to drive said ink sheet conveying unit and said discharge unit, said driving power train including;

a one way clutch which transmits driving power to said ink sheet conveying unit when said motor rotates in one direction and does not transmit driving power to said ink sheet conveying unit when said motor rotates in a direction opposite said one direction.

15. A printing apparatus as set forth in claim 14 futher comprising a:

torque limiter which slips to limit transmission of drive power to said discharge unit.

16. A thermal printing apparatus comprising:

a paper handling mechanism for passing a printing paper along a paper path;

a thermal head disposed adjacent said paper path;

an ink sheet provided between said paper path and said thermal head and having ink disposed thereon on at least one inked portion;

a platen securing said printing paper and said ink sheet into engagement with said thermal head;

said thermal head transferring said ink from said ink sheet to said printing paper to print a desired image thereon;

a pinch roller assembly provided along said paper path for driving said printing paper past said thermal head;

a paper registration sensor assembly located adjacent said pinch roller assembly along said paper path for detecting the front edge of said printing paper, said paper registration sensor assembly including;

a reflection sensor including a source and a sensor, a reflector for reflecting light from said source to said sensor, said reflector further functioning as a printing paper guide defining at least part of said paper path, said reflection sensor and said reflector being arranged with said paper path disposed therebetween.

17. The thermal printing apparatus of claim 16 wherein said paper path has a width dimension transverse thereto, said reflection sensor being centered in said paper path midway said width dimension and offset along said paper path from said pinch roller assembly in the direction opposite that of said platen.

18. The thermal printing apparatus of claim 16 wherein said paper registration sensor detects the front edge of said printing paper to register the printing paper to the ink sheet and thermal head.

19. The thermal printing apparatus of claim 18 further comprising:

an ink registration sensor for detecting a predetermined mark on said ink sheet to facilitate alignment of said inked portions of said ink sheet, said ink registration sensor detecting the alignment of an inked portion of said inked sheet to facilitate registration with said printing paper and said thermal head to facilitate printing on said printing paper.

20. The thermal printing apparatus of claim 19 wherein said ink registration sensor further includes, a reflection sensor including a source and a sensor, a reflector for reflecting light from said source to said sensor, said reflection sensor and said reflector being arranged with said ink sheet disposed therebetween.

21. The thermal printing apparatus of claim 16 wherein said pinch roller assembly includes a plurality of pinch rollers.

22. A thermal printing apparatus comprising:

a paper handling mechanism for passing a printing paper along a paper path;

a thermal head disposed adjacent said paper path;

an ink sheet cassette removable from said thermal printing apparatus and including, first and second substantially parallel and spaced bobbins;

an ink sheet wound between said first and second bobbins and having ink disposed on at least a portion thereof, and a cassette housing including two substantially cylindrical portions receiving said first and second bobbins and first and second connecting webs separating said first and second bobbins, said connecting webs having an opening therebetween in which said ink sheet may be accessed;

said thermal head transferring said ink from said ink sheet to said printing paper to print a desired image thereon;

a guide supporting said ink sheet cassette, facilitating its slidable insertion into the remainder of said thermal printing apparatus in a direction transverse to the paper path and positioning said ink sheet cassette so that said ink sheet is in proper relationship between said thermal head and said printing paper to facilitate printing;

a stopper for latching said ink sheet cassette in alignment with said paper path under condition of sliding to one position, and releasing said ink sheet cassette under condition of sliding to another position, said stopper latching on a portion of one of said first and second connecting webs.

23. A thermal printing apparatus comprising:

a paper handling mechanism for passing a printing paper along a paper path;

a thermal head disposed adjacent said paper path;

an ink sheet cassette removable from said thermal printing apparatus and including, first and second substantially parallel and spaced bobbins, an ink sheet wound between said first and second bobbins and having ink disposed on at least a portion thereof, and a cassette housing including two substantially cylindrical portions receiving said first and second bobbins and first and second connecting webs separating said first and second bobbins, said connecting webs having an opening therebetween in which said ink sheet may be accessed;

said thermal head transferring said ink from said ink sheet to said printing paper to print a desired image thereon;

a guide supporting said ink sheet cassette, facilitating its slidable insertion into the remainder of said thermal printing apparatus in a direction transverse to the paper path and positioning said ink sheet cassette so that said ink sheet is in proper relationship between said thermal head and said printing paper to facilitate printing;

a stopper for latching said ink sheet cassette in alignment with said paper path, said stopper latching on a portion of one of said first and second connecting webs;

a drive blade engaged with a drive end of said bobbin exposed from said cassette and transmitting torque to said bobbin;

a reel disk which slidably supports said drive blade and has a shaft whose sliding length is sufficient to enable engagement between said drive blade and said drive end of said bobbin, and which rotates integrally with said blade;

a spring which pushes said blade into engagement with said bobbin, and which has an extending force strong enough to discharge said cassette out of the apparatus.

24. A thermal printing apparatus comprising:

a paper handling mechanism for passing a printing paper along a paper path;

a thermal head disposed adjacent said paper path;

an ink sheet cassette removable from said thermal printing apparatus and including, first and second substantially parallel and spaced bobbins, an ink sheet wound between said first and second bobbins and having ink disposed on at least a portion thereof, and a cassette housing including two substantially cylindrical portions receiving said first and second bobbins and first and second connecting webs separating said first and second bobbins, said connecting webs having an opening therebetween in which said ink sheet may be accessed;

said thermal head transferring said ink from said ink sheet to said printing paper to print a desired image thereon;

a guide supporting said ink sheet cassette, facilitating its slidable insertion into the remainder of said thermal printing apparatus in a direction transverse to the paper path and positioning said ink sheet cassette so that said ink sheet is in proper relationship between said thermal head and said printing paper to facilitate printing; and a stopper for latching said ink sheet cassette in alignment with said paper path, said stopper latching on a portion of one of said first and second connecting webs;

wherein said stopper is beveled at the end thereof and includes a bias spring biasing said stopper in a fully extended position, said ink sheet cassette, when fully inserted in said thermal printing apparatus, forcing aside the bevel of said stopper against the force of said bias spring to allow said ink cartridge to be inserted past said stopper;

said stopper fully extending under the bias of said spring to latch said ink cassette into said thermal printing apparatus.

25. The thermal printing apparatus of claim 24 wherein said stopper latches to a connecting web of said cassette housing.

26. A thermal printing apparatus comprising:

a paper handling mechanism for passing a printing paper along a paper path;

a thermal head disposed adjacent said paper path;

an ink sheet cassette including an ink sheet having ink disposed on at least a portion thereof, said ink sheet cassette having an opening therein in which said ink sheet may be accessed, said ink sheet cassette being inserted in a cassette case, said cassette case including a stopper, moveable between release and engage positions, for preventing said ink sheet cassette from slipping out of position when inserted in said cassette case, said inserted ink sheet cassette being opposed by a dilating force created by a dilating force member such that movement of said stopper to the release position causes said dilating force to disengage said ink sheet cassette from said cassette case;

a platen securing said printing paper and said ink sheet into engagement with said thermal head;

said thermal head engaging said ink sheet, printing paper and platen through said opening in said ink sheet cassette when a printing operation is to be performed.

27. The thermal printing apparatus of claim 26 wherein said thermal head is movably mounted so as to be inserted through said opening in said ink sheet cassette to a printing position in engagement with said ink sheet, printing paper and platen.

28. The thermal printing apparatus of claim 26 further comprising an ink sheet guide mounted to said thermal head and separating the ink sheet from said thermal head when no printing operation is performed.

29. The thermal printing apparatus of claim 28 wherein said thermal head includes a heat generation unit;

said ink sheet guide separating said ink sheet from those portions of said thermal head spaced away from said heat generation unit even when no printing operation is being performed.

30. The thermal printing apparatus of claim 26 wherein said thermal head thermally transfers ink from said ink sheet to said printing paper.

31. The thermal printing apparatus of claim 26 wherein said ink sheet cassette includes, supply and take up reels having substantially parallel and spaced apart axes, said ink sheet being wound therebetween;

said opening in said ink sheet cassette being provided between said supply and take up reels and extending substantially parallel to said axes thereof.

32. The thermal printing apparatus of claim 31 further comprising an ink sheet guide guiding said ink sheet when said thermal head is pressed to said platen;

said ink sheet guide being positioned between said platen and one of said supply and take up reels of said ink sheet cassette when said thermal head is pressed against said platen.

33. The thermal printer of claim 32 wherein said ink sheet guide is positioned between said platen and said take up reel.

34. The thermal printer of claim 33 wherein said ink sheet guide is mounted to said thermal head.

35. The thermal printing apparatus of claim 27 wherein said thermal head is supported by a support arm pivotally supported by a shaft, said support arm being pivoted on said shaft to selectively present said thermal head against said ink sheet and printing paper disposed in said paper path.

36. The thermal printing apparatus of claim 35 wherein said support arm is U-shaped so as to enable clearance around said ink sheet cassette.

37. A thermal printing apparatus comprising:

a paper handling mechanism for passing a printing paper along a paper path;

a thermal head disposed adjacent said paper path;

an ink sheet provided between said paper path and said thermal head and having ink disposed thereon on at least one inked portion;

a platen securing said printing paper and said ink sheet into engagement with said thermal head;

said thermal head transferring said ink from said ink sheet to said printing paper to print a desired image thereon;

a drive roller assembly provided along said paper path for driving said printing paper past said thermal head, said drive roller assembly including first and second drive rollers; said first drive roller being positioned on the same side of said paper path as said thermal head and having a diameter smaller than said second roller and being positioned adjacent said thermal head to reduce the unprinted edge portion of a printed image printed by said thermal printer on said printing paper;

a paper registration sensor assembly co-located with said drive roller assembly along said paper path for detecting a front edge of said printing paper, said paper registration sensor assembly including;

a reflection sensor including a source and a sensor, a reflector for reflecting light from said source to said sensor, said reflection sensor and said reflector being arranged with said paper path disposed therebetween so as to detect an edge of said paper.

38. The thermal printing apparatus of claim 37 wherein said first and second rollers are pinch and capstan rollers respectively.

39. The thermal printing apparatus of claim 38 wherein said pinch roller is formed of a resilient material.

40. The thermal printing apparatus of claim 37 wherein said reflector further functions as a printing paper guide defining at least part of said paper path.

41. A thermal printing apparatus comprising:

a paper handling mechanism for passing a printing paper along a paper path;

a thermal head disposed adjacent said paper path;

an ink sheet having ink disposed on at least a portion thereof;

a platen securing said printing paper and said ink sheet into engagement with said thermal head;

said thermal head being movable to an engaged position where said thermal head is positioned in engagement with said ink sheet, printing paper and platen; and a movable paper guide which pivots about a guide support shaft and is shifted into an operating position by a force imparted to a pivoting end of said movable paper guide by said thermal head as said thermal head shifts to said engaged position to form a part of said paper path and to guide printing paper along said paper path past said thermal head when said thermal head is moved into the engaged position.

42. The thermal printing apparatus of claim 41 wherein said movable paper guide is spring biased to more fully open said paper path.

43. A thermal printing apparatus comprising:

a paper handling mechanism for passing a printing paper along a paper path;

a thermal head disposed adjacent said paper path;

an ink sheet provided between said paper path and said thermal head and having ink disposed thereon on at least one inked portion;

a platen securing said printing paper and said ink sheet into engagement with said thermal head and having a platen axis substantially perpendicular to the direction of paper travel along said paper path;

said thermal head transferring said ink from said ink sheet to said printing paper to print a desired image thereon;

said thermal head being supported by a support arm pivotally supported by a shaft, said support arm being pivoted on said shaft to selectively present said thermal head against said ink sheet and printing paper disposed in said paper path, said support arm being coupled to and moveable alone a coupling shaft positioned substantially parallel to the conveying direction of the printing paper.

44. The thermal printing apparatus of claim 43 wherein said shaft supporting said support arm has an axis substantially parallel to said platen axis;

said thermal head being attached to said support arm so as to pivot about a coupling shaft substantially parallel to the paper path, said thermal head being movable about said axis so as to ensure that said thermal head conforms to the surface of said platen.

45. The thermal printing apparatus of claim 44 wherein said thermal head is further attached to said support arm by first and second contact springs which constrain the rotation of said thermal head about said coupling shaft and allow said thermal head to apply a relatively constant force to said platen across the width of said paper path.

46. The thermal printing apparatus of claim 44 wherein said thermal head is further slidable on said coupling shaft to thereby provide two dimensional positional correction of said thermal head with respect to said platen.

47. The thermal printing apparatus of claim 43 wherein said shaft supporting said support arm has an axis substantially parallel to said platen axis;

said thermal head being attached to said support arm by two dimensional position adjustment means for adjusting the position of said thermal head with respect to said platen.

48. The thermal printing apparatus of claim 47 wherein said two dimensional position adjustment means adjusts said thermal head in a direction substantially parallel to said paper path and further moves said thermal head about an axis substantially parallel to said paper path so as to ensure that said thermal head conforms to the surface of said platen.

49. The printing apparatus as set forth in claim 1, wherein the inlet of said third conveying path has a movable paper guide for leading the printing paper which passes said printing unit to said third conveying path.

* * * * *